US009959825B2

(12) United States Patent
Kobayashi et al.

(10) Patent No.: US 9,959,825 B2
(45) Date of Patent: May 1, 2018

(54) LIQUID CRYSTAL DISPLAY DEVICE AND METHOD OF DRIVING THE SAME

(71) Applicant: Sharp Kabushiki Kaisha, Osaka-shi, Osaka (JP)

(72) Inventors: Fumiyuki Kobayashi, Osaka (JP); Asahi Yamato, Osaka (JP); Akizumi Fujioka, Osaka (JP); Ken Inada, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 150 days.

(21) Appl. No.: 14/780,639

(22) PCT Filed: Feb. 21, 2014

(86) PCT No.: PCT/JP2014/054205

§ 371 (c)(1),
(2) Date: Sep. 28, 2015

(87) PCT Pub. No.: WO2014/156402

PCT Pub. Date: Oct. 2, 2014

(65) Prior Publication Data

US 2016/0055812 A1 Feb. 25, 2016

(30) Foreign Application Priority Data

Mar. 29, 2013 (JP) ..... 2013-074058

(51) Int. Cl.
*G09G 3/36* (2006.01)
*G09G 3/20* (2006.01)

(52) U.S. Cl.
CPC ..... *G09G 3/3648* (2013.01); *G09G 3/2092* (2013.01); *G09G 3/3611* (2013.01);
(Continued)

(58) Field of Classification Search
CPC .. G09G 3/3648; G09G 3/3614; G09G 3/3696; G09G 3/2025; G09G 3/2011;
(Continued)

(56) References Cited

U.S. PATENT DOCUMENTS

2003/0179175 A1 9/2003 Shigeta et al.
2008/0284699 A1* 11/2008 Yano ..... G09G 3/2025 345/89

(Continued)

FOREIGN PATENT DOCUMENTS

JP 2004-004629 A 1/2004
JP 2011-170327 A 9/2011

OTHER PUBLICATIONS

Official Communication issued in International Patent Application No. PCT/JP20141054205, dated May 27, 2014.

*Primary Examiner* — Richard Hong
(74) *Attorney, Agent, or Firm* — Keating & Bennett, LLP

(57) ABSTRACT

A liquid crystal display device that performs intermittent driving involving a driving period and an idle period includes a gray scale level control unit that generates, from an input image signal, an image signal for display and an image signal for correction. A signal line control unit writes the image signal for correction to the plurality of signal lines before writing the image signal for display during a driving period. An LUT stores a correction gray scale value associated with a gray scale value of at least a current frame. An adding circuit corrects the input image signal based on the correction gray scale value read from the LUT. The subtracting circuit specifies, in a pixel region, a regular image pattern including at least a first pixel and a second pixel and changes an output from the adding circuit for the first image by a predetermined gray scale width.

23 Claims, 46 Drawing Sheets

(52) U.S. Cl.
CPC ..... *G09G 3/3614* (2013.01); *G09G 3/3696* (2013.01); *G09G 2300/0452* (2013.01); *G09G 2310/027* (2013.01); *G09G 2320/02* (2013.01); *G09G 2320/0252* (2013.01); *G09G 2320/046* (2013.01); *G09G 2330/021* (2013.01); *G09G 2340/16* (2013.01); *G09G 2360/16* (2013.01); *G09G 2360/18* (2013.01)

(58) Field of Classification Search
CPC ..... G09G 3/2092; G09G 3/3611; G09G 2320/02; G09G 2320/0252; G09G 2340/16; G09G 2360/16; G09G 2310/027; G09G 2320/046; G09G 2330/021; G09G 2300/0452; G09G 2360/18; G02F 1/136286
See application file for complete search history.

(56) References Cited

U.S. PATENT DOCUMENTS

| | | | | |
|---|---|---|---|---|
| 2009/0315920 | A1* | 12/2009 | Sakurai | G09G 3/2011 345/690 |
| 2011/0175883 | A1 | 7/2011 | Toyotaka et al. | |
| 2011/0298774 | A1* | 12/2011 | Yamada | G09G 3/3614 345/211 |
| 2012/0218322 | A1* | 8/2012 | Shiomi | G02F 1/136286 345/690 |
| 2014/0085356 | A1* | 3/2014 | Tanaka | G09G 3/3696 345/691 |
| 2015/0235600 | A1 | 8/2015 | Inada et al. | |

* cited by examiner

| | | GRAY SCALE VALUE OF CURRENT FRAME | | | | | | | | |
|---|---|---|---|---|---|---|---|---|---|---|
| | | 0 | 32 | 64 | 96 | 128 | 160 | 192 | 224 | 255 |
| GRAY SCALE VALUE OF PRECEDING FRAME | 0 | 3 | 8 | 7 | 6 | 5 | 3 | 1 | 1 | 1 |
| | 32 | 4 | 5 | 9 | 8 | 7 | 6 | 6 | 4 | 4 |
| | 64 | 5 | 6 | 4 | 9 | 5 | 5 | 4 | 4 | 3 |
| | 96 | 4 | 7 | 4 | 4 | 4 | 4 | 3 | 2 | 2 |
| | 128 | 3 | 3 | 4 | 4 | 4 | 5 | 4 | 4 | 2 |
| | 160 | 3 | 3 | 4 | 4 | 4 | 1 | 4 | 4 | 1 |
| | 192 | 2 | 3 | 3 | 3 | 3 | 4 | 0 | 5 | 1 |
| | 224 | 2 | 2 | 2 | 2 | 3 | 3 | 3 | −2 | 0 |
| | 255 | 1 | 2 | 2 | 3 | 3 | 2 | 1 | 1 | −3 |

FIG. 3

| GRAY SCALE LEVEL | CORRECTION VALUE IN LUT | P(A) | P(B) | P(C) | P(D) |
|---|---|---|---|---|---|
| V0 | 0 | P(VU) | P(VU) | P(VU) | P(VU) |
| V32 | 2 | P(VL) | P(VL) | P(VU) | P(VU) |
| V64 | 3 | P(VL) | P(VL) | P(VU) | P(VU) |
| V96 | 3 | P(VL) | P(VL) | P(VU) | P(VU) |
| V128 | 3 | P(VL) | P(VU) | P(VU) | P(VU) |
| V160 | 4 | P(VL) | P(VL) | P(VL) | P(VU) |
| V192 | 3 | P(VL) | P(VL) | P(VL) | P(VU) |
| V224 | 2 | P(VL) | P(VL) | P(VU) | P(VU) |
| V255 | 0 | P(VU) | P(VU) | P(VU) | P(VU) |

FIG. 22

| | P(A) | P(B) | P(C) | P(D) |
|---|---|---|---|---|
| EXAMPLE ARRANGEMENT 1 | P(VU) | P(VL) | P(VL) | P(VL) |
| EXAMPLE ARRANGEMENT 2 | P(VL) | P(VU) | P(VL) | P(VL) |
| EXAMPLE ARRANGEMENT 3 | P(VL) | P(VL) | P(VU) | P(VL) |
| EXAMPLE ARRANGEMENT 4 | P(VL) | P(VL) | P(VL) | P(VU) |
| EXAMPLE ARRANGEMENT 5 | P(VU) | P(VU) | P(VL) | P(VL) |
| EXAMPLE ARRANGEMENT 6 | P(VL) | P(VU) | P(VU) | P(VL) |
| EXAMPLE ARRANGEMENT 7 | P(VL) | P(VU) | P(VL) | P(VU) |

FIG. 23

| | | GRAY SCALE VALUE OF CURRENT FRAME | | | | | | | | |
|---|---|---|---|---|---|---|---|---|---|---|
| | | 0 | 32 | 64 | 96 | 128 | 160 | 192 | 224 | 255 |
| GRAY SCALE VALUE OF PRECEDING FRAME | 0 | 3 | — | — | — | — | — | — | — | — |
| | 32 | — | 5 | — | — | — | — | — | — | — |
| | 64 | — | — | 4 | — | — | — | — | — | — |
| | 96 | — | — | — | 4 | — | — | — | — | — |
| | 128 | — | — | — | — | 4 | — | — | — | — |
| | 160 | — | — | — | — | — | 1 | — | — | — |
| | 192 | — | — | — | — | — | — | 0 | — | — |
| | 224 | — | — | — | — | — | — | — | −2 | — |
| | 255 | — | — | — | — | — | — | — | — | −3 |

FIG. 27

| GRAY SCALE VALUE OF CURRENT FRAME | | | | | | | | |
|---|---|---|---|---|---|---|---|---|
| | 0 | 32 | 64 | 96 | 128 | 160 | 192 | 224 | 255 |
| | 3 | 8 | 7 | 6 | 5 | 3 | 0 | −1 | −2 |

FIG. 31

470a

| | | GRAY SCALE VALUE OF CURRENT FRAME | | | | | | | | |
|---|---|---|---|---|---|---|---|---|---|---|
| | | 0 | 32 | 64 | 96 | 128 | 160 | 192 | 224 | 255 |
| GRAY SCALE VALUE OF PRECEDING FRAME | 0 | 3 | 8 | 7 | 6 | 5 | 3 | 1 | 1 | 1 |
| | 32 | 4 | 5 | 9 | 8 | 7 | 6 | 6 | 4 | 4 |
| | 64 | 5 | 6 | 4 | 9 | 5 | 5 | 4 | 4 | 3 |
| | 96 | 4 | 7 | 4 | 4 | 4 | 4 | 3 | 2 | 2 |
| | 128 | 3 | 3 | 4 | 4 | 4 | 5 | 4 | 4 | 2 |
| | 160 | 3 | 3 | 4 | 4 | 4 | 3 | 4 | 4 | 1 |
| | 192 | 2 | 3 | 3 | 3 | 3 | 4 | 0 | 5 | 1 |
| | 224 | 2 | 2 | 2 | 2 | 3 | 3 | 3 | −2 | 0 |
| | 255 | 1 | 2 | 2 | 3 | 3 | 2 | 1 | 1 | −4 |

FIG. 38

470b

| | | GRAY SCALE VALUE OF CURRENT FRAME | | | | | | | | |
|---|---|---|---|---|---|---|---|---|---|---|
| | | 0 | 32 | 64 | 96 | 128 | 160 | 192 | 224 | 255 |
| GRAY SCALE VALUE OF PRECEDING FRAME | 0 | 2 | 4 | 4 | 3 | 3 | 2 | 1 | 1 | 1 |
| | 32 | 2 | 3 | 5 | 4 | 4 | 3 | 3 | 2 | 2 |
| | 64 | 3 | 3 | 2 | 5 | 3 | 3 | 2 | 2 | 2 |
| | 96 | 2 | 4 | 2 | 2 | 2 | 2 | 2 | 1 | 1 |
| | 128 | 2 | 2 | 2 | 2 | 2 | 3 | 2 | 2 | 1 |
| | 160 | 2 | 2 | 2 | 2 | 2 | 2 | 2 | 2 | 1 |
| | 192 | 1 | 2 | 2 | 2 | 2 | 2 | 0 | 3 | 1 |
| | 224 | 1 | 1 | 1 | 1 | 2 | 2 | 2 | -1 | 0 |
| | 255 | 1 | 1 | 1 | 2 | 2 | 1 | 1 | 1 | -3 |

FIG. 39

470c

| | | GRAY SCALE VALUE OF CURRENT FRAME | | | | | | | | |
|---|---|---|---|---|---|---|---|---|---|---|
| | | 0 | 32 | 64 | 96 | 128 | 160 | 192 | 224 | 255 |
| GRAY SCALE VALUE OF PRECEDING FRAME | 0 | 6 | 12 | 12 | 9 | 9 | 6 | 3 | 3 | 3 |
| | 32 | 6 | 9 | 15 | 12 | 12 | 9 | 9 | 6 | 6 |
| | 64 | 9 | 9 | 6 | 15 | 9 | 9 | 6 | 6 | 6 |
| | 96 | 6 | 12 | 6 | 6 | 6 | 6 | 6 | 3 | 3 |
| | 128 | 6 | 6 | 6 | 6 | 6 | 9 | 6 | 6 | 3 |
| | 160 | 6 | 6 | 6 | 6 | 6 | 6 | 6 | 6 | 3 |
| | 192 | 3 | 6 | 6 | 6 | 6 | 6 | 0 | 9 | 3 |
| | 224 | 3 | 3 | 3 | 3 | 6 | 6 | 6 | -3 | 0 |
| | 255 | 3 | 3 | 3 | 6 | 6 | 3 | 3 | 3 | -5 |

FIG. 40

LIQUID CRYSTAL DISPLAY DEVICE AND METHOD OF DRIVING THE SAME

TECHNICAL FIELD

The present invention relates to a liquid crystal display device and a method of driving it, and more particularly to a liquid crystal display device and a method of driving it where idled driving through AC driving is possible.

BACKGROUND ART

In recent years, small and light-weight electronic devices have been actively developed. A liquid crystal display device mounted on such an electronic device is required to consume low power. One driving method that reduces the power consumption of a liquid crystal display device is "idled driving", involving a driving period in which scan lines are scanned and signal voltages are written, and an idle period in which all the scan lines are left unscanned and writing does not occur. In the context of idled driving, control signals and the like are not provided to the scan line drive circuit and/or signal line control unit during an idle period such that the scan line drive circuit and/or signal line control unit do/does not operate, thereby reducing the power consumption of the liquid crystal display device. Such idled driving is also called "low-frequency driving" or "intermittent driving".

In a liquid crystal panel used in a liquid crystal display device, applying a voltage between pixel electrodes and the common electrode sandwiching the liquid crystal layer changes the orientation of liquid crystal molecules (i.e. their longitudinal direction) due to the dielectric anisotropy of liquid crystal. Further, since liquid crystal has optical anisotropy, a change in the orientation of liquid crystal molecules changes the polarization direction of light passing through the liquid crystal layer. Thus, a voltage applied to the liquid crystal layer controls the amount of light passing through the liquid crystal layer to display an image on the liquid crystal panel.

However, a response of liquid crystal to a change in applied voltage requires a certain time. For example, in liquid crystal display devices based on twisted nematic (TN), in-plane switching (IPS) and vertically aligned (VA) techniques, which are currently widely used, a response of liquid crystal may require a period of time of about 50 ms. Further, the response speed of liquid crystal changes depending on temperature, where the response time decreases as the temperature decreases.

Further, when the frequency of image signals is 60 Hz, one frame period is 16.7 ms. Thus, if the response time of liquid crystal is longer than one frame period, an afterimage is produced on the screen, decreasing the display quality of images.

In view of this, JP 2004-4629 A (Patent Document 1) and JP 2011-170327 A (Patent Document 2), for example, disclose liquid crystal display devices in which "overshoot driving" occurs, that is, a voltage greater than a voltage that is originally to be applied to the liquid crystal layer is applied thereto. For overshoot driving, a lookup table (referred to as "LUT" or "table") is used that stores correction values associated with combinations of gray scale values of preceding frames and gray scale levels of current frames. That is, a correction value associated with a combination of the gray scale value of a preceding frame and the gray scale value of a current frame is read from the LUT, and this correction value is used to correct an input image signal, and the resulting corrected image signal is output. This corrected image signal is used to perform overshoot driving to increase the display speed of the liquid crystal display device.

CONVENTIONAL ART DOCUMENTS

Patent Documents

Patent Document 1: JP 2004-4629 A
Patent Document 2: JP 2011-170327 A

SUMMARY OF THE INVENTION

Problems to be Solved by the Invention

In a liquid crystal display device, continuously applying voltages of the same polarity to the liquid crystal layer causes a burn which deteriorates the liquid crystal layer. To prevent a burn in the liquid crystal layer, AC driving is performed where, each time a signal voltage is written, the polarity of voltage is reversed. FIG. 44 illustrates how idled driving is performed by conventional AC driving. As shown in FIG. 44, during the first idled driving period, a signal voltage of positive polarity is first written, and this signal voltage is maintained during the subsequent idle period. During the second idled driving period, a signal voltage of negative polarity is first written, and this signal voltage is maintained during the subsequent idle period. From this onward, in a similar manner and repeatedly, signal voltages with their polarity reversed polarities for each idled driving period are written alternately and these signal voltages are maintained during their respective subsequent idle periods.

FIG. 45 schematically shows how luminance changes during idled driving by conventional AC driving when input image signals corresponding to gray scale values of 64, 128, 200 and 240 are written to a pixel-forming unit. As shown in FIG. 45, in a liquid crystal display device that enables display with 256 gray scale levels from gray scale level 0 (displaying black) and gray scale level 255 (displaying white), for an input image signal of gray scale level 64, luminance rapidly decreases directly after a signal voltage is written to the image-forming unit, and then gradually recovers. Similarly, for gray scale level 128, luminance decreases directly after a signal voltage is written to the image-forming unit, and then gradually recovers. The decrease in luminance directly after a signal voltage is written to the image-forming unit is smaller than that for gray scale level 64. For gray scale level 200, luminance remains unchanged even when a signal voltage is written to the image-forming unit. On the other hand, for gray scale level 240, luminance rises directly after a signal voltage is written to the image-forming unit, and then gradually decreases.

FIG. 46 illustrates how luminance changes when an input image signal of gray scale level 64 is written during idled driving by conventional AC driving, while FIG. 47 illustrates how luminance changes when an input image signal of gray scale level 240 is written during idled driving by conventional AC driving. First, the reason why luminance rapidly decreases directly after an input image signal of gray scale level 64 is written and then gradually recovers will be described with reference to FIG. 46. It is supposed that, in FIG. 46, the pixel-forming unit A and pixel-forming unit B are adjacent pixel-forming units, and have different polarities due to reversed driving. First, in one driving period, the pixel-forming unit A has positive polarity while the pixel-forming unit B has negative polarity. During the next driving period, the polarities are reversed, that is, the pixel-forming unit A has negative polarity while the pixel-forming unit B has positive polarity. When the polarity of a signal voltage applied to the pixel-forming unit A is reversed from positive to negative, the luminance of the pixel-forming unit A rapidly decreases before becoming constant. On the other hand, when the polarity of a signal voltage applied to the pixel-forming unit B is reversed from negative to positive, the luminance of the pixel-forming unit B gradually increases before approaching constancy. The viewer recognizes the total of the changing luminances of the pixel-forming units A and B as the luminance of the entire screen. Thus, in this case, the luminance of the entire screen appears to the viewer to rapidly decrease when the polarities have been reversed, and then recover gradually.

While the above description illustrates an example with an input image signal of gray scale level 64, generally the same applies to an example with gray scale level 128. For gray scale level 128, the decrease in luminance when polarity has been reversed is smaller than that for gray scale level 64.

An example where an input image signal of gray scale level 240 is written will now be described. The reason why luminance rapidly increases directly after an input image signal of gray scale level 240 is written and then gradually decreases will be described with reference to FIG. 47. Similar to the example shown in FIG. 46, the pixel-forming unit A and pixel-forming unit B are adjacent pixel-forming units, and have different polarities due to reversed driving. First, during one driving period, the pixel-forming unit A has positive polarity, and the pixel-forming unit B has negative polarity. During the next driving period, the polarities are reversed, where the pixel-forming unit A has negative polarity while the pixel-forming unit B has positive polarity. When the polarities are reversed, applying a signal voltage of negative polarity to the pixel-forming unit A causes the luminance of the pixel-forming unit A to decrease gradually before approaching constancy. On the other hand, applying a signal voltage of negative polarity to the pixel-forming unit B causes the luminance of the pixel-forming unit B to rapidly increase, before becoming constant. In this case, the viewer recognizes the total of the changing luminances of the pixel-forming units A and B as the luminance of the entire screen, and thus recognizes that the luminance of the entire screen rapidly increases when the polarities have been reversed, and then gradually decreases.

These changes in the luminance of the screen occur because, when the polarity of a signal voltage is reversed, the orientation of liquid crystal molecules cannot follow these changes. When moving images are displayed, the imagery rapidly changes such that the viewer can hardly recognize those changes in luminance. However, during idled driving, the viewer recognizes those changes in luminance as a flicker, which means a deterioration of the display quality of images. This flickering occurs even when the gray scale value of input image signals does not change.

The voltage that has decreased when the polarity was reversed approaches the signal voltage over time such that the luminance during the idle period gradually increases because the switching elements of the pixel-forming units are thin-film transistors (hereinafter referred to as "TFTs") having a channel layer made of oxide semiconductor. The TFTs having a channel layer made of oxide semiconductor will be described further below in detail.

Patent Document 1 discloses overshoot driving during normal driving. However, Patent Document 1 does not disclose or suggest overshoot driving that prevents flickering from occurring during idled driving by AC driving.

Patent Document 2 discloses the use of an LUT as a means for deciding on an amount of overshoot. However, this arrangement can only control the gray scale level in increments of the minimum unit of the correction amounts specified by the LUT. For example, if the correction amounts specified by the LUT are in increments of one gray scale level, gray scale level control is possible in one gray scale level increments, but not possible in 0.5 gray scale level increments, for example.

In view of this, an object of the present invention is to provide a liquid crystal display device where the decrease in the display quality during idled driving by AC driving can be reduced in smaller gray scale level increments.

Means to Solve the Problems

A liquid crystal display device according to an embodiment of the present invention is a liquid crystal display device that performs intermittent driving involving a driving period and an idle period, the liquid crystal display device including: a plurality of scan lines; a plurality of signal lines crossing the plurality of scan lines; a pixel-forming unit provided at the intersection of each of the plurality of scan lines and each of the plurality of signal lines; a scan line control unit that scans the plurality of scan lines by selecting one after another of the scan lines; a gray scale level control unit that generates, from an input image signal, an image signal for display and an image signal for correction; and a signal line control unit that writes the image signal for correction to the plurality of signal lines before writing the image signal for display during a driving period.

The gray scale level control unit includes: a correction value storage unit that stores a correction gray scale value associated with a gray scale value of at least a current frame of the input image signal; a first correction circuit that corrects the input image signal based on the correction gray scale value read from the correction value storage unit; and a second correction circuit that specifies, in a pixel region including the pixel-forming unit, a regular image pattern including at least a first pixel and a second pixel and changes an output from the first correction circuit for the first pixel by a predetermined gray scale width.

Effects of the Invention

The present invention provides a liquid crystal display device where the decrease in the display quality during idled driving by AC driving can be reduced in smaller gray scale level increments.

BRIEF DESCRIPTION OF THE DRAWINGS

FIG. 3 illustrates an example content of the LUT used in the liquid crystal display device shown in FIG. 1.

FIG. 22 illustrates a preferred example pixel arrangement in the liquid crystal display device according to an example variation of the first embodiment.

FIG. 23 illustrates another preferred example pixel arrangement in the liquid crystal display device according to an example variation of the present embodiment.

FIG. 27 illustrates an example content of the LUT used in the liquid crystal display device shown in FIG. 26.

FIG. 31 illustrates an example content of the LUT used in the liquid crystal display device according to the first example variation shown in FIG. 30.

FIG. 38 illustrates an LUT for room temperature used in the liquid crystal display device shown in FIG. 37.

FIG. 39 illustrates an LUT for high temperature used in the liquid crystal display device shown in FIG. 37.

FIG. 40 illustrates an LUT for low temperature used in the liquid crystal display device shown in FIG. 37.

EMBODIMENTS FOR CARRYING OUT THE INVENTION

Figure 1:
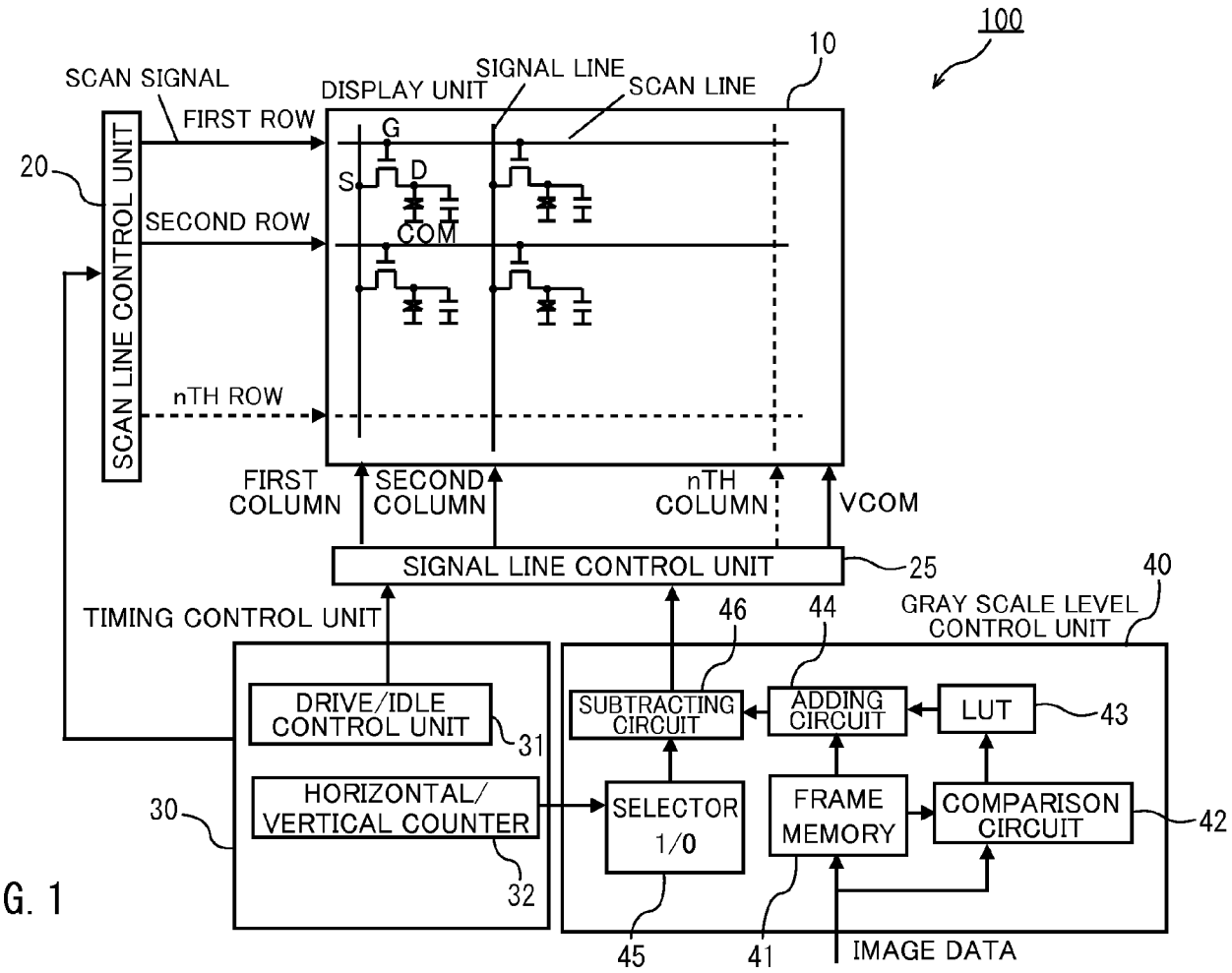
FIG. 1 is a block diagram of a liquid crystal display device according to a first embodiment of the present invention.

A liquid crystal display device of a first arrangement of the present invention is a liquid crystal display device that performs intermittent driving involving a driving period and an idle period, the liquid crystal display device including: a plurality of scan lines; a plurality of signal lines crossing the plurality of scan lines; a pixel-forming unit provided at the intersection of each of the plurality of scan lines and each of the plurality of signal lines; a scan line control unit that scans the plurality of scan lines by selecting one after another of the scan lines; a gray scale level control unit that generates, from an input image signal, an image signal for display and an image signal for correction; and a signal line control unit that writes the image signal for correction to the plurality of signal lines before writing the image signal for display during a driving period. The gray scale level control unit includes: a correction value storage unit that stores a correction gray scale value associated with a gray scale value of at least a current frame of the input image signal; a first correction circuit that corrects the input image signal based on the correction gray scale value read from the correction value storage unit; and a second correction circuit that specifies, in a pixel region including the pixel-forming unit, a regular image pattern including at least a first pixel and a second pixel and changes an output from the first correction circuit for the first pixel by a predetermined gray scale width.

In this arrangement, the second correction circuit in the gray scale level control unit specifies, in the pixel region, a regular image pattern including at least a first pixel and a second pixel and changes the output from the first correction circuit for the first pixel by a predetermined gray scale width. Thus, an input image signal corresponding to the first pixel in that pixel pattern is corrected by the first correction circuit based on the correction gray scale value and corrected by the second correction circuit based on the predetermined gray scale width. On the other hand, an input image signal for the second pixel is only corrected by the first correction circuit based on the correction gray scale value. Thus, within the above pixel pattern, the first and second pixels are corrected to different degrees, thereby correcting the luminance of the entire pixel pattern in a spatial manner. This makes it possible to correct an input image signal in smaller increments than increments of one correction gray scale level. This realizes a liquid crystal display device where the decrease in the display quality encountered when idled driving is performed by AC driving can be reduced in smaller gray scale level increments.

Starting from the liquid crystal display device of the first arrangement, it is preferable that the regular pixel pattern includes a total of 4 pixels with two pixels horizontally and two pixels vertically, and two of the four pixels are first pixels (second arrangement). Further, starting from the liquid crystal display device of the second arrangement, it is preferable that the first pixels are two of the four pixels that are disposed diagonally (third arrangement).

Starting from the liquid crystal display device of one of the first to third arrangements, it is preferable that the second correction circuit changes the output from the first correction circuit for the first pixel by increasing or decreasing it by one gray scale level, and leaves unchanged the output from the first correction circuit for the second pixel (fourth arrangement).

Starting from the liquid crystal display device of one of the first to fourth arrangements, it is preferable that a voltage applied to the pixel-forming unit is reversed in polarity in such a manner that voltages for pixel-forming units connected with the same signal line have the same polarity, and the first pixel and the second pixel are adjacent to each other as measured in a direction of the signal lines (fifth arrangement).

Alternatively, starting from the liquid crystal display device of one of the first to fourth arrangements, it is preferable that a voltage applied to the pixel-forming unit is reversed in polarity in such a manner that voltages for pixel-forming units connected with the same scan line have the same polarity, and the first pixel and the second pixel are adjacent to each other as measured in a direction of the scan lines (sixth arrangement).

Still alternatively, starting from the liquid crystal display device of the first to fourth arrangements, it is preferable that a voltage applied to the pixel-forming unit is reversed in polarity in such a manner that voltages for pixel-forming units adjacent to each other horizontally or vertically have opposite polarities, and the first pixel and the second pixel are adjacent to each other diagonally (seventh arrangement).

Starting from the liquid crystal display device of the first arrangement, it is preferable that the regular pixel pattern includes a total of 16 pixels with four pixels horizontally and four pixels vertically, and four consecutive pixels disposed horizontally in the pixel pattern include a first pixel and a second pixel and four consecutive pixels disposed vertically in the pixel pattern include a first pixel and a second pixel (eighth arrangement).

Starting from the liquid crystal display device of the first arrangement, it is preferable that, when the image signal for display is at a predetermined gray scale level, the regular pixel pattern is only composed of second pixels, and, when the image signal for display is at a gray scale level other than the predetermined gray scale level, the regular pixel pattern is composed of first and second pixels (ninth arrangement).

Starting from the liquid crystal display device of the first arrangement, it is preferable that different types of regular pixel patterns are provided depending on a gray scale level of the image signal for display (tenth arrangement).

Starting from the liquid crystal display device of one of the first to tenth arrangements, it is preferable that, within the driving period, the length of a period in which the pixel signal for display is written is equal to the length of a period in which the image signal for correction is written (eleventh arrangement).

Starting from the liquid crystal display device of the eleventh arrangement, it is preferable that, within the driving period, the length of a period in which the image signal for display is written and the length of a period in which the image signal for correction is written are equal to the time that corresponds to one frame (twelfth arrangement).

Starting from the liquid crystal display device of one of the first to twelfth arrangements, it is preferable that the gray scale level control unit further includes a frame memory for storing the input image signal on a frame-by-frame basis, the correction value storage unit provides a correction gray scale value associated with a gray scale value of a current frame of the input image signal to the first correction circuit, and when the image signal for correction is to be written, the first correction circuit corrects a gray scale value of the input image signal with the correction gray scale value and outputs it and, when the image signal for display is to be output, the first correction circuit outputs the gray scale value of the input image signal without correcting it (thirteenth arrangement).

Starting from the liquid crystal display device of the thirteenth arrangement, it is preferable that the first correction circuit further includes a comparison circuit that provides to the correction value storage unit the gray scale value of the current frame of the input image signal and a gray scale value of a preceding frame stored in the frame memory, and the correction value storage unit stores a correction value associated with a combination of the gray scale value of the current frame and the gray scale value of the preceding frame of the input image signal and, when receiving from the comparison circuit a gray scale value of a current frame and a gray scale value of a preceding frame of the input image signal, provides a correction value associated with this combination to the first correction circuit (fourteenth arrangement).

Starting from the liquid crystal display device of the fourteenth arrangement, it is preferable that the first correction circuit outputs the image signal for correction in each of two or more consecutive drive frames including the first drive frame and outputs the image signal for display in the last drive frame (fifteenth arrangement).

Starting from the liquid crystal display device of one of the first to twelfth arrangements, it is preferable that the gray scale level control unit further includes a frame memory that stores the input image signal on a frame-by-frame basis and a comparison circuit that determines a gray scale value of a current frame of the input image signal and a gray scale value of a preceding frame stored in the frame memory, the correction value storage unit stores a correction value to be used when the gray scale value of the current frame and the gray scale value of the preceding frame of the input image signal are substantially equal to each other, when the gray scale value of the current frame and the gray scale value of the preceding frame of the input image signal are substantially equal to each other, the correction value storage unit provides to the first correction circuit a correction value associated with the gray scale value of the current frame and the gray scale value of the preceding frame, when the gray scale value of the current frame and the gray scale value of the preceding frame of the input image signal are substantially equal to each other, the first correction circuit outputs the image signal for correction obtained by correcting the gray scale value of the input image signal with the correction value provided by the correction value storage unit and outputs the gray scale value of the input image signal as the image signal for display without correcting it, and, when the gray scale value of the current frame and the gray scale value of the preceding frame of the input image signal are not substantially equal to each other, the first correction circuit outputs the gray scale value of the input image signal as the image signal for correction at least once without correcting it (sixteenth arrangement).

Starting from the liquid crystal display device of the sixteenth arrangement, it is preferable that, when the gray scale value of the current frame and the gray scale value of the preceding frame of the input image signal are not substantially equal to each other, the first correction circuit further outputs the gray scale value of the input image signal as the image signal for correction without correcting it (seventeenth arrangement).

Starting from the liquid crystal display device of one of the first to seventeenth arrangements, it is preferable that the pixel-forming unit includes a thin-film transistor having a control terminal connected with the scan line, a first conductive terminal connected with the signal line, a second conductive terminal connected with a pixel electrode to which a first correction voltage, a second correction voltage or a signal voltage is to be applied, and a channel layer formed of oxide semiconductor (eighteenth arrangement).

Starting from the liquid crystal display device of the eighteenth arrangement, it is preferable that the oxide semiconductor includes indium (In), gallium (Ga), zinc (Zn) and oxygen (O) (nineteenth arrangement).

Now, more specific embodiments will be described with reference to the drawings.

1. First Embodiment

1.1 Configuration of Liquid Crystal Display Device

FIG. 1 is a block diagram of a liquid crystal display device 100 according to a first embodiment of the present invention. The liquid crystal display device 100 shown in FIG. 10 includes a liquid crystal panel 10, a scan line control unit 20, a signal line control unit 25, a timing control unit 30, and a gray scale level control unit 40.

The liquid crystal panel 10 has a plurality of pixel-forming units (not shown) arranged in a matrix with rows and columns. Further, the liquid crystal panel 10 has a plurality of scan lines (not shown) and a plurality of signal lines (not shown), crossing each other. Each scan line is connected with the pixel-forming units located in the same row as this scan line, and each signal line is connected with the pixel-forming units located in the same column as this signal line.

The timing control unit 30 receives horizontal synchronization signals and vertical synchronization signals to synchronize input image signals. Based on these synchronization signals, the timing control unit 30 generates control signals such as a gate clock signal and gate start pulse signal before providing them to the scan line control unit 20, and generates control signals such as a source clock signal and source start pulse signal before providing them to the signal line control unit 25.

The timing control unit 30 includes a drive/idle control unit 31 and a horizontal/vertical counter 32. The drive/idle control unit 31 provides an amplifier enable signal to the signal line control unit 25 in synchronization with the generated control signals. As discussed in greater detail further below, the liquid crystal display device 100 provides a driving period and an idle period: when the device drives the liquid crystal panel 10, in a driving period, an overshoot voltage (also referred to as "first correction voltage") or undershoot voltage (also referred to as "second correction voltage") is written or a signal voltage is written, and, in an idle period, these voltages are not written. During a driving period, the drive/idle control unit 31 activates the amplifier enable signal to operate an analog amplifier (not shown) provided in the signal line control unit 25. This allows an overshoot voltage, undershoot voltage or signal voltage to be written to signal lines. During an idle period, the amplifier enable signal is deactivated to stop the analog amplifier. Thus, the drive/idle control unit 31 is capable of defining a driving period and an idle period as desired.

The horizontal/vertical counter 32 determines the values of the horizontal and vertical positions of a pixel to which writing is to occur, and provides these values to the gray scale level control unit 40. As discussed in greater detail further below, the overshoot voltage or undershoot voltage is adjusted by selecting an output from the selector 45 depending on the position of the pixel obtained as the output from the horizontal/vertical counter 32 and providing it to the subtracting circuit 46.

In accordance with the control signal generated by the timing control unit 30, the scan line control unit 20 drives the scan lines of the liquid crystal panel 10 and selects one scan lines after another. In accordance with the control signal generated by the timing control unit 30, the signal line control unit 25 converts a corrected image signal provided by the gray scale level control unit 40 to a signal voltage which is an analog voltage, and writes this signal voltage to the signal line. Further, an overshoot voltage or undershoot voltage generated in the manner described below is written to signal lines. Further, these voltages written to signal lines are written to the pixel-forming units connected with the scan line selected by applying an active scan signal. Note that the signal line control unit 25 writes a signal voltage, overshoot voltage or undershoot voltage to a signal line only during a period in which it is receiving an active amplifier enable signal from the drive/idle control unit 31.

The gray scale level control unit 40 provides the signal line control unit 25 with a corrected image signal obtained by correcting an input image signal. The gray scale level control unit 40 includes a frame memory 41, a comparison circuit 42, a lookup table (LUT) 43, an adding circuit 44, a selector 45, and a subtracting circuit 46. The frame memory 41 stores a portion of an input image signal (i.e. image data) provided externally that corresponds to one frame. The comparison circuit 42 provides the LUT 43 with the gray scale value of an input image signal provided externally (i.e. the gray scale value of a current frame), and the gray scale value of the input image signal of the directly preceding frame period (i.e. the gray scale value of the preceding frame) stored in the frame memory 41. As discussed further below, the LUT 43 stores a plurality of correction values associated with the gray scale values of preceding frames and the gray scale values of current frames. If the LUT 43 is provided by the comparison circuit 42 with the gray scale value of a preceding frame and the gray scale value of a current frame, it provides the associated correction value to the adding circuit 44. In the present specification, the LUT is also referred to as "table". A signal obtained by correcting an input image signal using the adding circuit 44 and the subtracting circuit 46, described below, is referred to as corrected image signal. A signal that has not been corrected may be referred to as image signal.

The adding circuit 44 is connected with the frame memory 41 and receives an input image signal stored in the frame memory 41. When an overshoot voltage or undershoot voltage is to be written, an input image signal directly after it is stored in the frame memory 41 is immediately provided to the adding circuit 44 by the frame memory 41. The adding circuit 44 adds the correction value provided by the LUT 43 to the gray scale value of the current frame to generate a corrected image signal, and provides it to the subtracting circuit 46. The correction value provided by the LUT 43 is positive when an overshoot voltage is to be written, and is negative when an undershoot voltage is to be written.

During the frame following the frame in which an overshoot voltage or undershoot voltage was written, an input image signal stored in the frame memory 41 is provided again to the adding circuit 44. This input image signal is the same as the input image signal that was used to generate the corrected image signal. The adding circuit 44 provides the gray scale value of the current frame as an image signal to the signal line control unit 25 without correcting it.

As discussed above, the selector 45 receives from the timing control unit 30 horizontal and vertical positional information about the pixel to which writing is to occur. Based on this positional information, the selector 45 selects a selector output $V_{SEL}$ from among two values (i.e. "0" and "1" in the present embodiment) and provides it to the subtracting circuit 46. The subtracting circuit 46 subtracts the selector output $V_{SEL}$ from a signal provided by the adding circuit 44, and provides the result to the signal line control unit 25. Thus, the output from the subtracting circuit 46 is gray scale level ($V_P+V_{LUT}-V_{SEL}$). Here, $V_P$ is the gray scale value of the of a pixel in a current frame and $V_{LUT}$ is the correction value provided by the LUT 43. A pixel to which the higher one of the two values (i.e. "1" in the present embodiment) is provided as the selector output $V_{SEL}$ will be hereinafter represented as P(VL). This may also be represented as P(1). A pixel to which the lower one of the two values (i.e. "0" in the present embodiment) is provided as the selector output $V_{SEL}$ will be represented as P(VU). This may also be represented as P(0).

That is, for a pixel P(0), "0" is subtracted as the selector output $V_{SEL}$ from the gray scale value obtained by adding the correction value provided from the LUT 43 to the gray scale value of a current frame, and thus the output signal from the adding circuit 44, without any modification, is provided as the corrected image signal to the signal line control unit 25. On the other hand, for a pixel P(1), the gray scale value obtained by subtracting "1" as the selector output $V_{SEL}$ from the value obtained by adding the correction value provided from the LUT 43 to the gray scale value of a current frame is provided as the corrected image signal to the signal line control unit 25. The signal line control unit 25 writes to a signal line SL the voltage corresponding to the corrected image signal (i.e. overshoot voltage or undershoot voltage).

As discussed in greater detail further below, those of the pixels constituting one frame that are arranged in a predetermined number of rows and a predetermined number of columns constitute one unit and, within this one unit, pixels P(VU) and pixels P(VL) are arranged in a regular manner. The number of pixels P(VU) and the number of P(VL) within one unit is preferably equal to each other, but they may be different from each other.

Figure 2:
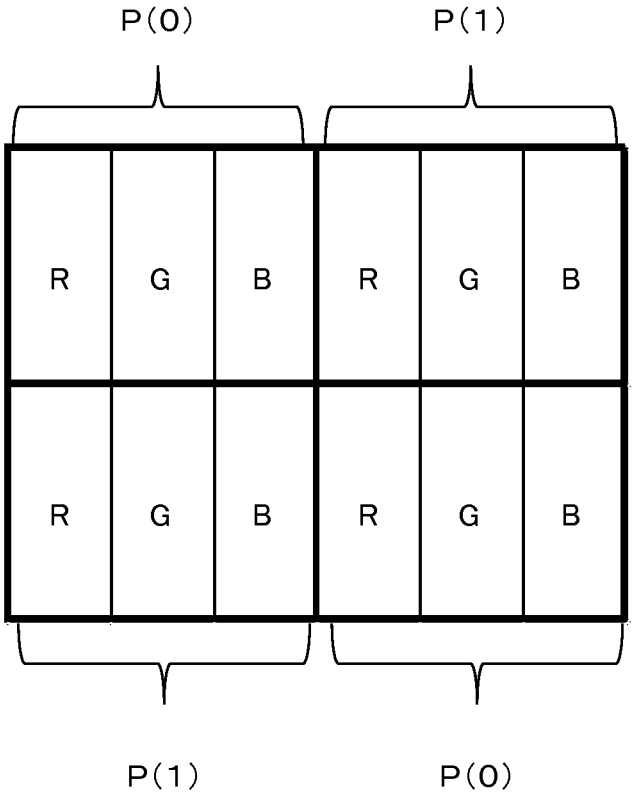
FIG. 2 illustrates an example pixel arrangement in the liquid crystal display device shown in FIG. 1.

FIG. 2 illustrates one example arrangement of pixels P(0) and P(1). In the example arrangement shown in FIG. 2, a total of four pixel, with two pixels horizontally and two pixels vertically, constitute one unit. In this example, one pixel is composed of three sub-pixels with different colors, i.e. RGB. One sub-pixel corresponds to one pixel-forming unit. Two pixels, to the top left and bottom right, are pixels P(0), while two pixels, to the bottom left and top right, are pixels P(1). Arranging the pixels P(0) with a selector output of "0" and the pixels P(1) with a selector output of "1" diagonally enables gray scale value correction in 0.5 level increments based on the correction values specified in the LUT 43. More specifically, for example, if the correction value provided by the LUT 43 is 4 gray scale levels, the gray scale value after correction of a pixel P(0) with a selector output of "0" is (PV+4−0). The gray scale value after correction of a pixel P(1) with a selector output of "1" is (PV+4−1). Here, PV is the gray scale value of a current frame in each pixel. Thus, as two pixels that account for a half of the four pixels constituting one unit are pixels P(1), the gray scale level of these two pixels decreases by one gray scale level. In other words, the average amount of correction for the four pixels of one unit is 3.5 gray scale levels, between 3 and 4 gray scale levels. This allows a correction value specified in the LUT 43 to be corrected in 0.5 gray scale level increments.

While in the example of FIG. 2, one pixel is composed of three sub-pixels of the different primary colors of RGB, the colors of the sub-pixels constituting one pixel are not limited to RGB. Further, one pixel may be composed of four or more sub-pixels of different primary colors. Furthermore, two pixels, to the top left and bottom right, may be pixels P(1) and two pixels, to the bottom left and top right, may be pixels P(0). Alternatively, pixels P(1) may be arranged in a horizontal direction or vertical direction. Alternatively, the number of pixels P(0) and the number of pixels P(1) may be different.

An example content of the LUT 43 will now be described. FIG. 3 illustrates an example content of the LUT 43 used in the liquid crystal display device 100. As shown in FIG. 3, the LUT 43 stores correction values that are associated with combinations of gray scale values of preceding frames and gray scale values of current frames and emphasize how an input image signal changes over time. For example, in the example shown in FIG. 3, when the gray scale value of a preceding frame is gray scale level 32 and the gray scale value of a current frame is gray scale level 160, "6 gray scale levels" is stored as the correction value in the LUT 43. When the LUT 43 provides this correction value to the adding circuit 44, the adding circuit 44 adds 6 gray scale levels to gray scale level 160, which is the gray scale value of the input image signal provided by the frame memory 41 (i.e. gray scale value of the current frame) to generate a corrected image signal of gray scale level 166, and provides it to the subtracting circuit 46. As discussed above, the subtracting circuit 46 subtracts the output of the selector 45 (i.e. "0" or "1") for each pixel and provides the result to the signal line control unit 25.

The LUT 43 also stores negative correction values that can be used as the correction values when an undershoot voltage is to be written. Specifically, they are the cases when the gray scale values of both a preceding frame and current frame are gray scale level 224, and when the gray scale values of both a preceding frame and current frame are gray scale level 255. For example, when the gray scale values of a preceding frame and current frame are 224, the LUT 43 shows that the associated correction value is −2. As this correction value is provided to the adding circuit 44 from the LUT 43, the adding circuit 44 adds −2 gray scale levels to gray scale level 224 which is the gray scale value of the input image signal provided by the frame memory 41 (i.e. gray scale value of the current frame) to generate a corrected image signal of gray scale level 222, and provides it to the subtracting circuit 46. If the gray scale values of both a preceding frame and current frame are gray scale level 192, the associated correction value is gray scale level 0, and thus neither overshoot nor undershoot will occur.

Figure 45:
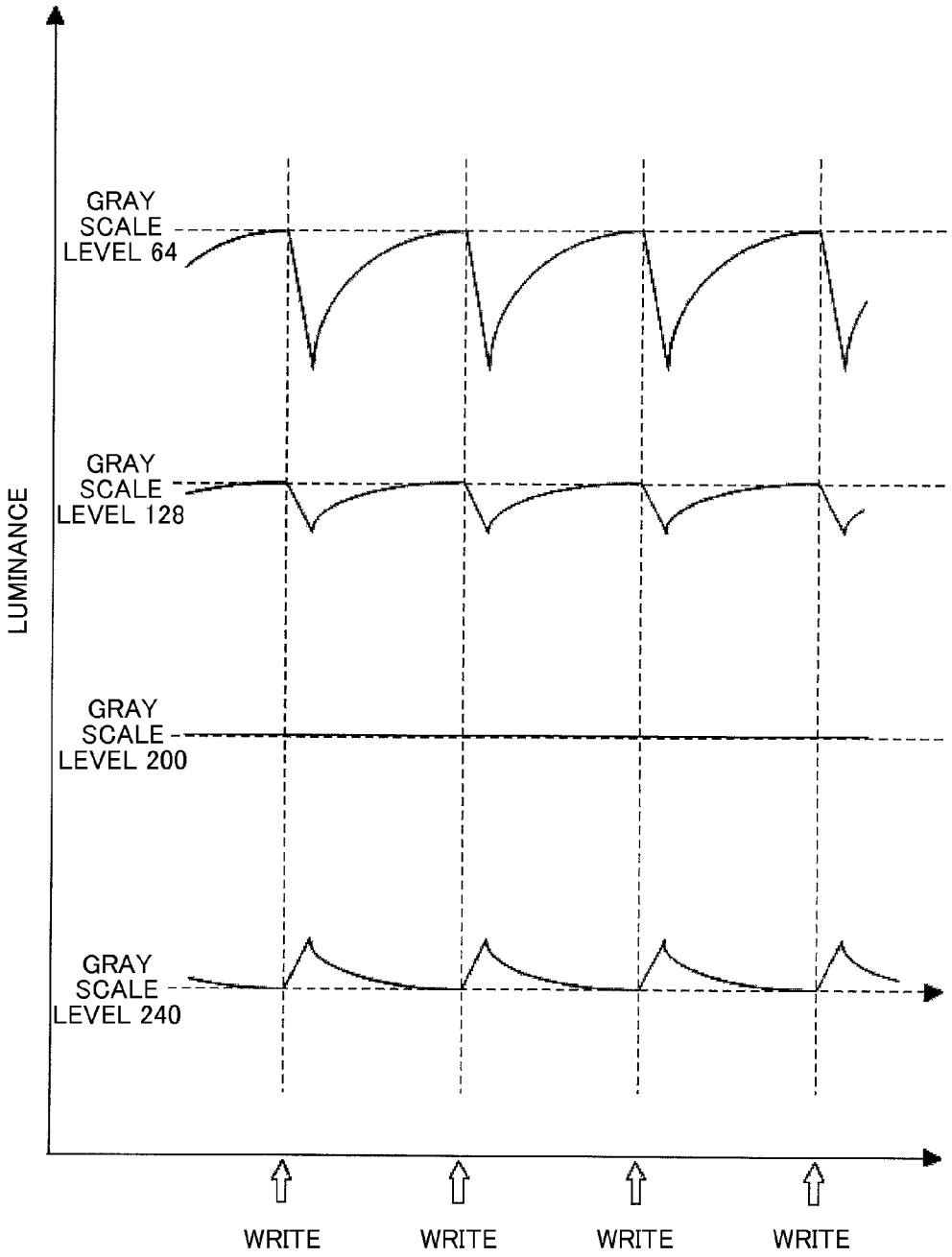
FIG. 45 schematically shows how luminance changes during idled driving by conventional AC driving when input image signals corresponding to gray scale values of 64, 128, 200 and 240 are written to a pixel-forming unit.
Figure 46:
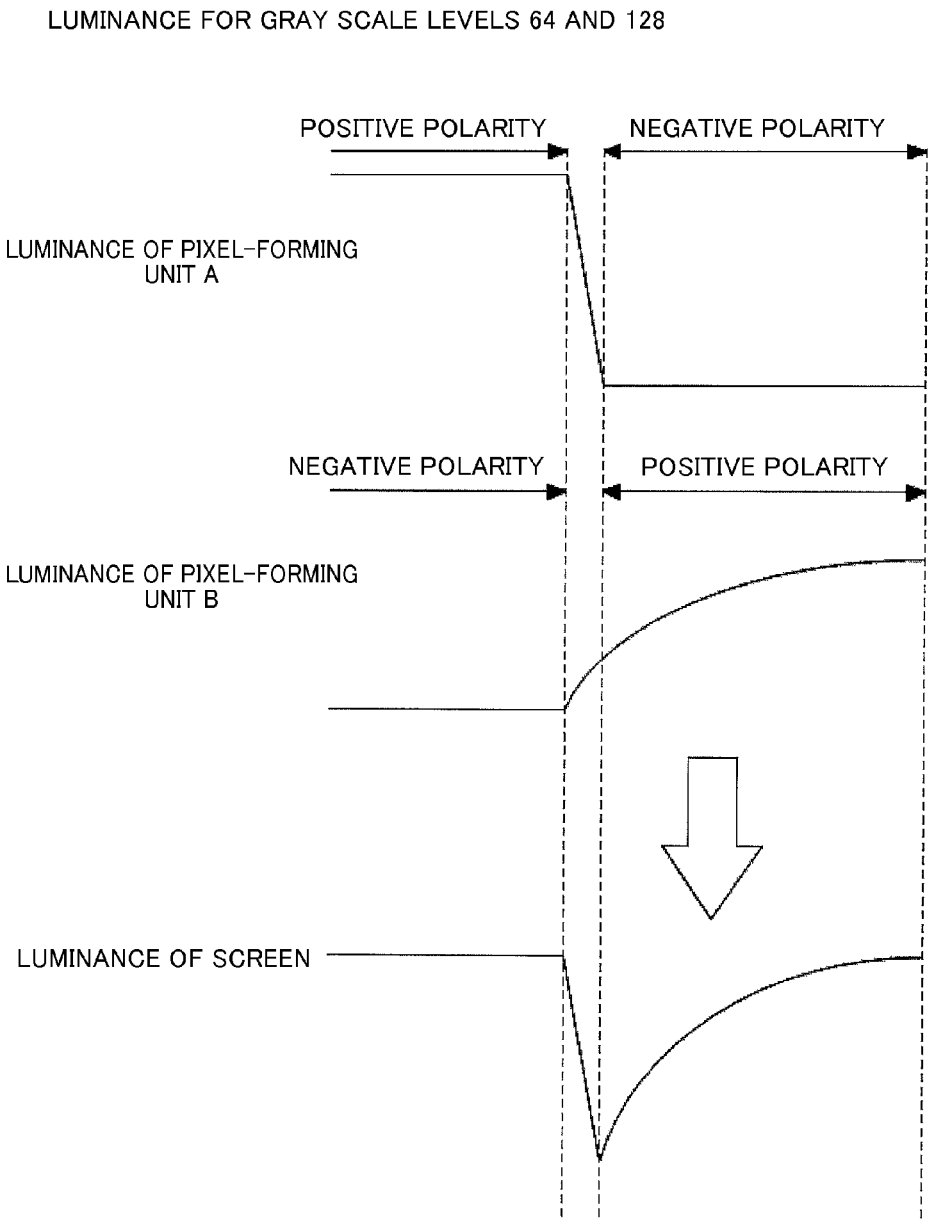
FIG. 46 illustrates how luminance changes when an input image signal of gray scale level 64 is written during idled driving by conventional AC driving.
Figure 47:
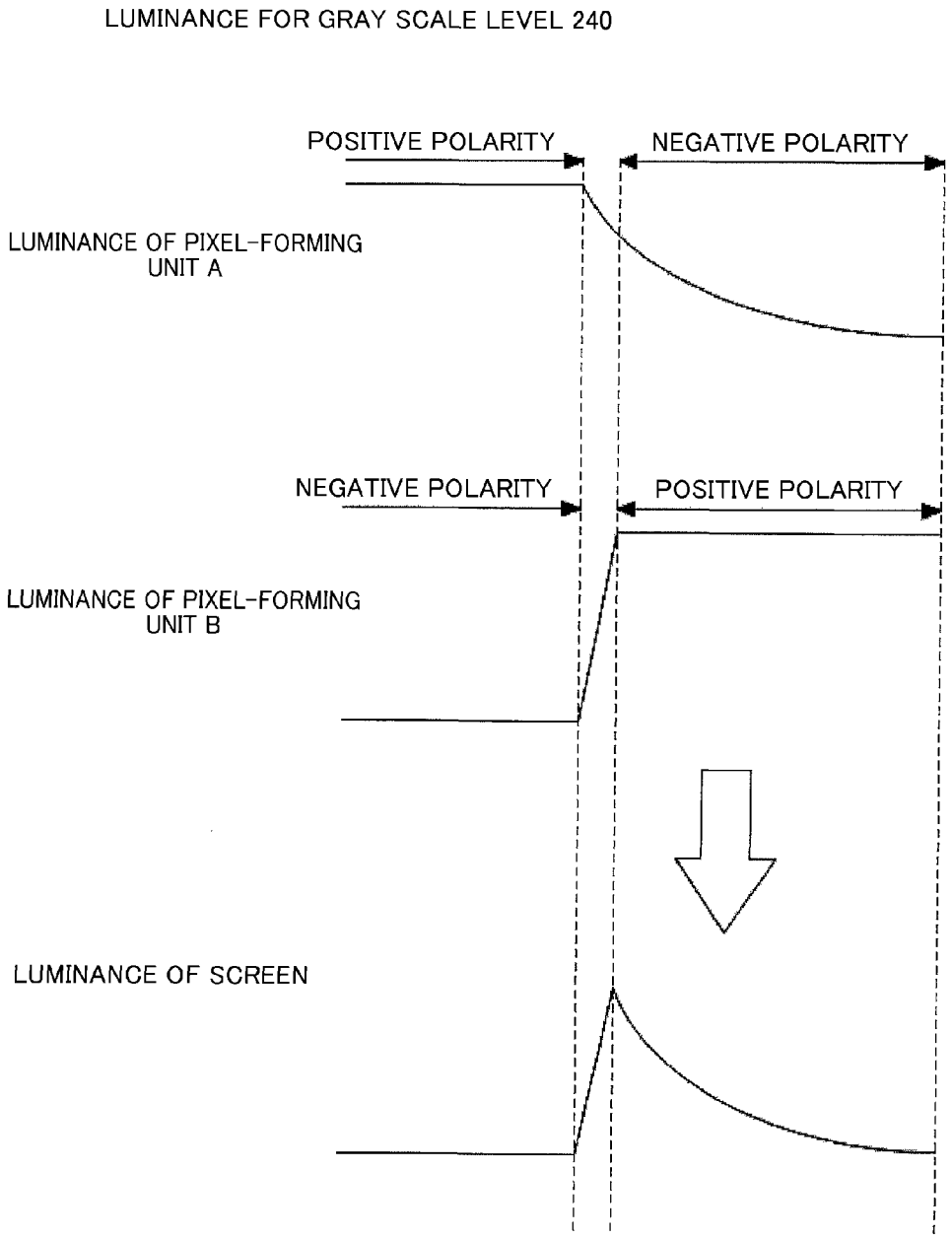
FIG. 47 illustrates how luminance changes when an input image signal of gray scale level 240 is written during idled driving by conventional AC driving.

Thus, for a positive correction value stored in the LUT 43, overshoot driving occurs, and for a negative value, undershoot driving occurs. As shown in FIG. 45, when the gray scale values of both a preceding frame and current frame are small, the luminance of the screen decreases at each idled driving period before recovering gradually. If the gray scale values of both a preceding frame and current frame are large, the luminance of the screen increases at each idled driving period before decreasing gradually. To counter these changes in luminance, the LUT 43 stores positive values with relatively large absolute values as correction values to be used when the gray scale values of a preceding frame and current frame are small, and store negative values and positive values with relatively small absolute values as correction values to be used when the gray scale values of a preceding frame and current frame are large.

In the present specification, the liquid crystal display device 100 is a display device that has a gray scale number of 256, and, accordingly, the LUT 43 stores gray scale values of gray scale level 0 to gray scale level 255. However, the gray scale number of a liquid crystal display device to which the present invention can be applied is not limited to 256, and may be larger or smaller than 256. In such cases, the correction values to be stored in the LUT are increased or decreased depending on the gray scale number of the liquid crystal display device.

To save memory capacity, the LUT 43 shown in FIG. 3 only stores gray scale values of preceding frames and current frames in 32 gray scale level increments. In view of this, how the LUT 43 can be used to calculate the correction value associated with gray scale values of preceding frames and current frames that are not stored in the LUT 43 will be described. The simplest way is to treat not only the gray scale values stored in the LUT 43, but also gray scale values greater or smaller by up to 16 levels as stored gray scale values. For example, any of the gray scale value of (192−16+1=) 177 to the gray scale value of (192+16=) 208 is treated as gray scale level 192. Any of the gray scale value of (224−16+1=) 209 to the gray scale value of (224+16=) 240 is treated as gray scale level 224. Specifically, the correction value used when the gray scale value of a preceding frame is 200 and the gray scale value of a current frame is 220 is gray scale level 5, which corresponds to the gray scale value of a preceding frame of 192 and the gray scale value of a current frame of 224. If a more precise correction value is desired to be calculated, linear interpolation may be used. Linear interpolation is a well-known interpolation method, and thus will not be described in detail.

1.2 Configuration of Pixel-Forming Unit

Figure 4:
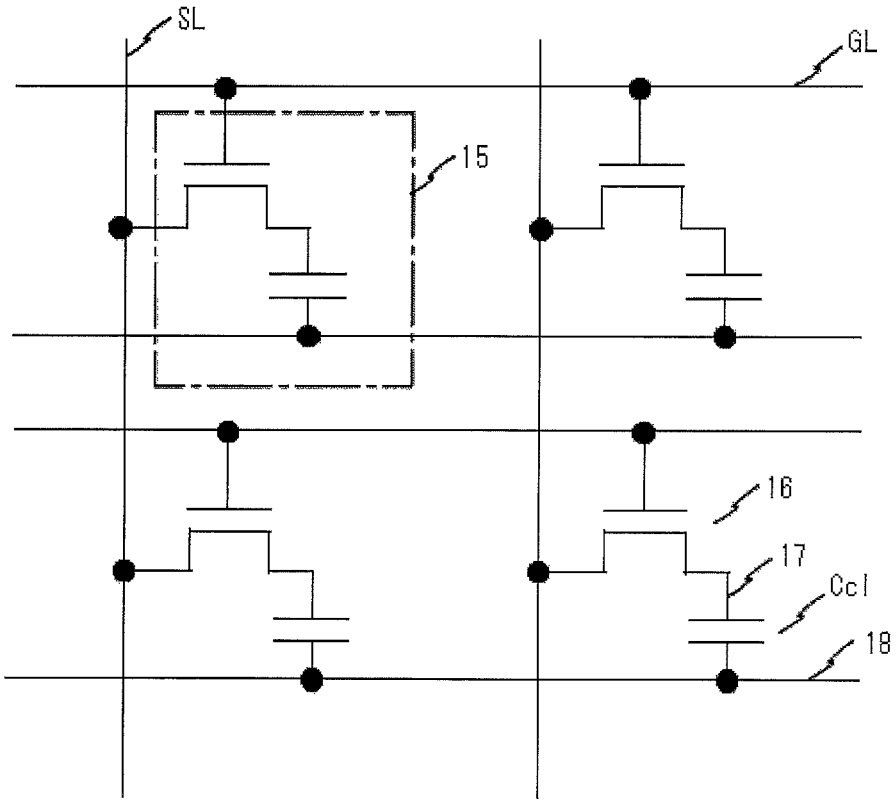
FIG. 4 illustrates an equivalent circuit of pixel-forming units included in the liquid crystal display device shown in FIG. 1.

FIG. 4 illustrates an equivalent circuit of pixel-forming units 15 included in the liquid crystal display device 100. As shown in FIG. 4, each pixel-forming unit 15 includes: a TFT 16 that has a gate terminal connected with the scan line GL that passes through the associated intersection for serving as a control terminal, and a source terminal connected with the signal line SL that passes through this intersection for serving as a first conductive terminal; a pixel electrode 17 connected with the drain terminal, or a second conductive terminal, of the TFT 16; a common electrode 18 shared by the pixel-forming units 15; and a liquid crystal layer (not shown) sandwiched between the pixel electrode 17 and the common electrode 18 and shared by a plurality of pixel-forming units 15. The liquid crystal capacitor Ccl formed by the pixel electrode 17 and common electrode 18 constitutes a pixel capacitor. A voltage to be applied to the common electrode 18 is produced by a common voltage generation circuit (not shown). Although an auxiliary capacitor is often provided parallel to the liquid crystal capacitor Ccl to ensure that a certain voltage is maintained at the pixel capacitor, the description of the present specification presupposes that the pixel capacitor is only composed of the liquid crystal capacitor Ccl.

The TFT 16 shown in FIG. 4 functions as a switching element that may be turned on to write a signal voltage to the liquid crystal capacitor Ccl and turned off to keep a signal voltage in the liquid crystal capacitor Ccl. The TFT 16 may be a TFT that uses oxide semiconductor for the channel layer (hereinafter referred to as "oxide TFT"), for example. Specifically, the channel layer of the TFT 16 is formed of In—Ga—Zn—O including indium (In), gallium (Ga), zinc (Zn), and oxygen (O). A TFT using In—Ga—Zn—O for the channel layer will be hereinafter referred to as "In—Ga—Zn—O TFT".

Figure 5:
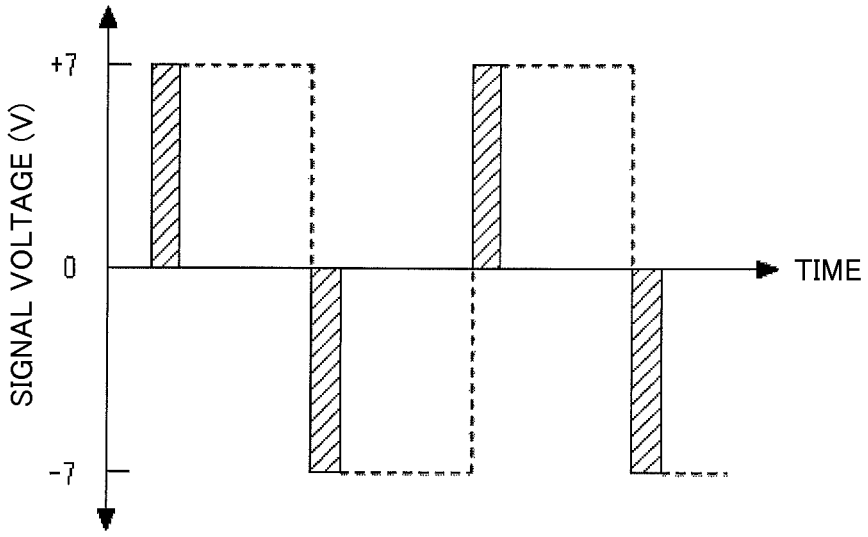
FIG. 5 illustrates how a signal voltage written to the liquid crystal capacitor changes over time when the switching elements of the pixel-forming units of the liquid crystal display device shown in FIG. 1 are In—Ga—Zn—O TFTs.

FIG. 5 illustrates how the signal voltage written to the liquid crystal capacitor Ccl changes over time when the switching elements of the pixel-forming units 15 of the liquid crystal display device 100 are In—Ga—Zn—O TFTs 16. As shown in FIG. 5, a positive signal voltage (such as +7V) is written and the written voltage is maintained for a predetermined period of time. Next, a negative signal voltage (such as −7V) is written and the written voltage is maintained for a predetermined period of time. Even if this operation is repeated, the signal voltage written to the liquid crystal capacitor Ccl hardly changes. This shows that the off-leak current in In—Ga—Zn—O TFTs 16 is very small and a signal voltage written to a liquid crystal capacitor Ccl is maintained for a long period of time. Thus, the use of In—Ga—Zn—O TFTs 16 as the switching elements of the pixel-forming units 15 allows multiple gray scale levels to be displayed even during idled driving.

Instead of In—Ga—Zn—O, an oxide semiconductor containing at least one of indium gallium, zinc, copper (Cu), silicon (Si), tin (Sn), aluminum (Al), calcium (Ca), germanium (Ge) and lead (Pb), for example, may be used for the channel layer to achieve the same effects.

1.3 Operation During Idled Driving

Figure 6:
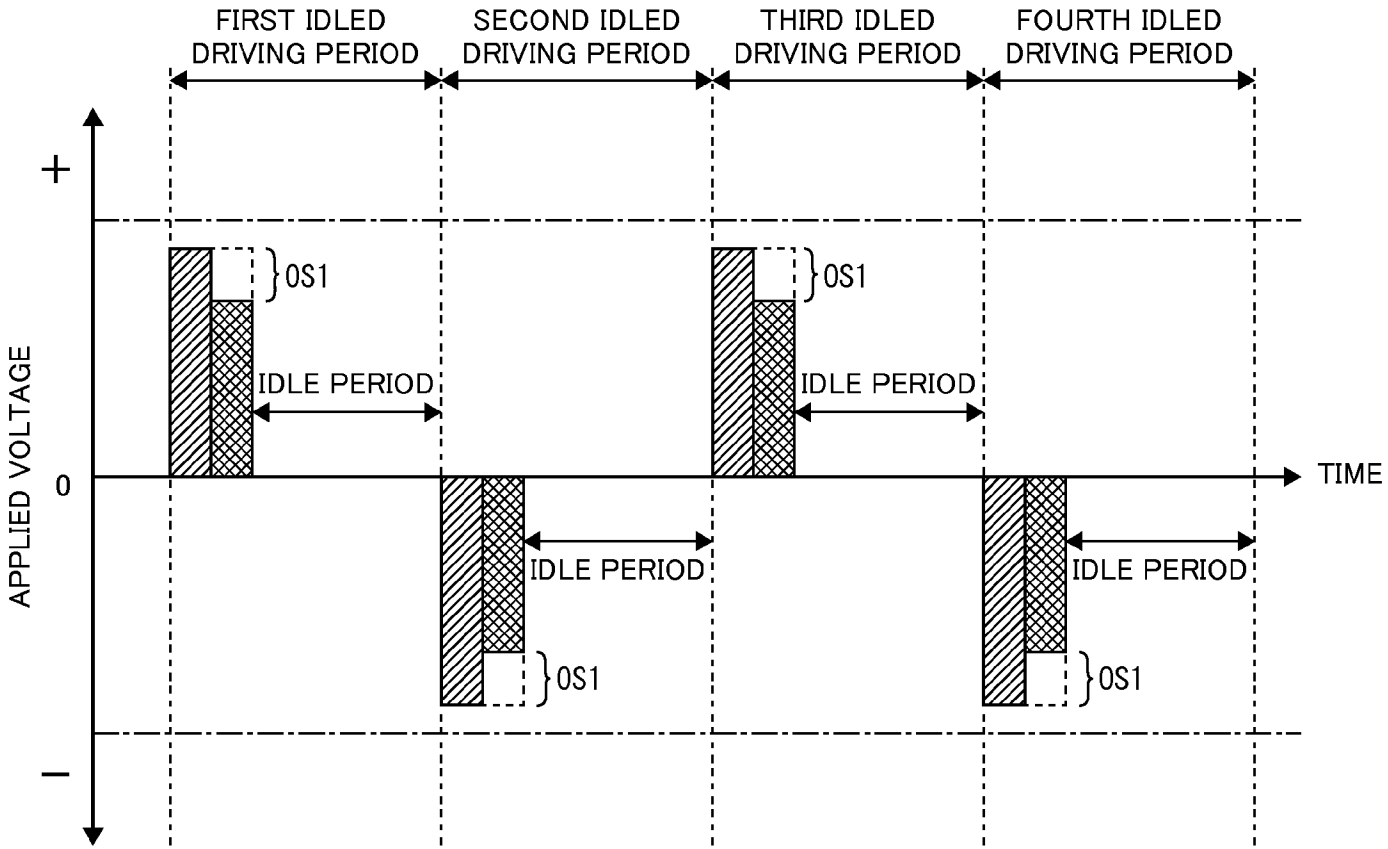
FIG. 6 illustrates idled driving involving overshoot driving in a pixel with a selector output of "0" in the liquid crystal display device shown in FIG. 1.
Figure 7:
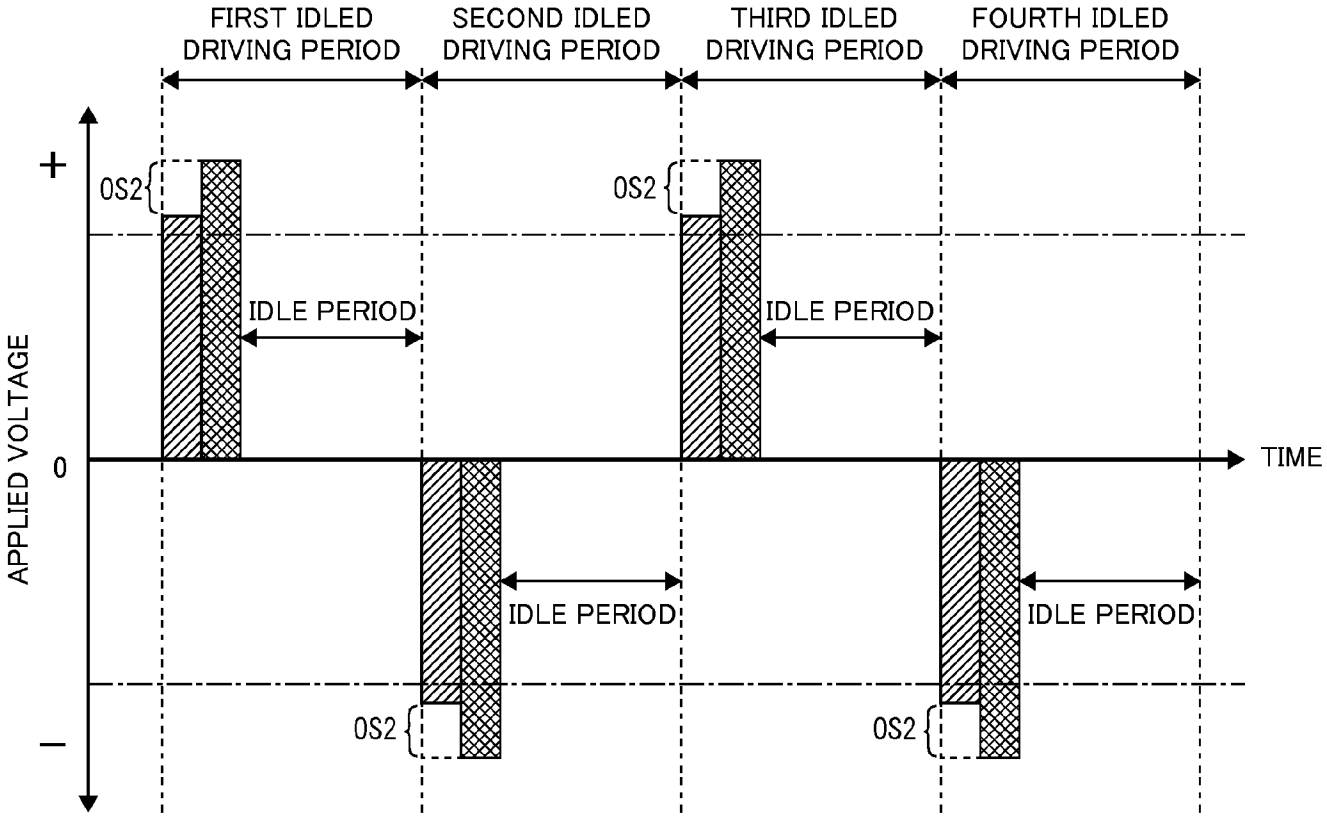
FIG. 7 illustrates idled driving involving undershoot driving in a pixel with a selector output of "0" in the liquid crystal display device shown in FIG. 1.
Figure 8:
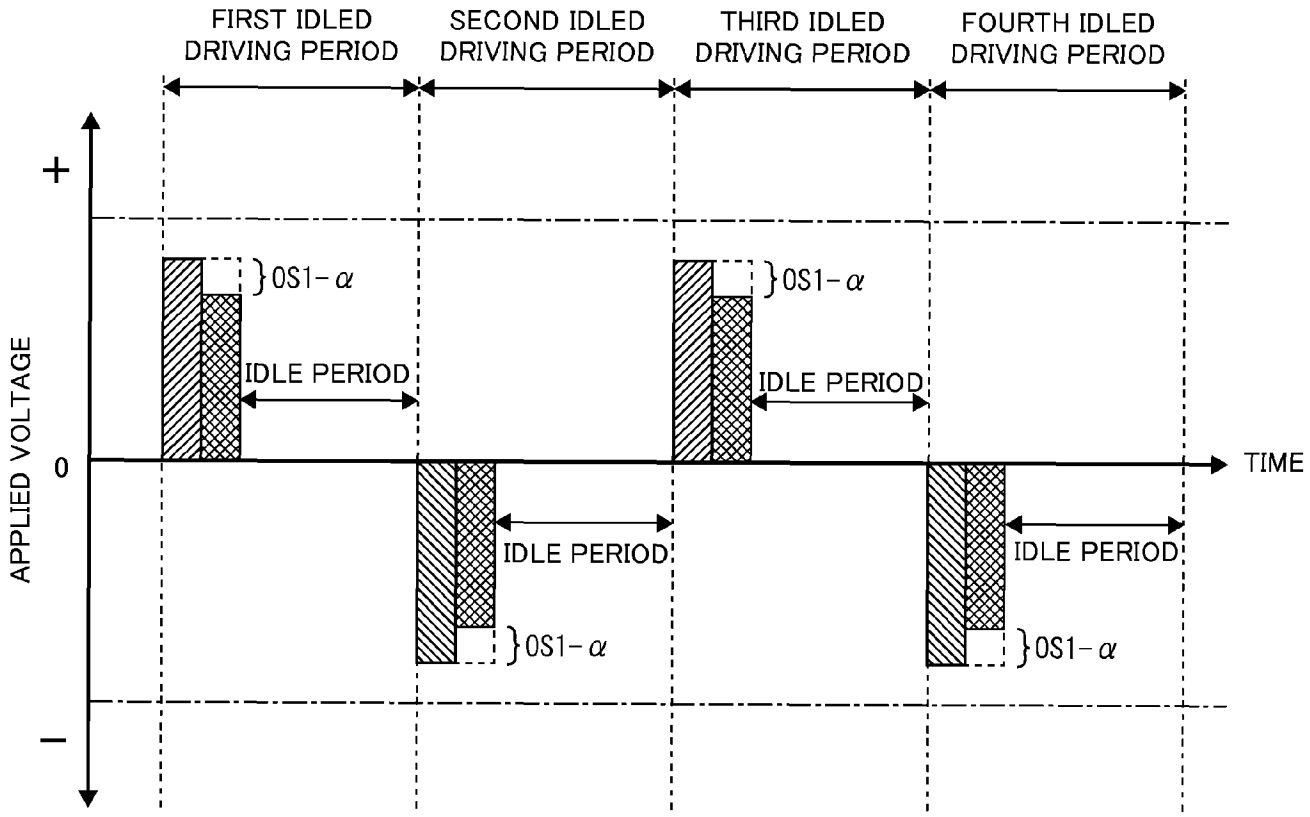
FIG. 8 illustrates idled driving involving overshoot driving in a pixel with a selector output of "1" in the liquid crystal display device shown in FIG. 1.
Figure 9:
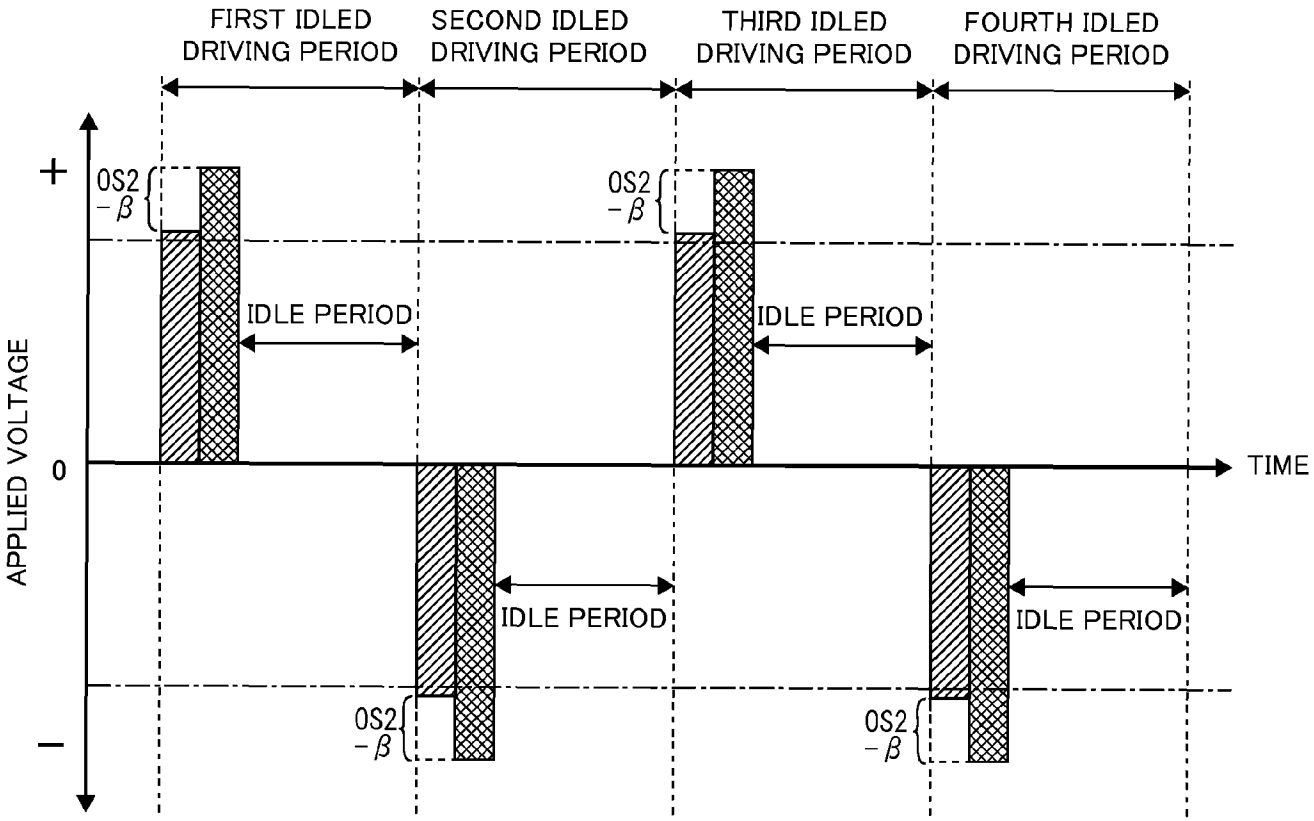
FIG. 9 illustrates idled driving involving undershoot driving in a pixel with a selector output of "1" in the liquid crystal display device shown in FIG. 1.

FIG. 6 illustrates idled driving involving overshoot driving in a pixel P(0) with a selector output of "0" in the liquid crystal display device 100. FIG. 7 illustrates idled driving involving undershoot driving in a pixel P(0) in the liquid crystal display device 100. FIG. 8 illustrates idled driving involving overshoot driving in a pixel P(1) with a selector output of "1" in the liquid crystal display device 100. FIG. 9 illustrates idled driving involving undershoot driving in a pixel P(1) in the liquid crystal display device 100.

<1.3.1 Idled Driving in Pixel P(0) with Selector Output of "0">

First, idled driving involving overshoot driving and undershoot driving in a pixel P(0) with a selector output of "0" will be described with reference to FIGS. 6 and 7.

The liquid crystal display device 100 drives the liquid crystal panel 10 by alternately repeating a driving period and an idle period. During a driving period, the drive/idle control unit 31 provides an active amplifier enable signal to the signal line control unit 25 such that an overshoot voltage or signal voltage is written to signal lines SL. During an idle period, the drive/idle control unit 31 provides a non-active amplifier enable signal to the signal line control unit 25 such that the signal line control unit 25 and/or scan line control unit 20 stops operating.

In the present specification, the one of the driving periods shown in FIGS. 6 and 7 in which an overshoot voltage is written is referred to as first driving period, and the period in which a signal voltage corresponding to a display gray scale level is written is referred to as second driving period. The frames for the driving periods are referred to as first drive frame and second drive frame, and the frame for an idle period is referred to as idle frame. The one of the driving periods shown in FIG. 7 in which an undershoot voltage is written is referred to as third driving period, and the period in which a signal voltage is written is referred to as fourth driving period. The frames for the driving periods are referred to as third drive frame and fourth drive frame, and the frame for an idle period is referred to as idle frame. When there is to be no distinction between an overshoot voltage, undershoot voltage and signal voltage, they may be simply referred to as voltages.

As shown in FIGS. 6 and 7, driving periods and idle periods are provided in an alternate manner, and a driving period and the following idle period are together referred to as idled driving period. The polarity of the signal voltage written to a signal line SL is reversed for each idled driving period. Thus, the polarity of the voltage is positive in the odd-numbered idled driving periods, and is negative in the even-numbered idled driving periods. In the examples shown in FIGS. 6 to 9, the gray scale value of the input image signal during each idled driving period is constant. This takes into consideration the fact that images displayed on the liquid crystal panel 10 using idled driving are usually still images. The present embodiment is not limited to still images, but any image suitable for idled driving may be used. In such cases, the gray scale value in each idled driving period of an input image signal is not necessarily constant. Examples where the gray scale value in each idled driving period is not constant will be described further below with reference to FIGS. 10 and 11.

The two chain lines at the top and bottom that run parallel to the time axis in each of FIGS. 6 and 7 indicate borders (i.e. are borderlines) for overshoot driving and undershoot driving. If the gray scale value of a preceding frame and the gray scale value of a current frame are equal and this gray scale value is not less than a predetermined value, undershoot driving occurs; otherwise, overshoot driving occurs. In the present embodiment, these chain lines indicate applied voltages corresponding to a situation where the gray scale value of a preceding frame and current frame in the LUT 43 is 224. Gray scale level 224, which is the gray scale value in this situation, may be referred to as "border value".

In the example of FIG. 6, a first and second drive frames are provided as consecutive ones in the driving period of the first idled driving period. In the first drive frame, the comparison circuit 42 determines the gray scale value of the input image signal provided externally (i.e. gray scale value of the current frame) and the gray scale value of the input image signal provided in the directly preceding frame period stored in the frame memory 41 (i.e. gray scale value of the preceding frame), and provides the result to the LUT 43. The LUT 43 provides the adding circuit 44 with the correction value associated with the combination of the gray scale value of the preceding frame and the gray scale value of the current frame. In this implementation, the gray scale value of the current frame is smaller than the relevant boundary value, and thus the correction value provided by the LUT 43 is positive. The adding circuit 44 adds the correction value provided by the LUT 43 to the gray scale value of the current frame provided by the frame memory 41, and provides the result to the subtracting circuit 46. Based on the output of the selector 45, the subtracting circuit 46 subtracts "0" (i.e. uses the same value as the output from the adding circuit 44) to generate a corrected image signal. The corrected image signal thus provided is converted to an overshoot voltage that is greater than the voltage associated with the input image signal by the amount of the correction value (labeled "OS1" in FIG. 6), and this voltage is written to the signal line SL. The polarity of this overshoot voltage is positive. Thus, overshoot driving occurs in the first idled driving period.

In the second drive frame, the same signal as the input image signal used in the first drive frame is stored in the frame memory 41. The frame memory 41 provides the stored input image signal to the adding circuit 44. The adding circuit 44 provides the provided input image signal to the subtracting circuit 46 without adding a correction value to it. The subtracting circuit 46 also provides the input signal as an image signal to the signal line control unit 25 without performing any subtraction operation in the second frame. The image signal is converted to an analog signal voltage corresponding to the voltage of the input image signal, which is written to the signal line SL. In the present specification, such driving is referred to as "normal driving". The polarity of this signal voltage is also positive. Thus, an image to be displayed in the first idled driving period is displayed on the liquid crystal panel 10.

Thus, in the first drive frame, a correction value provided by the LUT 43 is used to perform overshoot driving, and, in the subsequent second drive frame, normal driving occurs to write a signal voltage of positive polarity to the signal line SL. This is followed by an idle period in which the image written by the normal driving continues to be displayed, which lasts until the initiation of the first driving period of the second idled driving period.

In the driving periods of the second idled driving period, too, a first and second drive frames are provided as consecutive ones. In this case, similar to the frames of the first idled driving period, the gray scale value of the current frame is smaller than the relevant boundary value, and thus a correction value provided by the LUT 43 is used to perform overshoot driving in the first drive frame, and normal driving occurs in the second drive frame. However, unlike in the first idled driving period, the polarity of the overshoot voltage and signal voltage in the first and second drive frames is negative. This is followed by an idle period in which the image written by the normal driving continues to be displayed, which lasts until the initiation of the first driving period of the third idled driving period.

Then, similarly, in the odd-numbered idled driving period, an overshoot voltage of positive polarity is written in the first drive frame to perform overshoot driving. Then, a signal voltage of positive polarity is written in the second drive frame to perform normal driving, followed by an idle period. In the even-numbered idled driving period, too, an overshoot voltage of negative polarity is written in the first drive frame to perform overshoot driving. Then, a signal voltage of negative polarity is written in the second drive frame to perform normal driving, followed by an idle period.

In the example of FIG. 7, a third and fourth drive frames are provided as consecutive ones in the driving period of the first idled driving period. In the third drive frame, the comparison circuit 42 determines the gray scale value of the input image signal provided externally (i.e. gray scale value of the current frame) and the gray scale value of the input image signal provided in the directly preceding frame period stored in the frame memory 41 (i.e. gray scale value of the preceding frame), and provides the result to the LUT 43. The LUT 43 provides the adding circuit 44 with the correction value associated with the combination of the gray scale value of the preceding frame and the gray scale value of the current frame. In this implementation, the gray scale value of the preceding frame and the gray scale value of the current frame are equal and the gray scale value of the current frame is larger than the relevant boundary value, and thus the correction value provided by the LUT 43 is negative. The adding circuit 44 adds the correction value to the gray scale value of the current frame provided by the frame memory 41 to generate a corrected image signal, and provides it to the subtracting circuit 46. The corrected image signal is converted to an undershoot voltage that is smaller than the voltage associated with the input image signal by the amount of the correction value (labeled "OS2" in FIG. 7), and this voltage is written to the signal line SL. The polarity of this undershoot voltage is positive. Thus, undershoot driving occurs in the first idled driving period.

In the fourth drive frame, the same signal as the input image signal used in the third drive frame is stored in the frame memory 41. The frame memory 41 provides the stored input image signal to the adding circuit 44. The adding circuit 44 provides the provided input image signal as an image signal to the signal line control unit 25 without adding a correction value to it. The subtracting circuit 46 also provides the provided input image signal without performing subtraction in the fourth frame. The image signal is converted to an analog signal voltage corresponding to the voltage of the input image signal, which is written to the signal line SL. The polarity of this signal voltage is also positive. Thus, an image to be displayed in the first idled driving period is displayed on the liquid crystal panel 10.

Thus, in the third drive frame, a correction value provided by the LUT 43 is used to perform undershoot driving, and, in the subsequent fourth drive frame, normal driving occurs to write a signal voltage of positive polarity to the signal line SL. This is followed by an idle period in which the image written by the normal driving continues to be displayed, which lasts until the initiation of the first driving period of the second idled driving period.

In the driving periods of the second idled driving period, too, a third and fourth drive frames are provided as consecutive ones. In this case, similar to the frames of the first idled driving period, the gray scale value of the preceding frame and the gray scale value of the current frame are equal and the gray scale value of the current frame is larger than the relevant boundary value, and thus a correction value provided by the LUT 43 is used to perform undershoot driving in the third drive frame, and normal driving occurs in the fourth drive frame. However, unlike in the first idled driving period, the polarity of the undershoot voltage and signal voltage in the third and fourth drive frames is negative. This is followed by an idle period in which the image written by the normal driving continues to be displayed, which lasts until the initiation of the first driving period of the third idled driving period.

Then, similarly, in the odd-numbered idled driving period, an undershoot voltage of positive polarity is written in the third drive frame to perform undershoot driving. Then, a signal voltage of positive polarity is written in the fourth drive frame to perform normal driving, followed by an idle period. In the even-numbered idled driving period, an undershoot voltage of negative polarity is written in the third drive frame to perform undershoot driving. Then, a signal voltage of negative polarity is written in the fourth drive frame to perform normal driving, followed by an idle period.

<1.3.2 Idled Driving in Pixel P(1) with Selector Output of "1">

Idled driving involving overshoot driving and undershoot driving in a pixel P(1) with a selector output of "1" will now be described with reference to FIGS. 8 and 9.

For a pixel P(1) with a selector output of "1", the selector 45 provides "1" as a value to be subtracted to the subtracting circuit 46 in the first drive frame for overshoot driving and in the third drive frame for undershoot driving. The selector 45 provides "0" as a value to be subtracted to the subtracting circuit 46 in the second drive frame (FIG. 8) and fourth drive frame (FIG. 9) for normal driving.

Thus, a comparison between FIGS. 6 and 8 shows that, in a pixel P(1) with a selector output of "1", the amount of the correction value for the overshoot voltage is (OS1−α). Here, α is the voltage corresponding to the amount of gray scale width of 1 subtracted by the subtracting circuit 46. Further, a comparison between FIGS. 7 and 9 shows that, for a pixel P(1) with a selector output of "1", the amount of the correction value for the undershoot voltage is (OS2−β). Here, β is the voltage corresponding to a gray scale width of 1 subtracted by the subtracting circuit 46.

<1.3.3 Idled Driving when Gray Scale Value of Preceding Frame is Different from Gray Scale Value of Current Frame>

Figure 10:
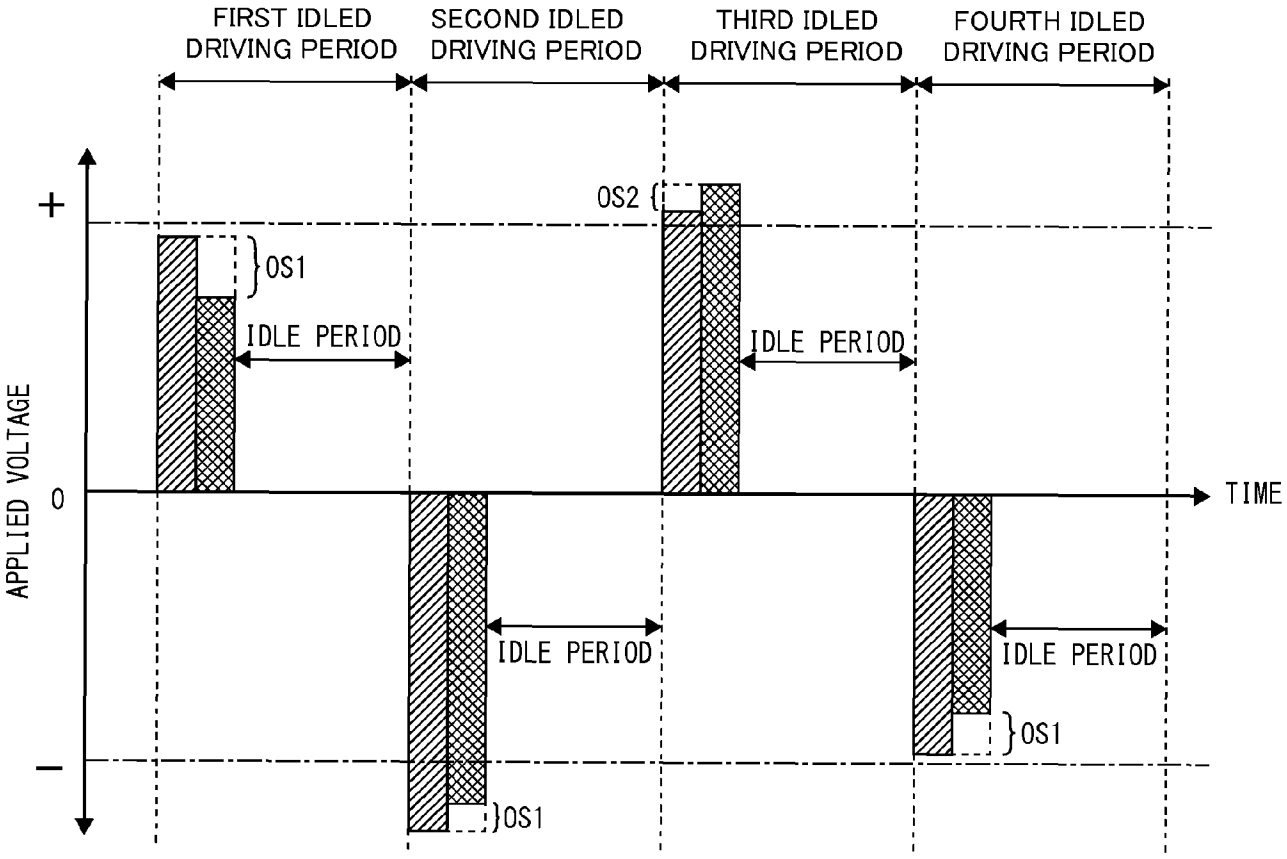
FIG. 10 illustrates idled driving in a pixel with a selector output of "0" in the liquid crystal display device shown in FIG. 1, where the gray scale value of a current frame may be different from the gray scale value of its preceding frame.
Figure 11:
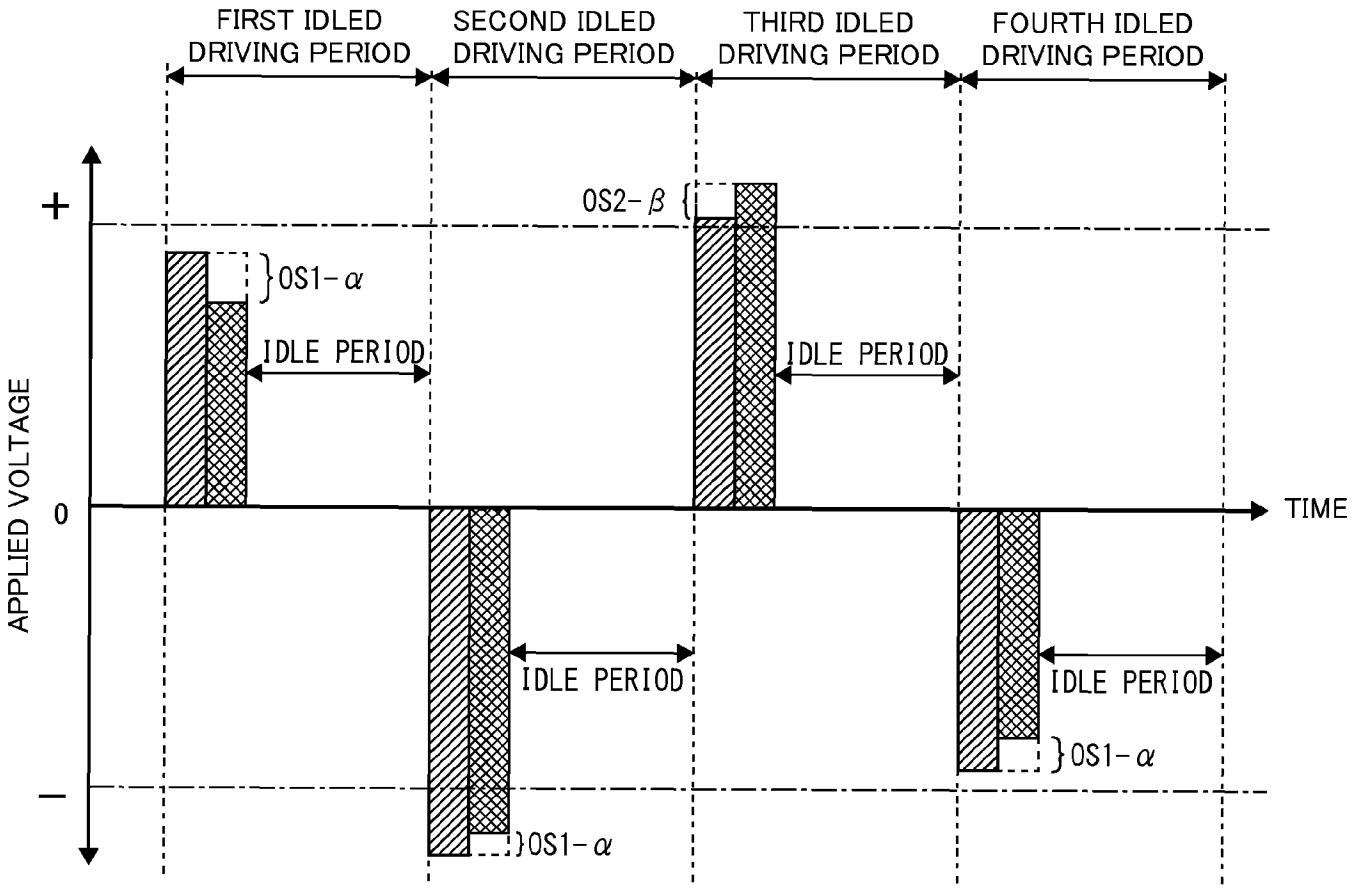
FIG. 11 illustrates idled driving in a pixel with a selector output of "1" in the liquid crystal display device shown in FIG. 1, where the gray scale value of a current frame may be different from the gray scale value of its preceding frame.

While FIGS. 6 to 9 show examples where the gray scale value of a current frame is equal to the gray scale value of its preceding frame, FIGS. 10 and 11 illustrate idled driving where the gray scale value of a current frame may be different from the gray scale value of its preceding frame. FIG. 10 shows an example for a pixel P(0) with a selector output of "0", while FIG. 11 shows an example for a pixel P(1) with a selector output of "1".

First, the first idled driving period for a pixel P(0) with a selector output of "0" will be described with reference to FIG. 10. In the first drive frame, the gray scale value of the current frame is smaller than the relevant boundary value, and thus a correction value provided by the LUT 43 is added to generate an overshoot voltage with positive polarity, and overshoot driving occurs. In the second drive frame, an analog signal voltage of positive polarity is generated without correcting the gray scale value of the current frame, and normal driving occurs.

In the second idled driving period, the gray scale value of the current frame is larger than the relevant boundary value, but is different from the gray scale value of the input image signal in the first idled driving period (i.e. gray scale value of the preceding frame). Thus, in the first drive frame, overshoot driving with negative polarity occurs, before normal driving with negative polarity occurs in the second drive frame.

In the third idled driving period, the gray scale value of the current frame is larger than the relevant boundary value and the gray scale value of the current frame is equal to the gray scale value of the input image signal in the second idled driving period (i.e. gray scale value of the preceding frame). Thus, in the first drive frame, undershoot driving with positive polarity occurs, before normal driving with positive polarity occurs in the second drive frame. In the fourth idled driving period, the gray scale value of the current frame is smaller than the relevant boundary value, and thus overshoot driving with negative polarity occurs in the first drive frame before normal driving with negative polarity occurs in the second drive frame.

The first idled driving period for a pixel P(1) with a selector output of "1" will now be described with reference to FIG. 11.

For a pixel P(1) with a selector output of "1", the selector 45 provides "1" as a value to be subtracted to the subtracting circuit 46 in the first drive frame for overshoot driving and in the third drive frame for undershoot driving. The selector 45 provides "0" as a value to be subtracted to the subtracting circuit 46 in the second drive frame and fourth drive frame for normal driving.

Thus, a comparison between FIGS. 10 and 11 shows that, in a pixel P(1) with a selector output of "1", the amount of the correction value for the overshoot voltage is (OS1−α). Here, α is the voltage corresponding to the amount of gray scale width of 1 subtracted by the subtracting circuit 46. Further, for a pixel P(1) with a selector output of "1", the amount of the correction value for the undershoot voltage is (OS2−β). Here, β is the voltage corresponding to a gray scale width of 1 subtracted by the subtracting circuit 46.

1.4 Effects

Figure 12:
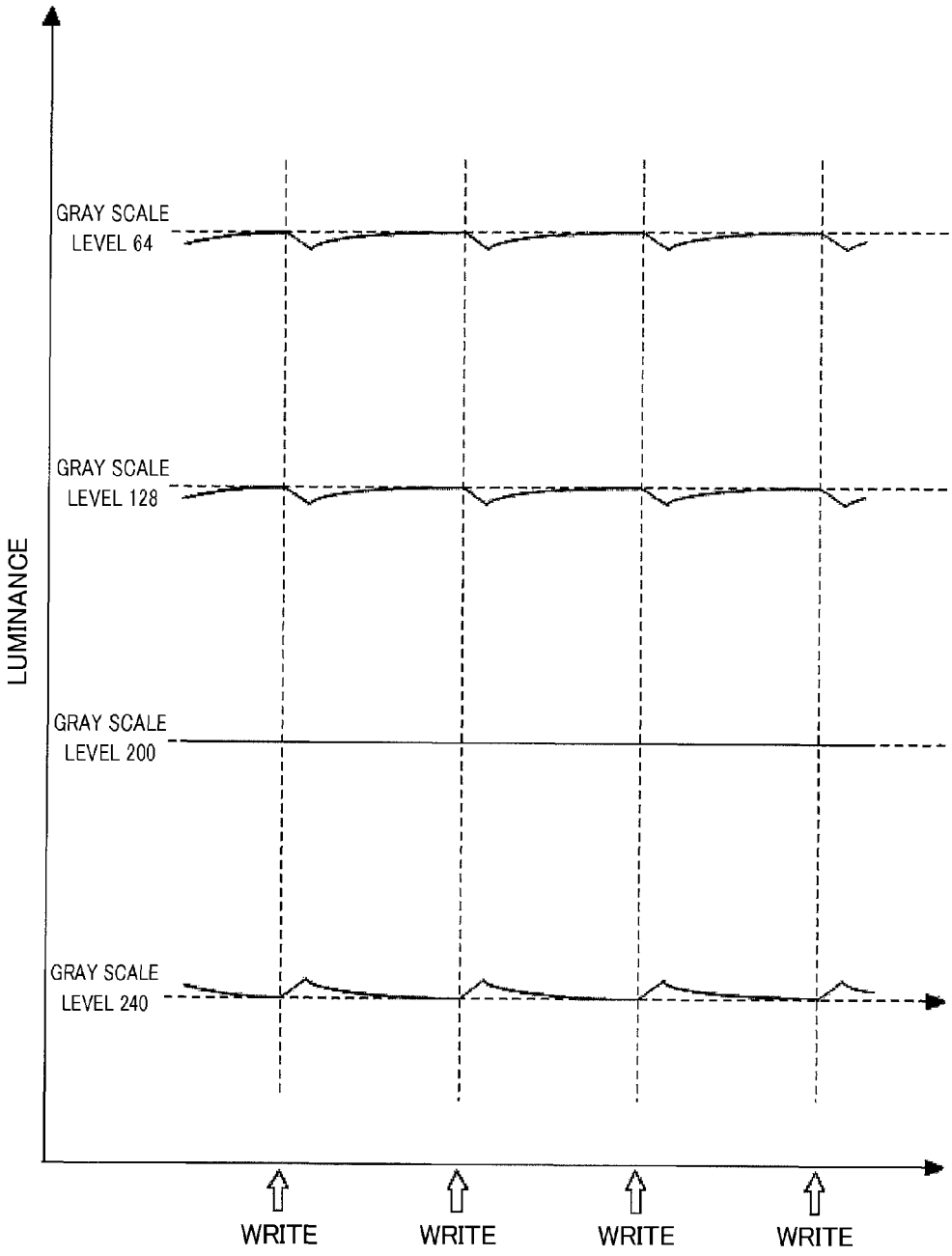
FIG. 12 schematically illustrates how luminance changes when idled driving occurs in the liquid crystal display device shown in FIG. 1.

FIG. 12 schematically illustrates how luminance changes when idled driving occurs in the liquid crystal display device 100. As described with regard to FIG. 45, for an input image signal of gray scale level 64, luminance rapidly decreases directly after the signal voltage is written to the image-forming unit, and then gradually recovers. On the other hand, for an input image signal of gray scale level 240, luminance rises rapidly directly after the signal voltage is written to the pixel-forming unit, and then gradually decreases. In contrast, according to the present embodiment, overshoot driving or undershoot driving occurs depending on the gray scale value of the input image signal. This prevents luminance from rapidly decreasing for gray scale levels 64 and 128, or prevents luminance from rapidly increasing for gray scale level 240, thereby minimizing changes in the luminance of images being displayed for both gray scale value. Thus, the viewer can hardly recognize flickers, which means improved quality of images displayed on the display panel 10.

Since normal driving occurs after overshoot driving or undershoot driving occurs, the last signal voltage written to the signal line SL in the driving period has the voltage value associated with the input image signal. This allows the liquid crystal display device 100 to constantly display images associated with input image signals. Further, the switching element of a pixel-forming unit 15 is an In—Ga—Zn—O TFT 16, which has a very small off-leak current. Thus, after luminance decreases directly after a signal voltage is written, luminance recovers to the original level in the following idle period.

1.5 First Example Variation

In the above embodiment, for each driving period, overshoot driving and normal driving or undershoot driving and normal driving occur once consecutively. Alternatively, three or more drive frames may be provided to increase the driving period such that overshoot driving or undershoot driving occurs a plurality of times, before normal driving occurs once.

Figure 13:
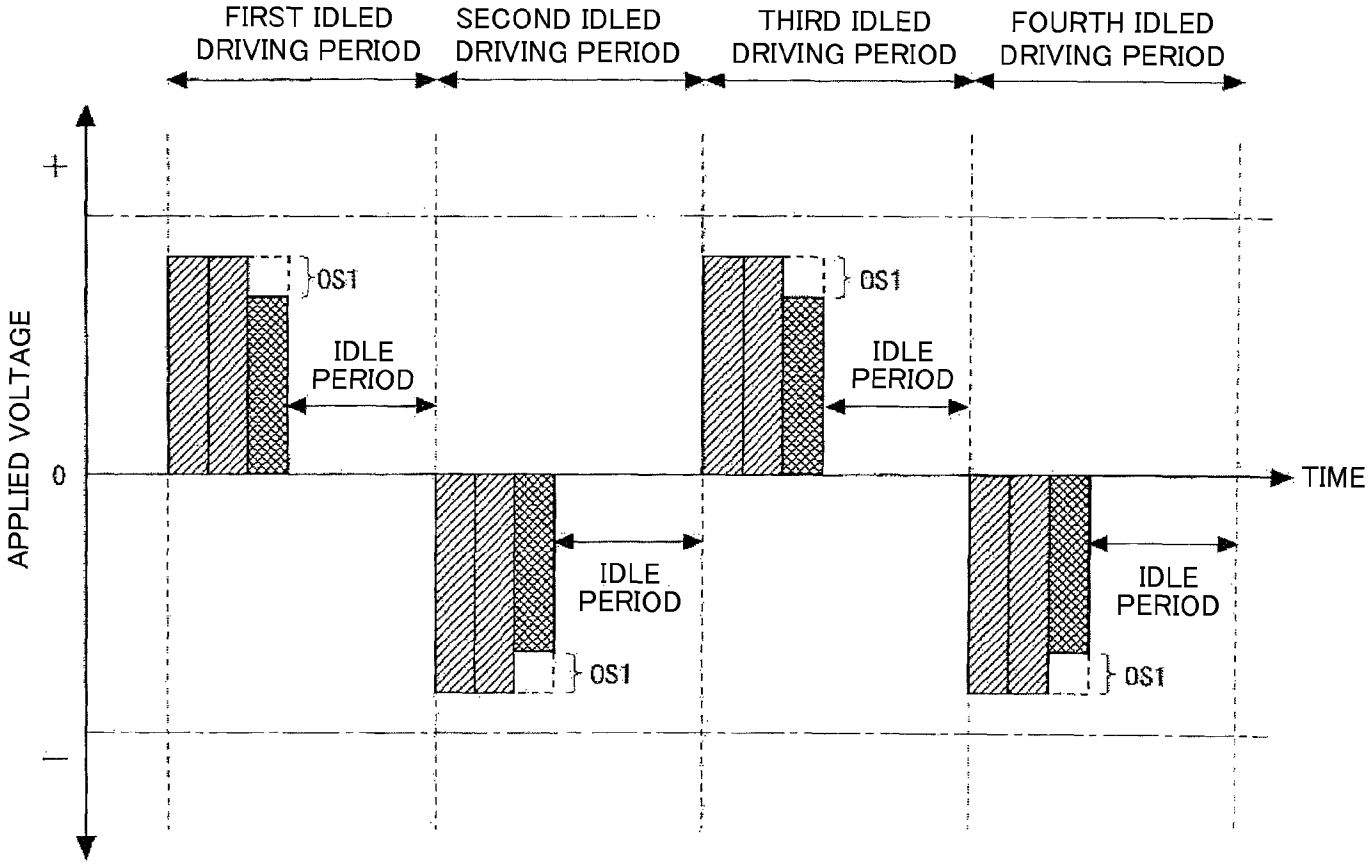
FIG. 13 illustrates idled driving in a first example variation of the first embodiment, where overshoot driving occurs twice.

The configuration of the liquid crystal display device of the first example variation of the present embodiment is the same configuration shown in FIG. 1, and thus its block diagram and description will not be provided. FIG. 13 illustrates idled driving in the present example variation. As shown in FIG. 13, during the driving period of the first idled driving period, overshoot driving occurs twice consecutively, before normal driving occurs once.

Figure 14:
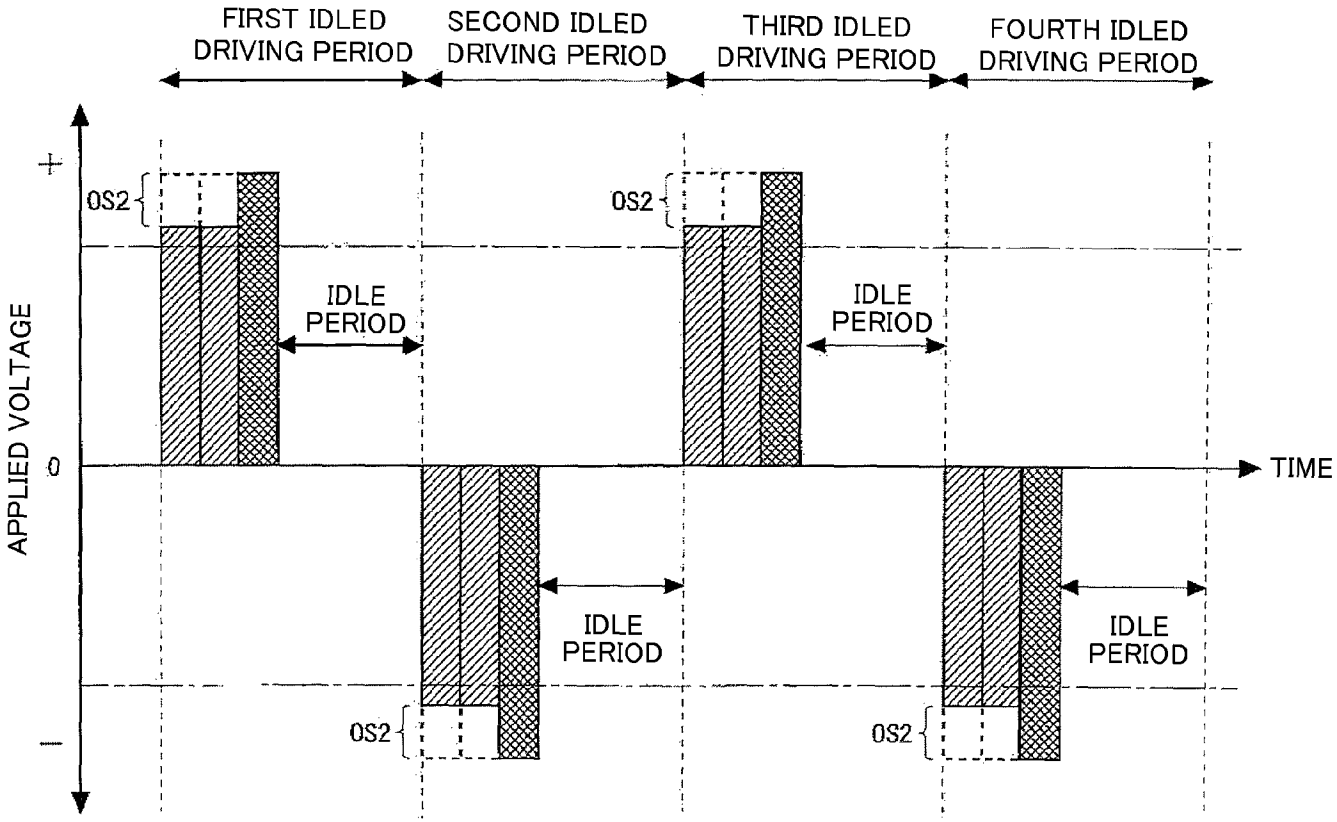
FIG. 14 illustrates idled driving in the first example variation of the first embodiment, where undershoot driving occurs twice.

As overshoot driving occurs twice consecutively in the driving period of each idled driving period, even liquid crystal molecules of liquid crystal with a low response speed can be oriented in the direction of the applied voltage in a reliable manner. Also, as shown in FIG. 14, undershoot driving may occur twice consecutively and then normal driving may occur once. The effects of this implementation are the same as that shown in FIG. 13, and thus will not be described.

While in the present example variation the number of times that overshoot driving and undershoot driving occur is two, it may be three or more for liquid crystal with a yet lower response speed.

Figure 15:
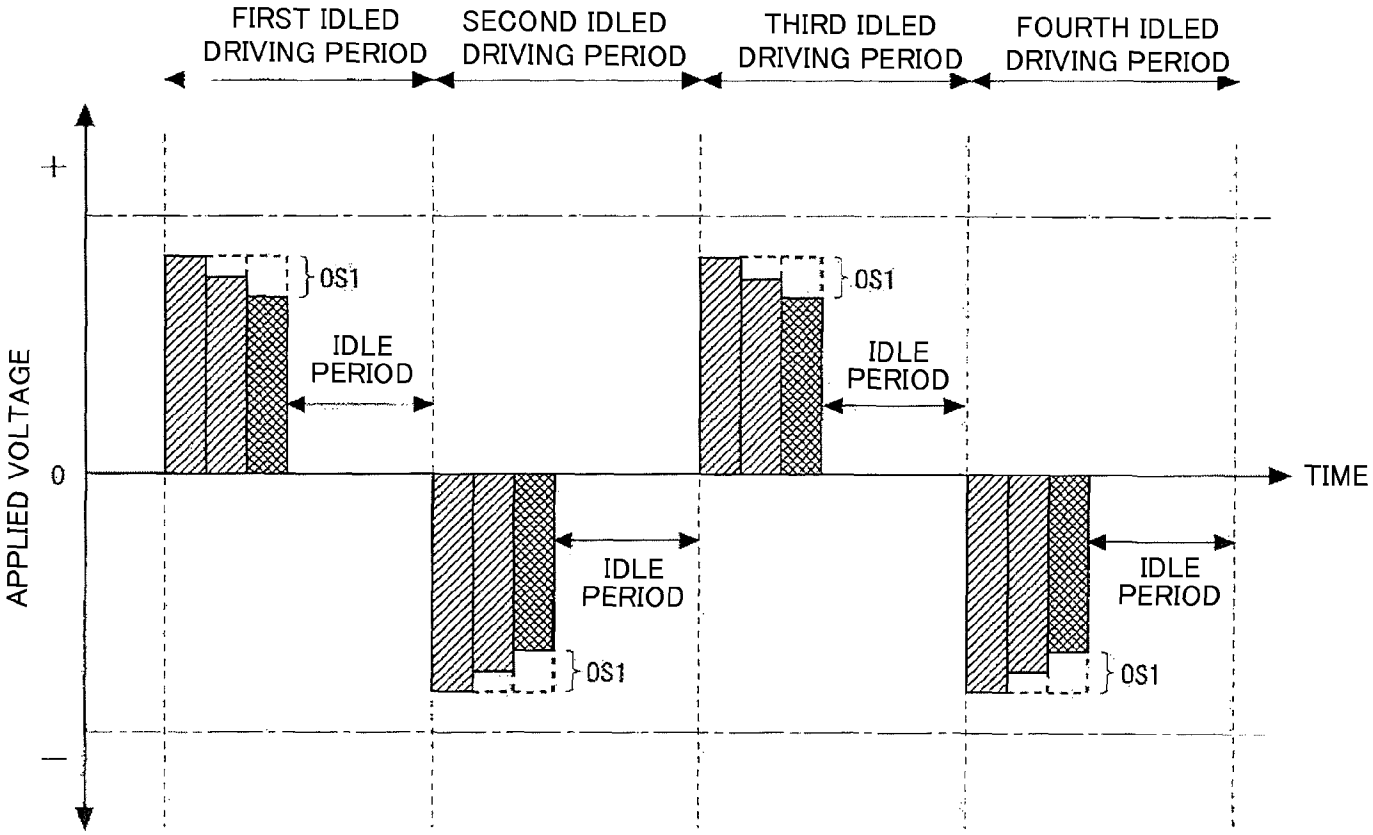
FIG. 15 illustrates idled driving in the first example variation of the first embodiment, involving overshoot driving where the voltage value gradually decreases.
Figure 16:
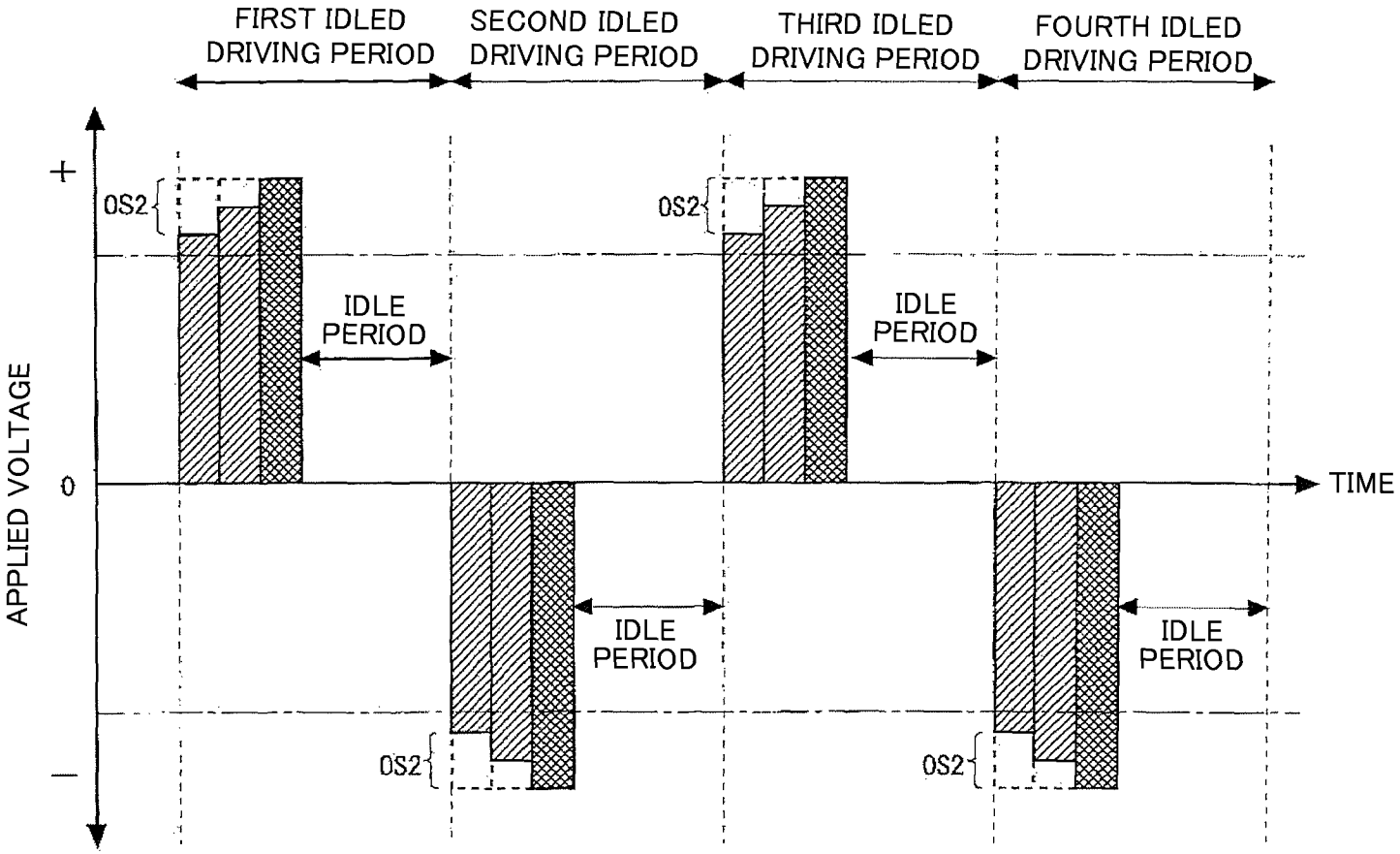
FIG. 16 illustrates idled driving involving undershoot driving in the first example variation of the first embodiment, where the voltage value gradually increases.

Further, in the overshoot driving shown in FIG. 13, the overshoot voltages written while overshoot driving occurs twice consecutively have the same value. However, these voltages may have different values: as shown in FIG. 15, overshoot driving may be performed by writing overshoot voltages whose value gradually decreases. Alternatively, as shown in FIG. 16, undershoot driving may be performed by writing undershoot voltages whose value gradually increases.

Note that in each of the examples of FIGS. 13 to 16, an image associated with an input image signal needs to be displayed during the idle period, and thus normal driving needs to occur in the last drive frame in the driving period to write the signal voltage of the voltage value associated with the input image signal.

In the present example variation, where overshoot driving or undershoot driving occurs twice or more consecutively, pixels P(0) with a selector output of "0" and pixels P(1) with a selector output of "1" may be in different arrangements for each driving period, however, they are preferably be in the same arrangement. The reason for this will be described with reference to FIG. 17. In these examples, a correction value for overshoot provided by the LUT 43 is a gray scale width of 2, and, when a total of four pixels with two horizontally and two vertically constitute one unit, the pixels to the top left and to the bottom right are P(1) and the pixels to the bottom left and top right are P(0) during overshoot driving for the first frame. Then, if the arrangement of pixels P(0) and P(1) of the first frame is maintained in the second frame, as shown in the upper section of FIG. 17, the total correction amount from the overshoot driving in the first frame and the overshoot driving in the second frame (i.e. "total amount of correction gray scale range" in FIG. 17) is a gray scale width of 2 for the pixels to the top left and to the bottom right, and an gray scale width of 4 for the pixels to the bottom left and to the top right. In this case, the effects of spatial correction are maintained.

Figure 17:
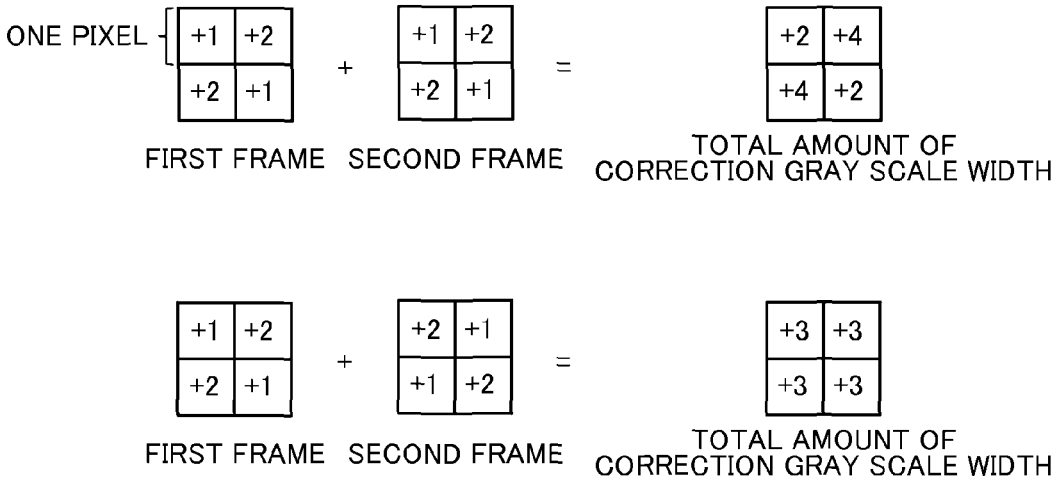
FIG. 17 illustrates effects of the first example variation of the first embodiment, for different pixel arrangements, involving idled driving where overshoot driving occurs twice.

On the other hand, if a different arrangement of pixels P(0) and P(1) is used in the second frame where the pixels to the bottom left and to the top right are P(0) in the second frame, as shown in the lower section of FIG. 17, the total correction amount from the overshoot driving in the first frame and the overshoot driving from the second frame is a gray scale width of 3 for all the pixels, potentially eliminating the effects of spatial correction.

1.6 Second Example Variation

In the above embodiment, the TFT of a pixel-forming unit 15 is an In—Ga—Zn—O TFT 16. Alternatively, it may be a TFT having a channel layer made of amorphous silicon (Si) or polycrystalline silicon. A TFT having a channel layer made of amorphous silicon and a TFT having a channel layer made of polycrystalline silicon will be hereinafter referred to as "a-TFT" and "p-TFT", respectively.

More specifically, a second example variation of the present embodiment is a liquid crystal display device using a-TFTs or p-TFTs as the switching elements of the pixel-forming units 15. The configuration of this liquid crystal display device is the same as the configuration of the liquid crystal display device 100 shown in FIG. 1 except that the In—Ga—Zn—O TFTs are replaced by a-TFTs or p-TFTs, and thus their description and block diagram will not be provided.

A liquid crystal display device using a-TFTs is not suitable for displaying images with multiple gray scale levels, as is the case with a liquid crystal display device using In—Ga—Zn—O TFTs; however, it is capable of displaying images that can be displayed in two luminance levels, such as black and white images. Further, an RGB color filter may be attached to the surface of the liquid crystal panel to display images rendered in eight colors, including black. Note that a-TFTs or p-TFTs also include TFTs having a channel layer made of a semiconductor such as amorphous silicon-germanium (SiGe) or a polycrystalline silicon-germanium.

1.7 Third Example Variation

The above embodiment (including the above example variations) illustrates arrangements where the output of the selector 45 is "0" or "1". However, the selector output is not limited to these values, and may have any value selected from among two values that have an appropriate difference, provided that an amount of correction by a unit smaller than a gray scale width of 1 can be generated in a spatial manner.

1.8 Fourth Example Variation

The above embodiment (including the above example variations) illustrates arrangements where a subtracting circuit 46 for subtracting an output of the selector 45 is provided between the adding circuit 44 and signal line control unit 25. Alternatively, the subtracting circuit 46 may be replaced by an adding circuit. This arrangement generates a corrected image signal with an output from the selector 45 added, and provides the same effects of spatial correction as the arrangement with the subtracting circuit 46.

1.9 Fifth Example Variation

The example variations described in 1.9.1 to 1.9.3 below are related to variations of how pixels to which different outputs are provided from the selector 45 are arranged.

<1.9.1 Arrangements Depending on Polarity Reversing Technique>

First, preferred arrangements selected depending on polarity reversing technique will be described.

Polarity reversing techniques for the liquid crystal display device include, for example: (1) reversing, for each frame, the polarity of the voltage applied to each pixel such that the voltages applied to the sub-pixels connected with the same signal line have the same polarity (i.e. so-called source line reverse driving); (2) reversing, for each frame, the polarity of the voltage applied to each pixel such that the sub-pixels connected with the same scan line have the same polarity (i.e. so-called gate line reverse driving); and (3) reversing, for each frame, the polarity of the voltage applied to each pixel such that the voltages applied to sub-pixels adjacent to each other in the vertical and horizontal directions have opposite polarities (i.e. so-called dot reverse driving).

The present example variation describes preferred exemplary arrangements of pixels for each of these reversing techniques.

Figure 18:
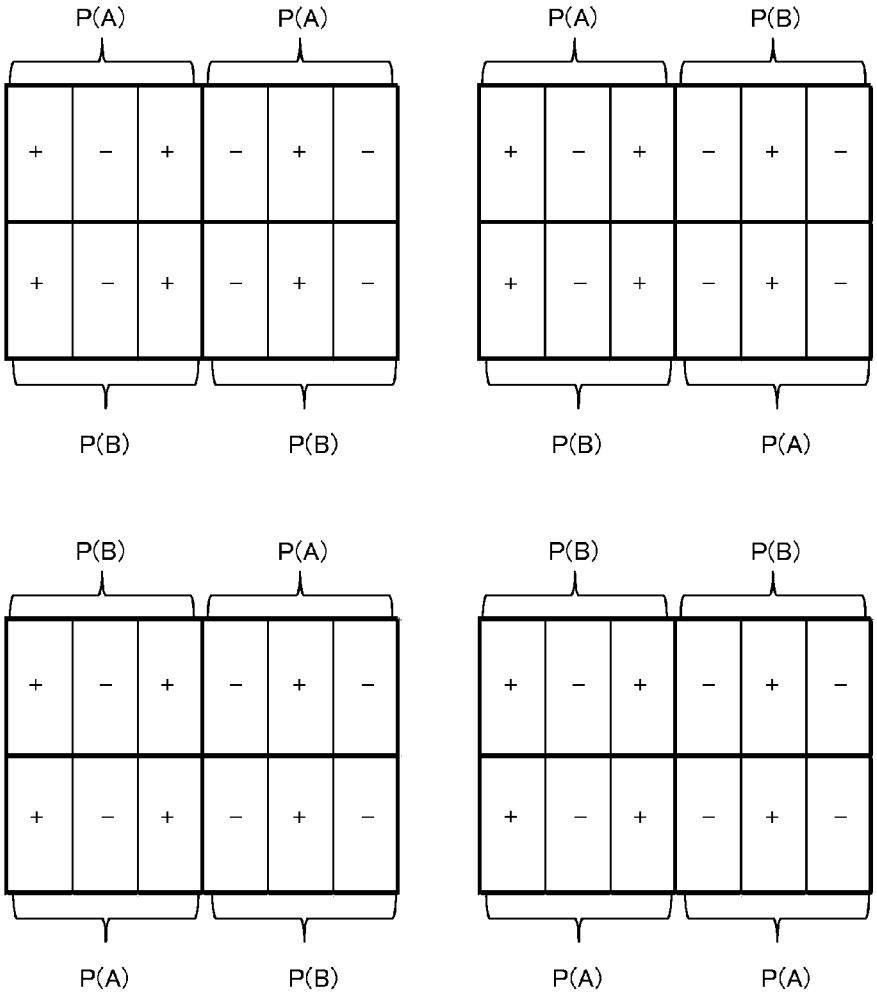
FIG. 18 illustrates a preferred example pixel arrangement where the liquid crystal display device according to an example variation of the first embodiment is based on source line reverse driving.

First, four exemplary pixel arrangements suitable for source line reverse driving are shown in FIG. 18. In FIG. 18, the symbol "+" or "−" in each sub-pixel denotes the polarity of the voltage applied to this sub-pixel in a given frame. P(A) and P(B) denote pixels to which different selector outputs A and B, respectively, are provided. For example, when "0" is provided as a selector output to the pixels P(A), "1" is provided to the pixels P(B). When "1" is provided as a selector output to the pixels P(A), "0" is provided to the pixels P(B). As discussed above, the selector output is not limited to "0" or "1".

As shown in FIG. 18, a pixel arrangement suitable for source line reverse driving presupposes that the pixels P(A) and P(B) are arranged in the direction in which the signal lines extend (i.e. vertical direction). In other words, the pixels P(A) or P(B) are not adjacent to each other in the direction in which the signal lines extend (i.e. vertical direction).

As the pixels P(A) and P(B) to which different selector outputs are provided are disposed to be adjacent to each other in the direction in which the signal lines extend, during source line reverse driving, the amount of overshoot or undershoot is prevented from being biased in the direction in which the signal lines extend. Thus, flickering is prevented from being aggravated even when a pattern where a flicker can easily be visible is displayed. A pattern where a flicker can easily be visible may be, for example, a pattern where the pixels with more sub-pixels of positive polarity displays an image with gray scale level 64 and the pixels with more sub-pixels of negative polarity displays an image with gray scale level 0.

Figure 19:
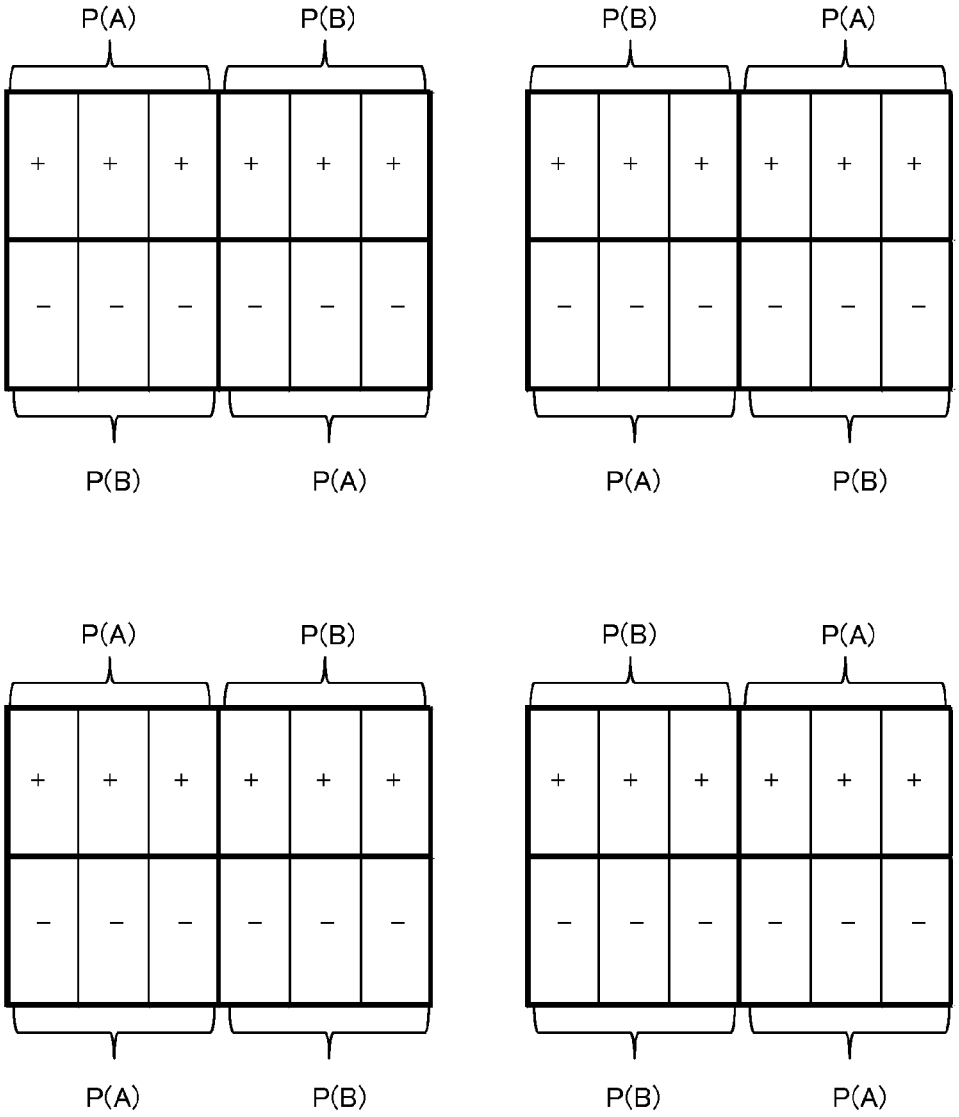
FIG. 19 illustrates a preferred example pixel arrangement where the liquid crystal display device according to an example variation of the first embodiment is based on gate line reverse driving.

Four example pixel arrangements suitable for gate line reverse driving are shown in FIG. 19. As shown in FIG. 19, a pixel arrangement suitable for gate line reverse driving presupposes that the pixels P(A) and P(B) are arranged in the direction in which the scan lines extend (i.e. horizontal direction). In other words, the pixels P(A) or P(B) are not adjacent to each other in the direction in which the scan lines extend (i.e. horizontal direction).

As the pixels P(A) and P(B) to which different selector outputs are provided are disposed to be adjacent in the direction in which the scan lines extend, during gate line reverse driving, the amount of overshoot or undershoot is prevented from being biased in the direction in which the scan lines extend, preventing flickers from being aggravated.

Figure 20:
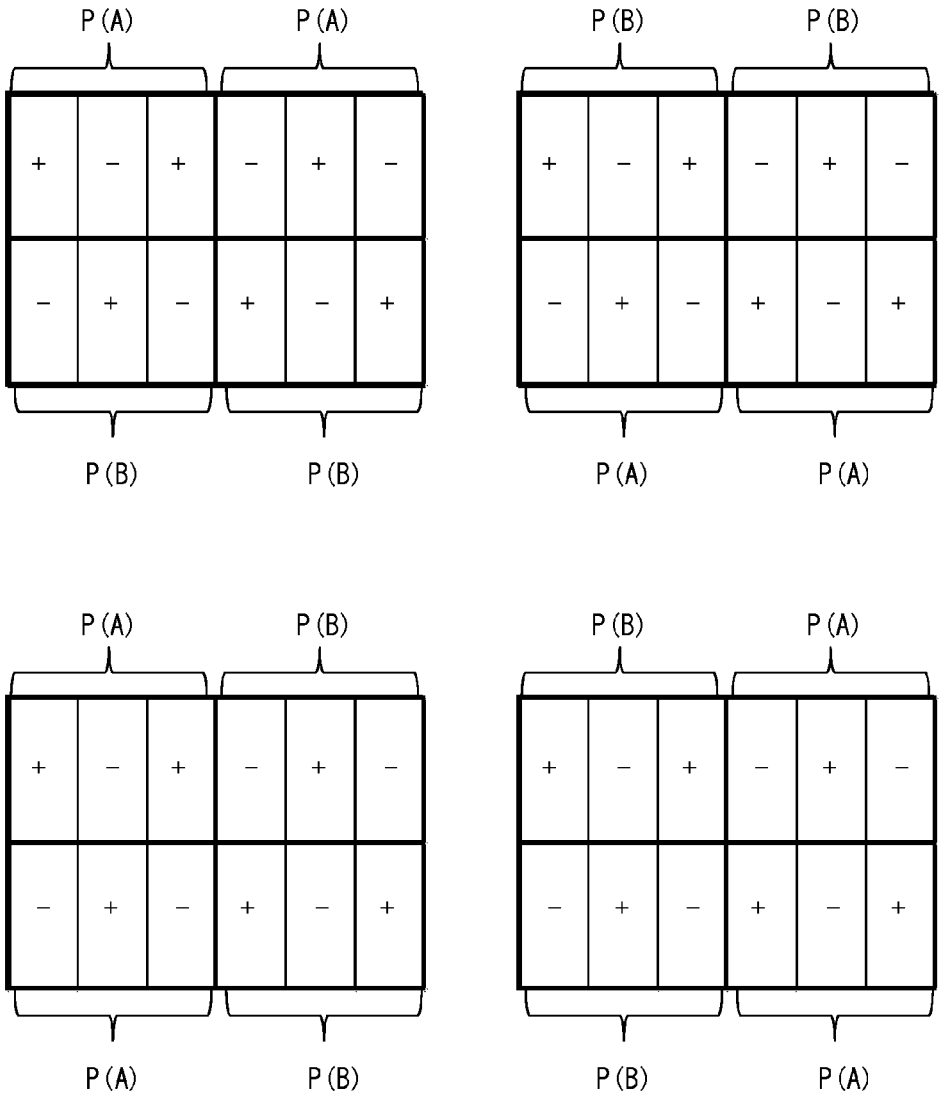
FIG. 20 illustrates a preferred example pixel arrangement where the liquid crystal display device according to an example variation of the first embodiment is based on dot reverse driving.

Four example pixel arrangements suitable for dot reverse driving are shown in FIG. 20. As shown in FIG. 20, a pixel arrangement suitable for dot reverse driving presupposes that the pixels P(A) and P(B) are adjacent diagonally. In other words, the pixels P(A) or P(B) are not adjacent to each other diagonally.

As the pixels P(A) and P(B) to which different selector outputs are provided are disposed to be adjacent to each other diagonally, during dot reverse driving, the amount of overshoot or undershoot is prevented from being biased in a diagonal direction, preventing flickers from being aggravated.

<1.9.2 Pixel Arrangement in Larger Units>

Figure 21:
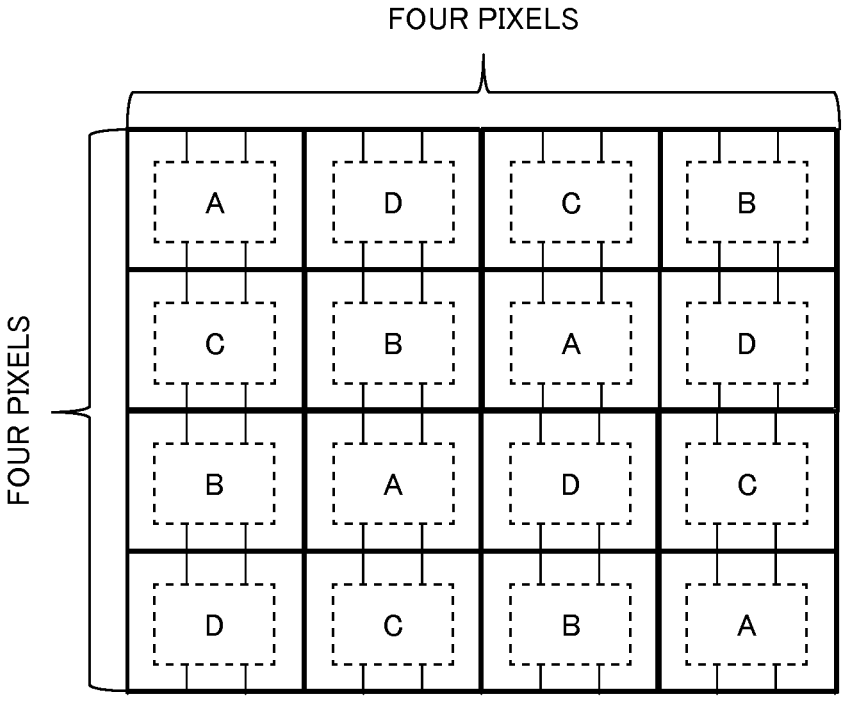
FIG. 21 illustrates a preferred example pixel arrangement in the liquid crystal display device according to an example variation of the first embodiment.

The above embodiment (including the above example variations) mainly describes an arrangement where a total of four pixels, with two horizontally and two vertically, constitute one unit. The present example variation describes an example pixel arrangement suitable for larger units. FIG. 21 shows, by way of example, an arrangement where a total of 16 pixels, with four horizontally and four vertically, constitute one unit.

In FIG. 21, a pixel P(VL) to which the higher one of the two values is provided as the selector output $V_{SEL}$ or a pixel P(VU) to which the lower one is provided is assigned to each of the positions labeled P(A) to P(D).

For example, as shown in FIG. 22, P(VL) or P(VU) may be assigned to each of the positions of the pixels P(A) to P(D) depending on display gray scale level. As in the example shown in FIG. 22, it is supposed that the correction value obtained from the LUT 43 for a display gray scale level of 0 is the gray scale width of 0. In this case, P(VU) is assigned to every one of the pixels P(A) to P(D).

It is supposed that the correction value obtained from the LUT 43 for a display gray scale level of 32 is the gray scale width of 2. In this case, P(VL) is assigned to the pixels P(A) and P(B), while P(VU) is assigned to the pixels P(C) and P(D). Thus, the subtracting circuit 46 subtracts the amount of gray scale width of 1 for the pixels P(A) and P(B) to which P(VL) is assigned. On the other hand, the subtracting circuit 46 subtracts the amount of gray scale width of 0 for the pixels P(C) and P(D) to which P(VU) is assigned such that the output from the adding circuit 44 is provided to the signal control unit 25 without any modification. As a result, the amount of correction for the pixels P(A) and P(B) is the gray scale width of 1 and the amount of correction for the pixels P(C) and P(D) is the gray scale width of 2, such that the spatial amount of correction measured when the 16 pixels are viewed as a whole is the gray scale width of 1.5.

It is supposed that the correction value obtained from the LUT 43 for a display gray scale level of 128 is the gray scale width of 3 for example. In this case, P(VL) is assigned to the pixels P(A), while P(VU) is assigned to the pixels P(B), P(C) and P(D). Thus, the subtracting circuit 46 subtracts the amount of gray scale width of 1 for the pixels P(A) to which P(VL) is assigned. On the other hand, the subtracting circuit 46 subtracts the amount of gray scale width of 0 for the pixels P(B), P(C) and P(D) to which P(VU) is assigned such that the output from the adding circuit 44 is provided to the signal control unit 25 without any modification. As a result, the correction amount for the pixels P(A) is the gray scale width of 2, while the correction amount for the pixels P(B), P(C) and P(D) is the gray scale width of 3 such that the spatial amount of correction measured when the 16 pixels are viewed as a whole is the gray scale width of 2.75.

Thus, the arrangement shown in FIGS. 21 and 22 enables spatial correction by a unit smaller than the unit amount for the correction values specified in the LUT 43.

Seven other preferred manners of assigning P(VL) and P(VU) to the pixels P(A) to P(D) are shown in FIG. 23 as Example Arrangements 1 to 7. In FIG. 23, arrangements with P(VL) and P(VU) switched are also possible.

In the preferred example arrangements shown in FIGS. 21 and 23, four pixels P(A) to P(D) form the smallest constitutional unit, and four such smallest constitutional units are combined to form one unit of pixels, formed by 16 pixels. As 16 pixels form one unit, the amount of overshoot or undershoot may be adjusted in ¼ gray scale level increments. Since gray scale levels are calculated based on bit calculation, the smallest constitutional unit is preferably formed by a pixel group with $2^n$ pixels horizontally and $2^n$ pixels vertically (n is a natural number).

Figure 24:
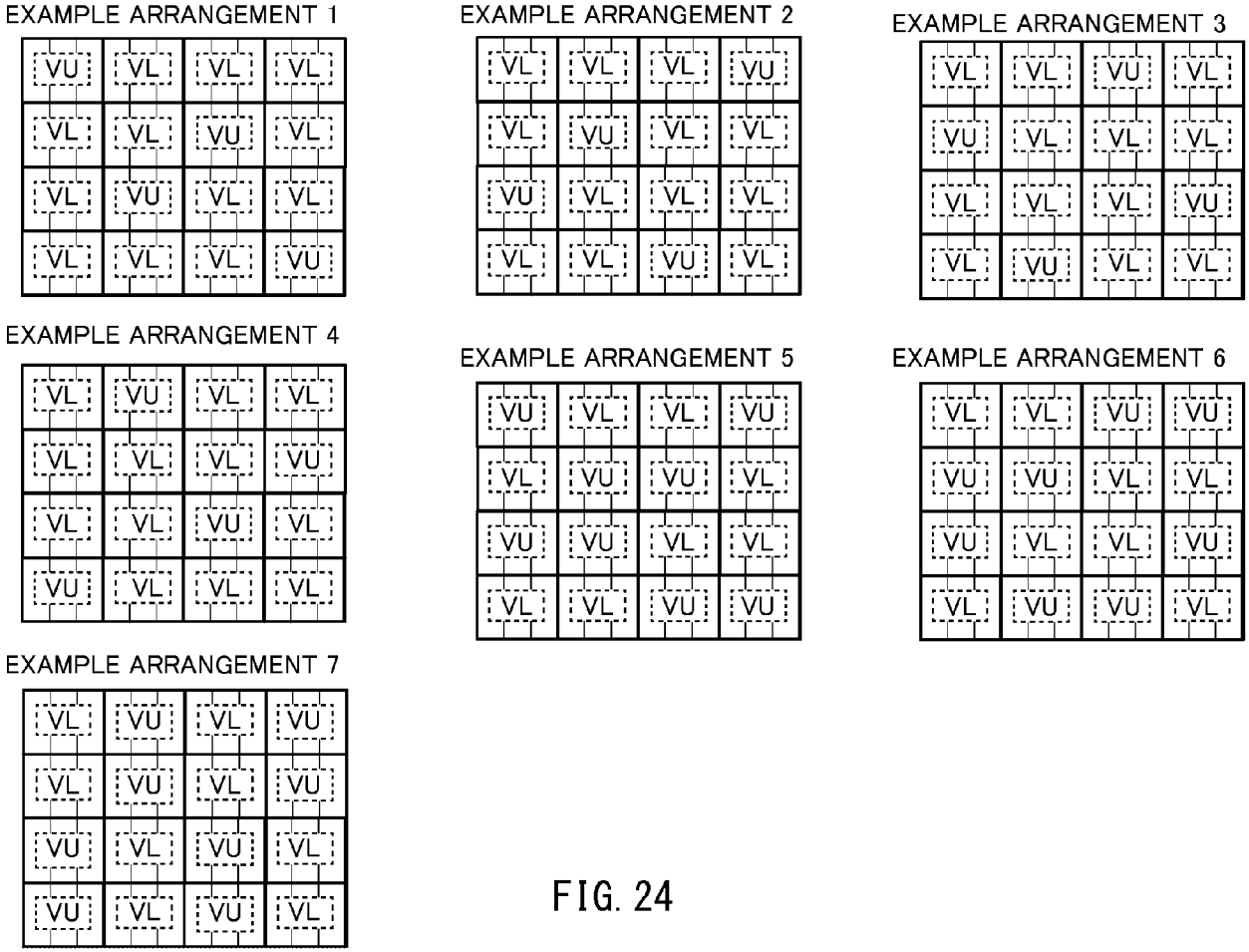
FIG. 24 illustrates other preferred example pixel arrangements in the liquid crystal display device according to another example variation of the present embodiment.

The results from applying example arrangements 1 to 7 shown in FIG. 23 to the pixels P(A) to P(D) shown in FIG. 21 are shown in FIG. 24. In each of the preferred example arrangements shown in FIG. 24, within one unit made of 16 pixels, the pixels P(VL) and P(VU) are disposed such that the four pixels arranged in a given column or row are not of the same one of these two categories.

As the pixels P(VL) and P(VU) are arranged in this manner, flickering is prevented from being aggravated even when a pattern where a flicker can easily occur is displayed.

<1.9.3 Arrangement in Only Part of Display Region>

Figure 25:
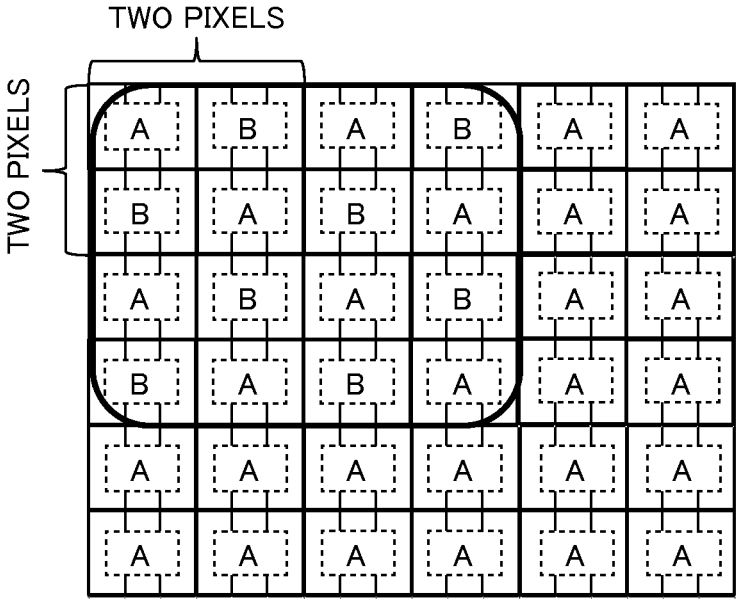
FIG. 25 illustrates another preferred example pixel arrangement in the liquid crystal display device according to an example variation of the present embodiment.

In the present example variation, pixels with different selector outputs $V_{SEL}$ are present in a mixed manner only in part of the display region. FIG. 25 shows a specific example thereof. In the arrangement shown in FIG. 25, the pixels P(A) and P(B) are regularly arranged only in a portion of the display region of the liquid crystal display device 100, i.e. in the region of four pixels horizontally and four pixels vertically toward the top left of the display region. In the other regions, pixels P(A) are provided. In FIG. 25, P(A) denotes a pixel P(0) to which "0" is provided as a selector output, while P(B) denotes a pixel P(1) to which "1" is provided.

The position and size of the region in which the pixels P(A) and P(B) are arranged in a mixed manner can be decided as desired depending on use. For example, if a region for displaying moving images is provided in part of the display region, pixels P(VL) and P(VU) may be arranged regularly only in this region. Alternatively, when an image captured by a camera (i.e. a natural image) and a rendered image are present in one image in a mixed manner, pixels P(VL) and P(VU) may be arranged regularly only in the region for the natural image.

2. Second Embodiment

2.1 Configuration of Liquid Crystal Display Device

A liquid crystal display device 200 according to a second embodiment of the present invention will be described.

Figure 26:
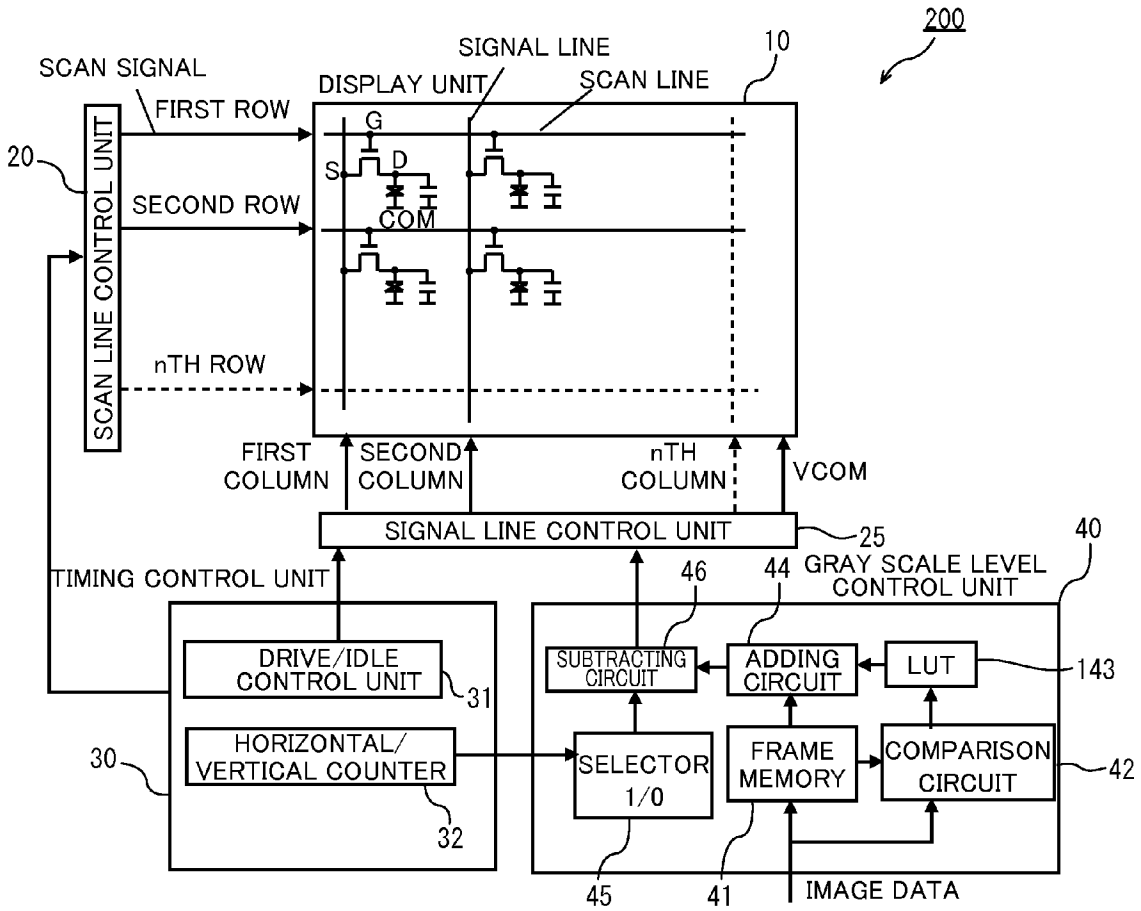
FIG. 26 is a block diagram of a liquid crystal display device according to a second embodiment of the present invention.

FIG. 26 is a block diagram of a liquid crystal display device 200 according to a second embodiment of the present invention. Similar to the liquid crystal display device 100 shown in FIG. 1, the liquid crystal display device 200 shown in FIG. 26 includes a liquid crystal panel 10, a scan line control unit 20, a signal line control unit 25, a timing control unit 30, and a gray scale level control unit 40. Among these components, the gray scale level control unit 40 has a configuration different from that of the gray scale level control unit 40 shown in FIG. 1. In view of this, in FIG. 26, the same components as those shown in FIG. 1 are labeled with the same reference characters as those for the components shown in FIG. 1 and their description will not be provided, and the components that are different will be mainly described. As shown in FIG. 26, in the liquid crystal display device 200, the LUT 43 shown in FIG. 1 is replaced by an LUT 143, discussed below.

FIG. 27 illustrates an example content of the LUT 143 used in the liquid crystal display device 200. As shown in FIG. 27, the LUT 143 stores correction values for emphasizing how an input image signal changes over time, associated only with the combinations of the gray scale values of preceding frames and the gray scale values of current frames that are equal to each other. For example, for the gray scale value of the preceding frame of 32, only the correction value associated with the gray scale value of the current frame of 32 is stored, and no correction value associated with any other gray scale value is stored. Further, the correction values for relatively small gray scale values of preceding frames and current frames are positive, while some correction values for larger values are negative. More specifically, only the correction values for the gray scale values of preceding frames and current frames of 224 and 255 are negative, and otherwise the correction values are positive.

Thus, only when the comparison circuit 42 determines that the gray scale value of a preceding frame is equal to the gray scale value of a current value, it provides a result to the LUT 143. The LUT 143 provides the correction value associated with the gray scale values provided by the comparison circuit 42 to the adding circuit 44. The adding circuit 44 adds the correction value to the gray scale value of the current frame and provides the result to the subtracting circuit 46. The subtracting circuit 46 subtracts, from the signal received from the adding circuit 44, the selector output $V_{SEL}$ supplied depending on the position of a pixel to which writing is to occur, thereby generating a corrected image signal. The corrected image signal is provided to the signal line control unit 25.

When the comparison circuit 42 determines that the gray scale value of the preceding frame is not equal to the gray scale value of the current frame, the comparison circuit 42 provides no result to the LUT 143. Thus, the adding circuit 44 does not correct the gray scale value of the current frame and provides, to the signal line control unit 25, the gray scale value of the current frame as an image signal.

It should be noted that, in the present embodiment, the gray scale value of a preceding frame and the gray scale value of a current frame being equal to each other means that not only the two values are exactly equal to each other, but also that the values are substantially equal to each other. The gray scale values being substantially equal to each other in the present specification may involve the gray scale values listed in the LUT 143 plus or minus 8. For example, for one gray scale value of 32, the other gray scale value may be 24 to 40 in order to be substantially equal to the one gray scale value of 32. For example, if the gray scale value of a preceding frame is 28 and the gray scale value of a current frame is 36, they are substantially equal to each other such that the adding circuit 44 adds, to the gray scale value of the current frame, the correction value in the LUT 143 to be used when the gray scale values of the preceding frame and current frame are 32, i.e. 5.

2.2 Operation During Idled Driving

Figure 28:
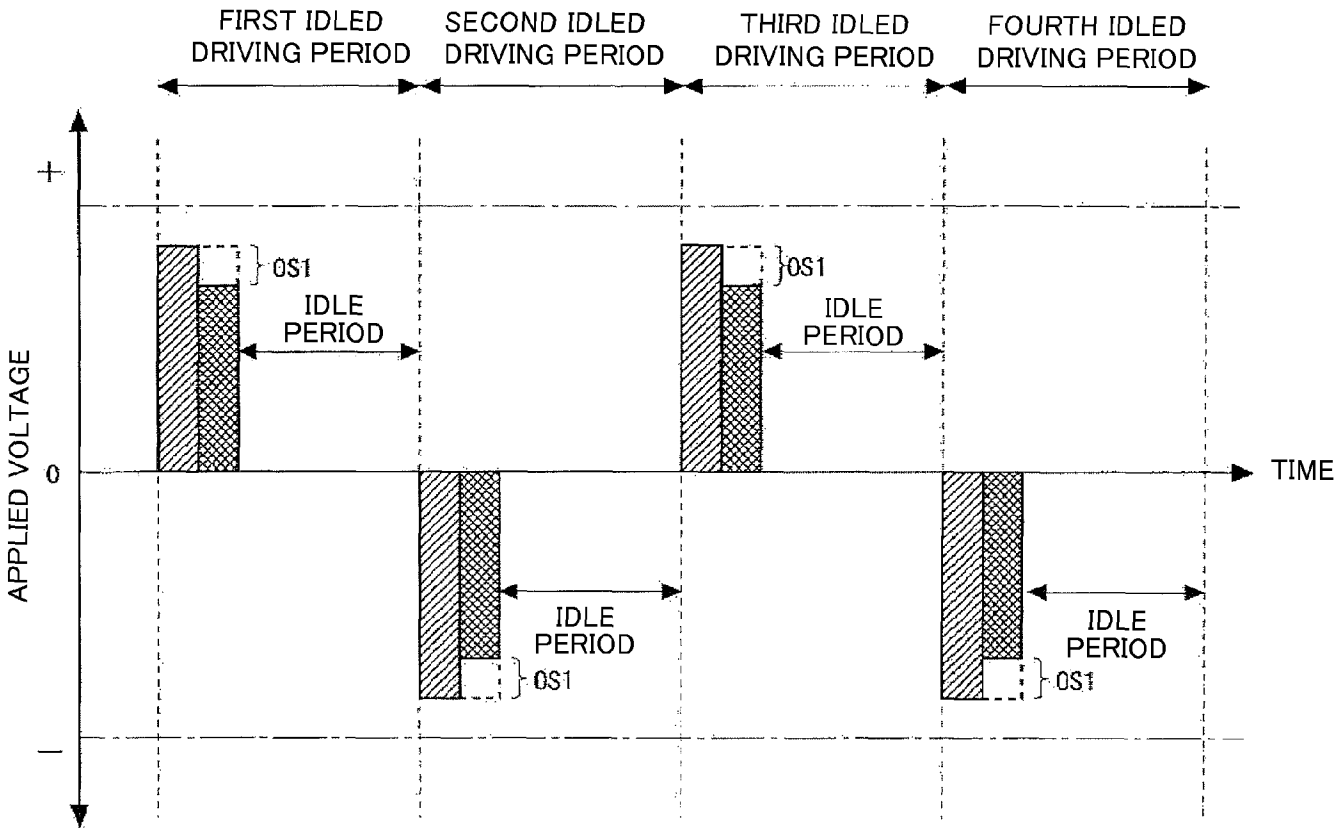
FIG. 28 illustrates idled driving involving overshoot driving in the liquid crystal display device shown in FIG. 26, where the gray scale value of a current frame is equal to the gray scale value of its preceding frame.
Figure 29:
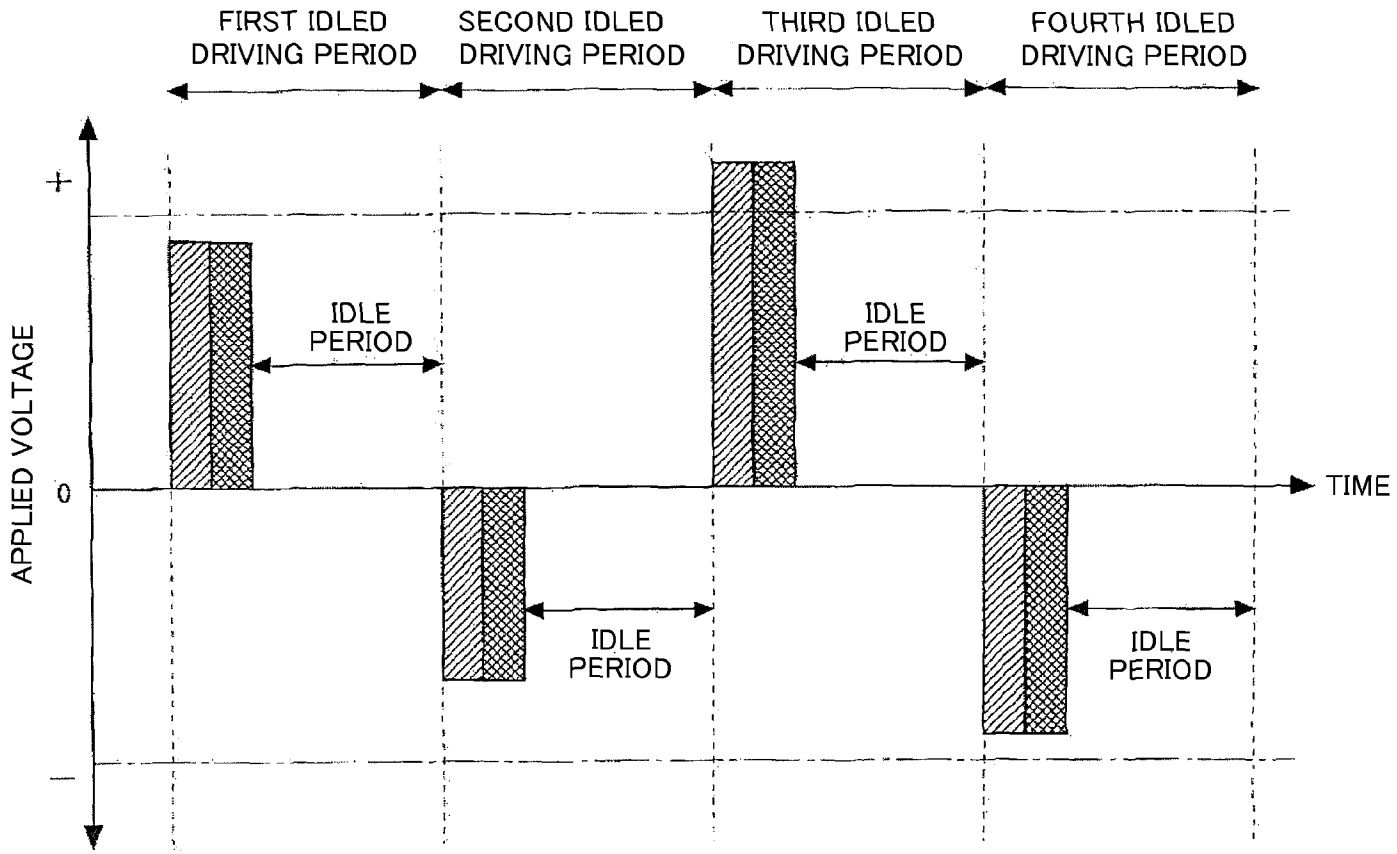
FIG. 29 illustrates idled driving in the liquid crystal display device shown in FIG. 26, where the gray scale value of a current frame is different from the gray scale value of its preceding frame.

FIG. 28 illustrates idled driving involving overshoot driving, where the gray scale value of a current frame is equal to the gray scale value of its preceding frame. FIG. 29 illustrates idled driving, where the gray scale value of a current frame is different from the gray scale value of its preceding frame. The idled driving shown in FIG. 28 is the same as the idled driving illustrated with reference to FIG. 6, and thus will not be described. FIGS. 28 and 29 illustrate the idled driving for the pixels P(0). For the pixels P(1), the manner in which the subtracting circuit 46 subtracts "1" from a corrected image signal for overshoot driving or undershoot driving is the same as that for the first embodiment, and thus will not be described.

As shown in FIG. 29, for any of the idled driving periods, the gray scale value of the current frame is different from the gray scale value of its preceding frame, and thus the adding circuit 44 is not provided with a correction value by the LUT 143. Thus, when the adding circuit 44 receives an input image signal from the frame memory 41, it outputs it without correcting it using a correction value. As a result, neither overshoot driving nor undershoot driving occurs. When neither overshoot driving nor undershoot driving occurs, the subtracting circuit 46 does not perform a subtraction process.

In the second drive frame, too, the adding circuit, when receiving an input image signal from the frame memory 41, it provides it as an image signal to the signal line control unit 25 without correcting it. The image signal is converted to a signal voltage with the voltage value corresponding to the input image signal and is written to signal lines SL. Thus, voltages with the same magnitude are output in the first and second drive frames, which is the same as normal driving occurring twice. Thus, as normal driving occurs twice, a signal voltage is written to signal lines SL, followed by an idle period in which the image written by the normal driving continues to be displayed, which last until the initiation of the first driving period of the next idled driving period.

Then, similarly, in the odd-numbered idled driving periods, normal driving occurs twice consecutively to write a signal voltage of positive polarity with no correction value added to it, followed by an idle period. In the even-numbered idled driving periods, normal driving occurs twice consecutively to write a signal voltage of negative polarity with no correction value added to it, followed by an idle period.

2.3 Effects

A flicker can be easily recognized when the same image is displayed consecutively. In view of this, in the present embodiment, overshoot driving or undershoot driving is provided only when images with substantially the same gray scale value are displayed consecutively, followed by normal driving. Thus, the viewer can hardly recognize flickers.

If images with substantially different gray scale values are displayed consecutively, even when a flicker is produced due to a decrease in luminance, the viewer can hardly recognize the flicker. In view of this, neither overshoot driving nor undershoot driving occurs, and normal driving occurs twice. This makes it possible to reduce the memory capacity of the LUT 143, thereby reducing the cost of the liquid crystal display device 200.

If the response speed of the liquid crystal is high, when the gray scale value of a preceding frame is different from the gray scale value of a current frame, instead of providing consecutive first and second drive frames or providing consecutive third or fourth drive frames, only a first drive frame may be provided followed by an idle period without a second drive frame, or only a third drive frame may be provided followed by an idle period without a fourth drive frame. In these cases, no second or fourth drive frame is provided, thereby reducing the power consumption of the liquid crystal display device.

2.4 First Example Variation

Figure 30:
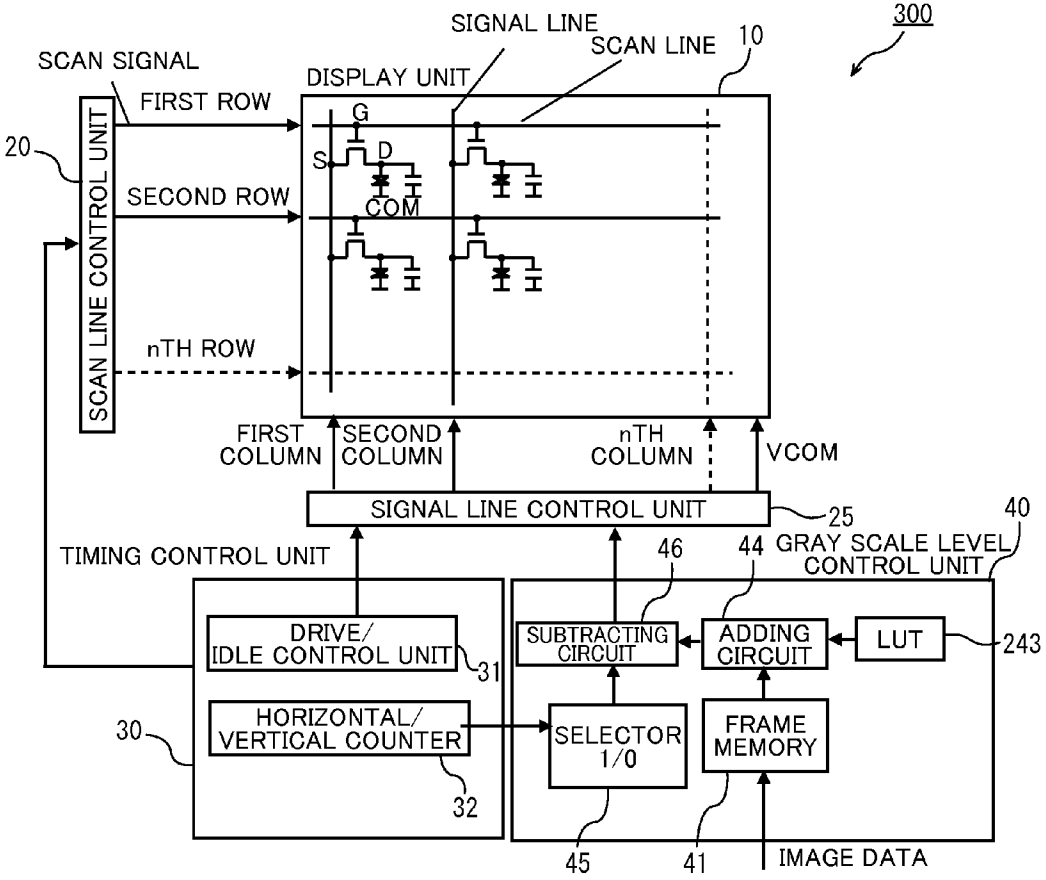
FIG. 30 is a block diagram of a liquid crystal display device according to a first example variation of the liquid crystal display device shown in FIG. 26.

FIG. 30 is a block diagram of a liquid crystal display device 300 according to a first example variation of the present embodiment. Similar to the liquid crystal display device 100 shown in FIG. 1, the liquid crystal display device 300 shown in FIG. 30 includes a liquid crystal panel 10, a scan line control unit 20, a signal line control unit 25, a timing control unit 30, and a gray scale level control unit 40. Among these components, the gray scale level control unit 40 has a configuration different from that of the gray scale level control unit 40 shown in FIG. 1. In view of this, in FIG. 30, the same components as those shown in FIG. 1 are labeled with the same reference characters as those for the components shown in FIG. 1 and their description will not be provided, and the components that are different will be mainly described.

As shown in FIG. 30, the gray scale level control unit 40 includes a frame memory 41, an adding circuit 44 and an LUT 243, however, it includes no comparison circuit. No comparison circuit is provided in the present embodiment because there is no need to determine whether the gray scale value of a preceding frame is equal to the gray scale value of a current frame. FIG. 31 illustrates an example content of the LUT 243 used in the present example variation. The LUT 243 is different from the LUT 43 shown in FIG. 3 in that it only stores correction values associated with the gray scale values of current frames. Thus, a correction value is decided on only depending on the gray scale value of a current frame, regardless of the gray scale value of its preceding value. In the LUT 243, too, the correction values for gray scale values of current frames that are not more than 160 are positive; the correction value for gray scale level 192 is zero; and the correction values for gray scale levels 224 and higher are negative.

Thus, unlike in the second embodiment, when the correction value associated with the gray scale value of a current frame is positive, the adding circuit 44 adds the correction value to the gray scale value of the current frame to generate a corrected image signal regardless of the gray scale value of a preceding frame, and provides it to the subtracting circuit 46. Thus, overshoot driving occurs. If the correction value associated with the gray scale value of a current frame is negative, the adding circuit does subtraction based on the correction value to generate a corrected image signal, and provides it to the subtracting circuit 46. Thus, undershoot driving occurs. If the correction value is zero, the adding circuit provides an input image signal to the subtracting circuit 46 without correcting it. The process in the subtracting circuit 46 is the same as that for the first embodiment, and thus will not be described.

<2.4.1 Operation of Idle Driving>

Figure 32:
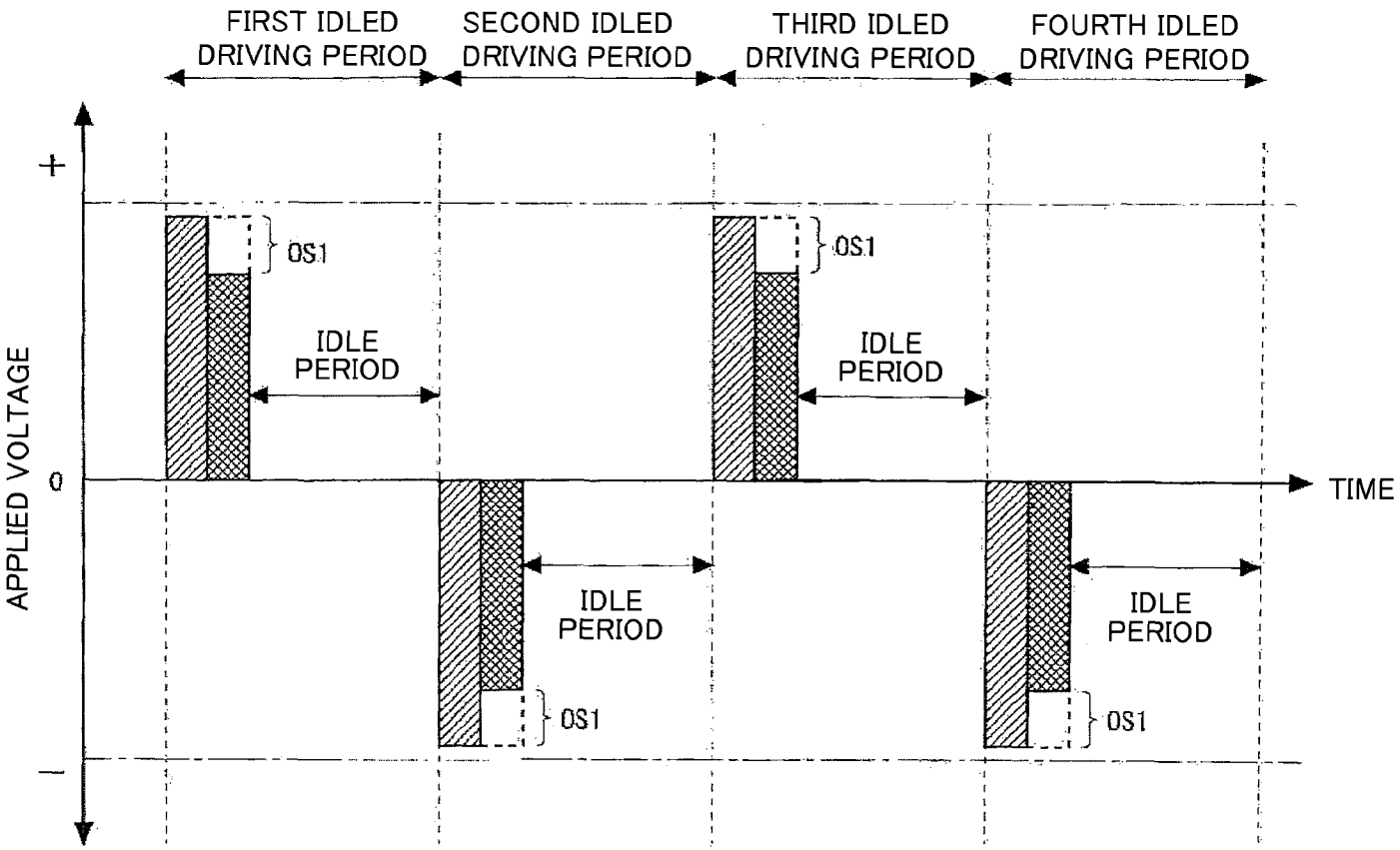
FIG. 32 illustrates idled driving involving overshoot driving in the liquid crystal display device shown in FIG. 30, where the gray scale value of a current frame is equal to the gray scale value of its preceding frame.
Figure 33:
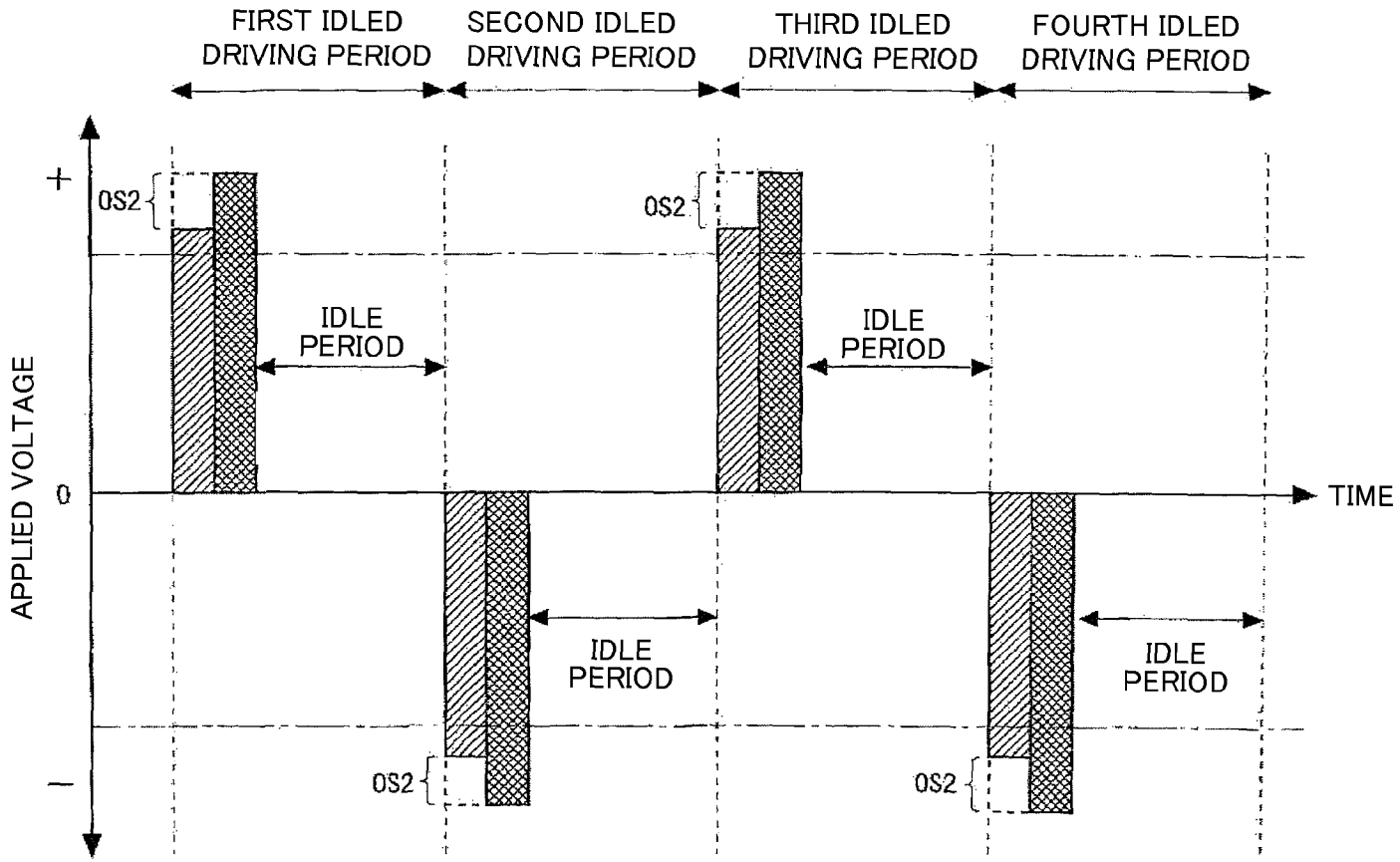
FIG. 33 illustrates idled driving involving undershoot driving in the liquid crystal display device shown in FIG. 30, where the gray scale value of a current frame is equal to the gray scale value of its preceding frame.
Figure 34:
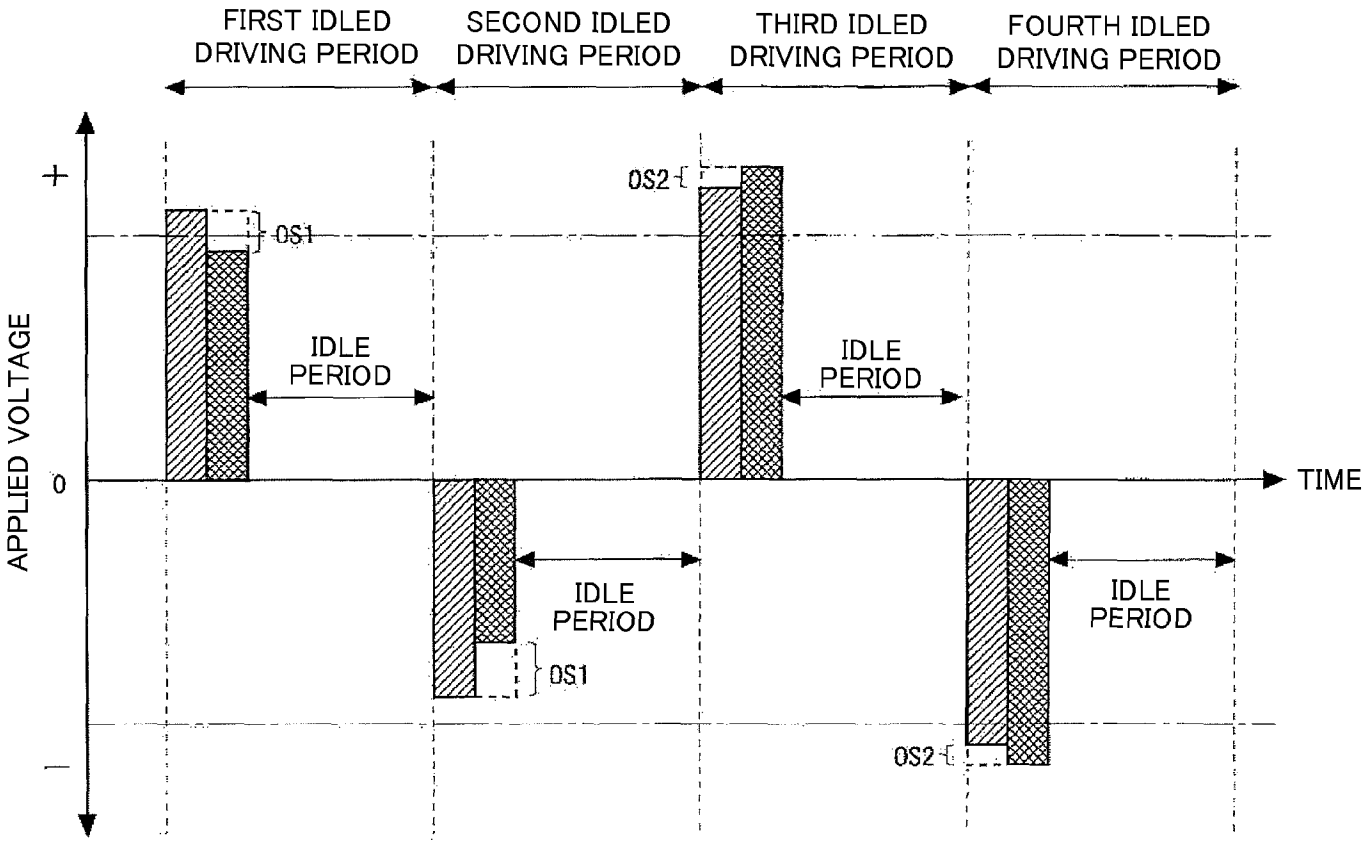
FIG. 34 illustrates idled driving in the liquid crystal display device shown in FIG. 30, where the gray scale value of a current frame is different from the gray scale value of its preceding frame.

FIG. 32 illustrates idled driving involving overshoot driving where the gray scale value of a current frame is equal to the gray scale value of its preceding frame, and FIG. 33 illustrates idled driving involving undershoot driving where the gray scale value of a current frame is equal to the gray scale value of its preceding frame. FIG. 34 illustrates idled driving where the gray scale value of a current frame is different from the gray scale value of its preceding frame. FIGS. 32 to 34 illustrate idled driving for the pixels P(0). For the pixels P(1), the manner in which the subtracting circuit 46 subtracts "1" to determine a corrected image signal for overshoot driving or undershoot driving is the same as that for the first embodiment, and thus will not be described.

In the example shown in FIG. 32, a first and second drive frames are provided as consecutive ones in the driving period of the first idled driving period. In the first drive frame, the gray scale value of the input image signal (i.e. gray scale value of the current frame) is smaller than the relevant boundary value; thus, when the adding circuit 44 has received from the LUT 243 the correction value associated with the gray scale value of the current frame provided by the frame memory 41, it adds the correction value to the gray scale value of the current frame to generate a corrected image signal, and provides it to the subtracting circuit 46. The corrected image signal provided by the subtracting circuit 46 is converted to an overshoot voltage, and is written to signal lines SL. The polarity of this analog signal value is positive. Thus, overshoot driving occurs.

In the second drive frame, the same signal as the input image signal used in the first drive frame is stored in the frame memory 41. When the frame memory 41 provides the input image signal to the adding circuit 44, the adding circuit 44 provides it to the subtracting circuit 46 as an image signal without adding a correction value to it. For the pixels P(0), the subtracting circuit 46 does not perform a subtraction process, and the image signal is converted to the signal voltage corresponding to the input image signal, and is written to signal lines SL. The polarity of this analog signal voltage is also positive. Thus, normal driving occurs.

Thus, in the first drive frame, a correction value provided by the LUT 243 is used to perform overshoot driving, and, in the second drive frame, normal driving is performed to write a signal voltage of positive polarity to signal lines SL.

This is followed by an idle period in which the image written by the normal driving continues to be displayed, which lasts until the initiation of the first driving period of the second idled driving period.

In the driving period of the second idled driving period, too, a first and second drive frames are provided as consecutive ones. Here, similar to the operation for the first idled driving period, overshoot driving is performed in the first drive frame based on the corrected image signal obtained by adding a correction value provided by the LUT 243 to the gray scale value of a current frame, and normal driving occurs in the second drive frame. In each of these drive frames, a voltage of negative polarity is written. This followed by an idle period in which the image written by the normal driving continues to be described, which lasts until the initiation of the first driving period of the third idled driving period.

Then, similarly, in the odd-numbered idled driving periods, an overshoot voltage of positive polarity is written to perform overshoot driving. Next, a signal voltage of positive polarity is written to perform normal driving, followed by an idle period. In the even-numbered idled driving periods, an overshoot voltage of negative polarity is written to perform overshoot driving. Next, a signal voltage of negative polarity is written to perform normal driving, followed by an idle period.

In the example shown in FIG. 33, in the driving period of the first idled driving period, a third and fourth drive frames are provided as consecutive ones. The gray scale value of the input image signal (i.e. gray scale value of the current frame) is greater than the relevant boundary value; thus, in the third drive frame, when the adding circuit 44 has received from the LUT 243 the correction value corresponding to the gray scale value of the current frame provided by the frame memory 41, it does subtraction from the gray scale value of the current frame based on the correction value to generate a corrected image signal, and provides it to the subtracting circuit 46. The corrected image signal provided by the subtracting circuit 46 is converted to an undershoot voltage, which is written to signal lines SL. The polarity of this analog signal voltage is positive. Thus, undershoot driving occurs.

In the fourth drive frame, the same signal as the input image signal used in the third drive frame is stored in the frame memory 41. When the frame memory 41 provides the input image signal to the adding circuit 44, the adding circuit 44 provides it as an image signal to the subtracting circuit 46 without doing subtraction based on a correction value. The image signal provided by the subtracting circuit 46 is converted to the signal voltage corresponding to the input image signal, which is written to signal lines SL. The polarity of this analog signal voltage is also positive. Thus, normal driving occurs.

Thus, in the third drive frame, a correction value provided by the LUT 243 is used to perform undershoot driving, and, in the fourth drive frame, normal driving occurs to write a signal voltage of positive polarity to signal lines SL. This is followed by an idle period in which the image written by the normal driving continues to be displayed, which lasts until the initiation of the first driving period of the second idled driving period.

In the driving period of the second idled driving period, too, a third and fourth drive frames are provided as consecutive ones. In the third drive frame, the gray scale value of the current frame is not smaller than the relevant boundary value. In view of this, undershoot driving is performed based on the corrected image signal obtained by subtraction from the gray scale value of the current frame based on the correction value provided by the LUT 243, and normal driving occurs in the fourth drive frame. In each of these drive frames, a voltage of negative polarity is written. This is followed by an idle period in which the image written by the normal driving continues to be displayed until the initiation of the first driving period of the third idled driving period.

Then, similarly, in the odd-numbered idled driving periods, an undershoot voltage of positive polarity is written to perform undershoot driving. Next, a signal voltage of positive polarity is written to perform normal driving, followed by an idle period. In the even-numbered idled driving periods, an undershoot voltage of negative polarity is written to perform undershoot driving. Next, a signal voltage of negative polarity is written to perform normal driving, followed by an idle period.

Since the LUT 243 is used in the example shown in FIG. 34, it depends on the gray scale value of the current frame whether overshoot driving or undershoot driving occurs. Thus, in each idled driving period, overshoot driving occurs if the gray scale value of the current frame is smaller than the relevant boundary value, and undershoot driving occurs if the gray scale value of the current frame is greater than the relevant boundary value. More specifically, overshoot driving occurs in the first and second idled driving period, and undershoot driving occurs in the third and fourth idled driving periods.

Thus, in the present example variation, overshoot driving or undershoot driving occurs only depending on the gray scale value of a current frame, regardless of whether the gray scale value of the current frame is equal to the gray scale value of its preceding frame. Thus, unlike the second embodiment, the present example variation must perform normal driving in the second and fourth drive frames, i.e. the driving in the second and fourth drive frames cannot be omitted.

<2.4.2 Effects>

The present example variation not only has the same effects as those of the second embodiment, but also eliminates the necessity to determine whether the gray scale value of a current frame is equal to the gray scale value of its preceding frame, which means that there is no need to provide a comparison circuit. This further reduces the cost of manufacturing the liquid crystal display device 300.

2.5 Second Example Variation

In the first example variation, the correction amounts stored in the LUT 243 that are used when the input image signal changes from positive to negative in polarity are the same as those used when the signal changes from negative to positive in polarity.

If the dielectric anisotropy of liquid crystal varies depending on the direction of a voltage applied to the liquid crystal layer such that liquid crystal molecules can be easily oriented in some directions and no so easily in others, the response speed of the liquid crystal varies depending on the direction of a voltage applied. In such cases, the overshoot voltage and undershoot voltage must be changed depending on the direction of the voltage applied even when the gray scale value of a current frame is equal to the gray scale value of its preceding frame. In view of this, the gray scale level control unit of the liquid crystal display device has an LUT for storing correction values used when a voltage in a certain direction is applied (also referred to as "first table"), and an LUT for storing correction values used for the opposite direction (also referred to as "second table"). In the present embodiment, the contents of the LUTs will not be illustrated.

In this example variation, too, for the pixels P(1), the manner in which the subtracting circuit 46 subtracts "1" provided as a selector output $V_{SEL}$ is the same as in the first embodiment, and thus will not be described in detail.

Figure 35:
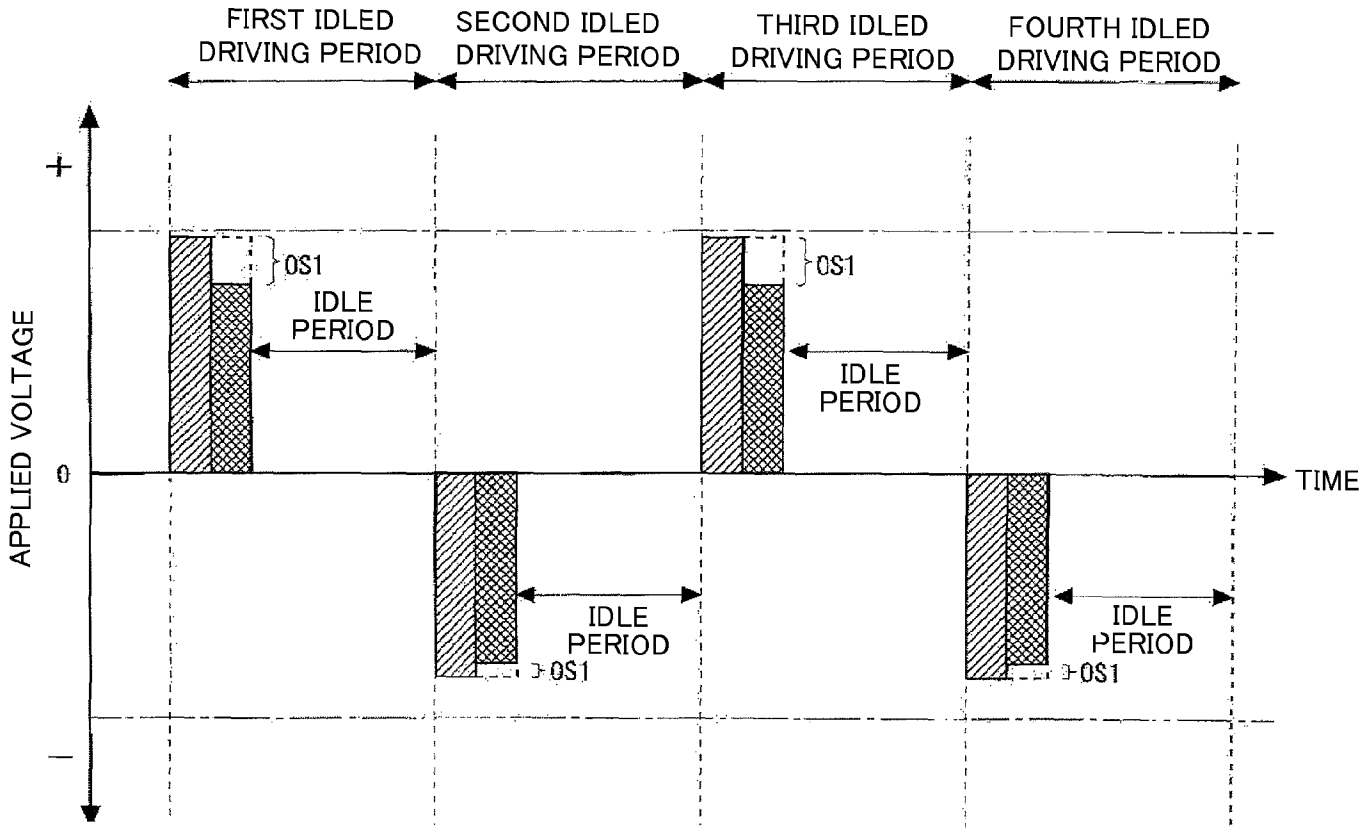
FIG. 35 illustrates idled driving involving overshoot driving in a second variation of the liquid crystal display device shown in FIG. 26, where the gray scale value of a current frame is equal to the gray scale value of its preceding frame.
Figure 36:
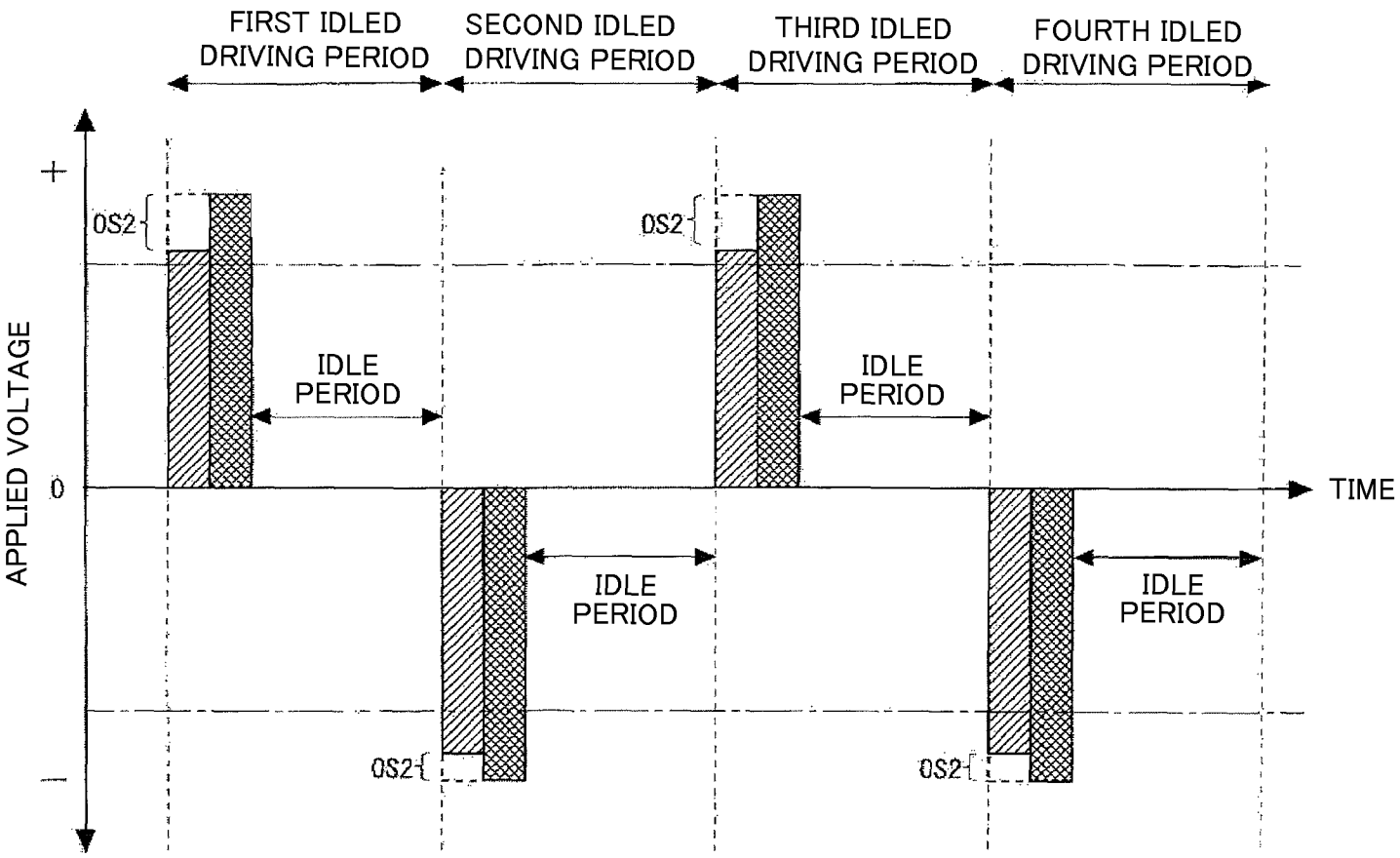
FIG. 36 illustrates idled driving involving overshoot driving in the second variation of the liquid crystal display device shown in FIG. 26, where the gray scale value of a current frame is equal to the gray scale value of its preceding frame.

FIG. 35 illustrates idled driving involving overshoot driving where the gray scale value of a current frame is equal to the gray scale value of its preceding frame, and FIG. 36 illustrates idled driving involving undershoot driving where the gray scale value of a current frame is equal to the gray scale value of its preceding frame. As shown in FIG. 35, even when the gray scale values of a preceding frame and current frame are equal to each other, the overshoot voltage used when the input image signal changes from positive to negative in polarity is different from that used when the signal changes from negative to positive in polarity, where the absolute value of the overshoot voltage used when the signal changes from negative to positive in polarity is greater than the absolute value of the voltage used when the opposite is the case. Such overshoot driving is performed by making the absolute values of correction values in the LUT used when the signal changes from negative to positive in polarity greater than the absolute values of the correction values in the LUT used when the signal changes from positive to negative in polarity even when the gray scale values of a preceding frame and current frame are the same.

Similarly, as shown in FIG. 36, even when the gray scale values of a preceding frame and current frame are equal to each other, the undershoot voltage used when the input image signal changes from positive to negative in polarity is different from that used when the signal changes from negative to positive in polarity, where the absolute value of the undershoot voltage used when the signal changes from negative to positive in polarity is greater than the absolute value of the voltage used when the opposite is the case. Such undershoot driving is performed by making the absolute values of correction values in the LUT used when the signal changes from negative to positive in polarity greater than the absolute values of the correction values in the LUT used when the signal changes from positive to negative in polarity.

Thus, even if the response speed of the liquid crystal encountered when the voltage applied to the liquid crystal layer changes from positive to negative in polarity is different from that encountered when the voltage changes from negative to positive in polarity, the correction value may be changed depending on the direction of the voltage applied to reduce the changes in luminance depending on the direction of the voltage applied to a similar level. Thus, the viewer can hardly recognize flickers.

The present example variation may not only be used when the gray scale value of a preceding frame and the gray scale value of a current frame are equal to each other, but also when they are different from each other. Further, the device may also be driven in the same manner as that for the present example variation when the amounts of voltage correction values OS1 and OS2 used when the signal changes from positive to negative in polarity are greater than the amounts of voltage correction values OS1 and OS2 used when the signal changes in the opposite way.

3. Third Embodiment

When the dielectric anisotropy of liquid crystal changes due to changes in the temperature around the liquid crystal display device, the response speed of the liquid crystal display device changes significantly. Thus, when the LUT storing correction values set for room temperature is used to perform overshoot driving or undershoot driving at a lower temperature, the decreased response speed of the liquid crystal due to the lower temperature means an insufficient response speed, meaning that a desired gray scale level is not produced. If overshoot driving or undershoot driving is performed at a higher temperature, the increased response speed of the liquid crystal due to the higher temperature results in an excessively emphasized image. In view of this, a liquid crystal display device used in a wide temperature range preferably has different LUTs for different temperature ranges such that the optimum correction value that depends on a given temperature is added to perform optimized overshoot driving.

3.1 Configuration of Liquid Crystal Display Device

Figure 37:
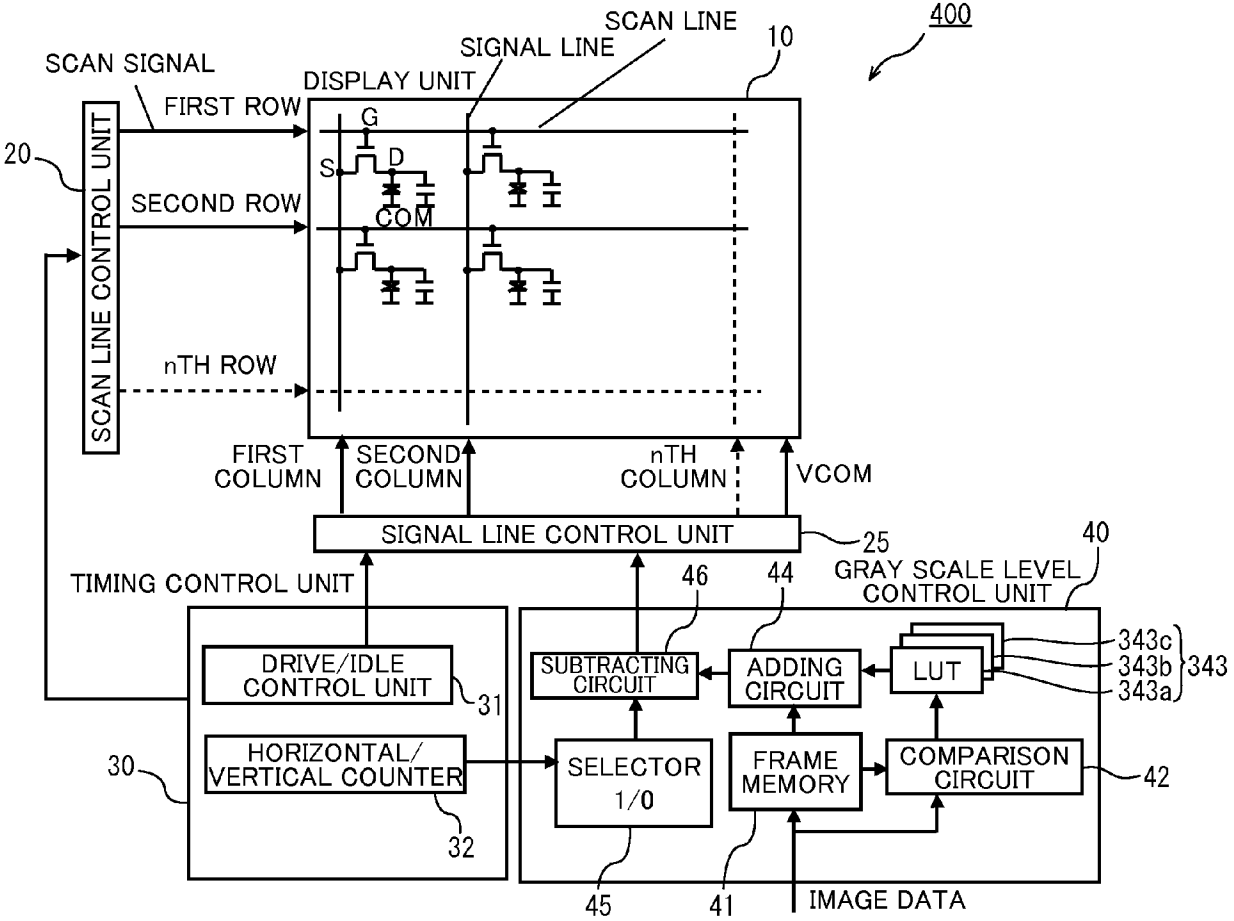
FIG. 37 is a block diagram of a liquid crystal display device according to a third embodiment of the present invention.
Figure 41:
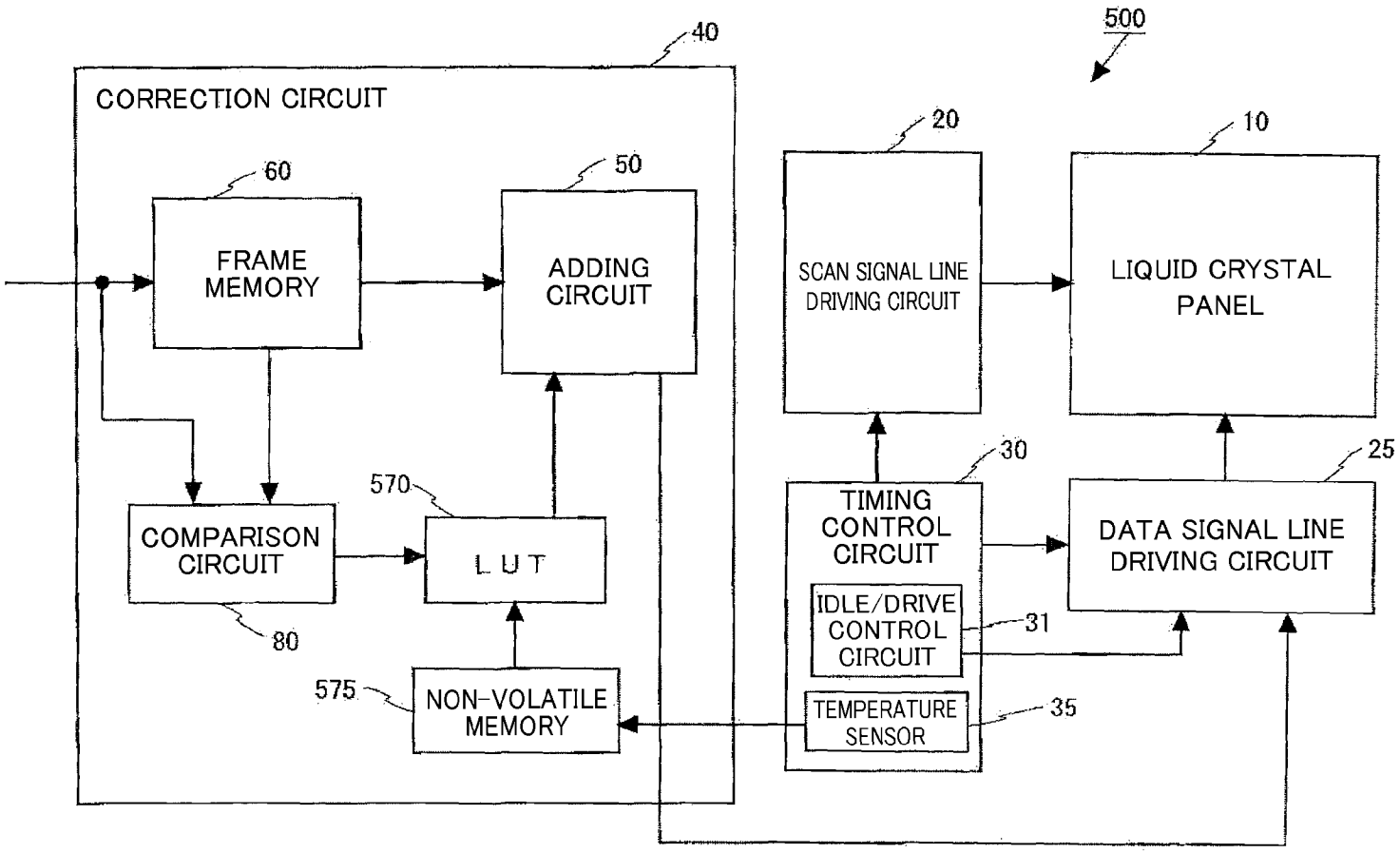
FIG. 41 is a block diagram of a liquid crystal display device according to a first variation of the third embodiment.
Figure 42:
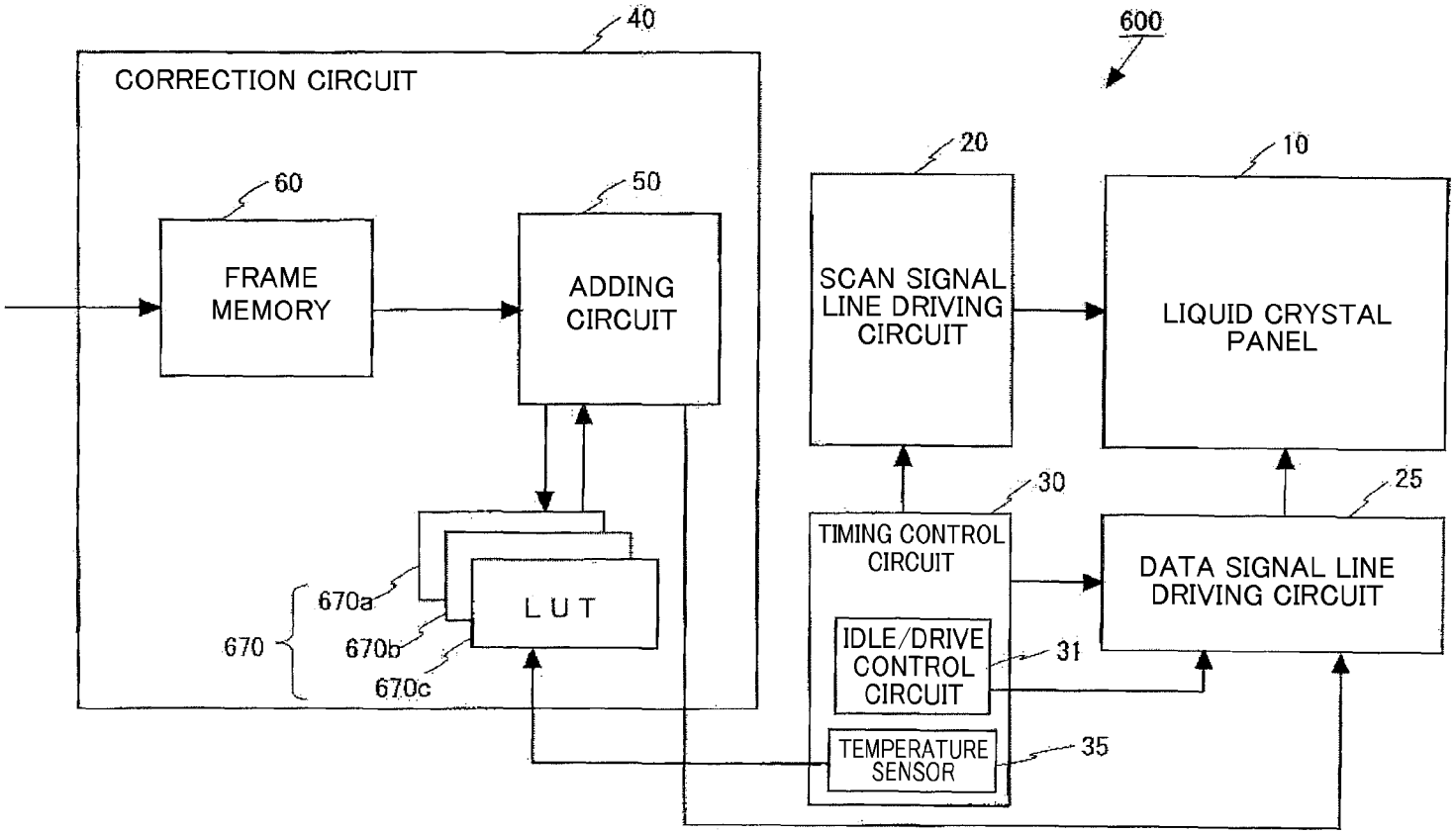
FIG. 42 is a block diagram of a liquid crystal display device according to the third embodiment where the comparison circuit has been eliminated.
Figure 43:
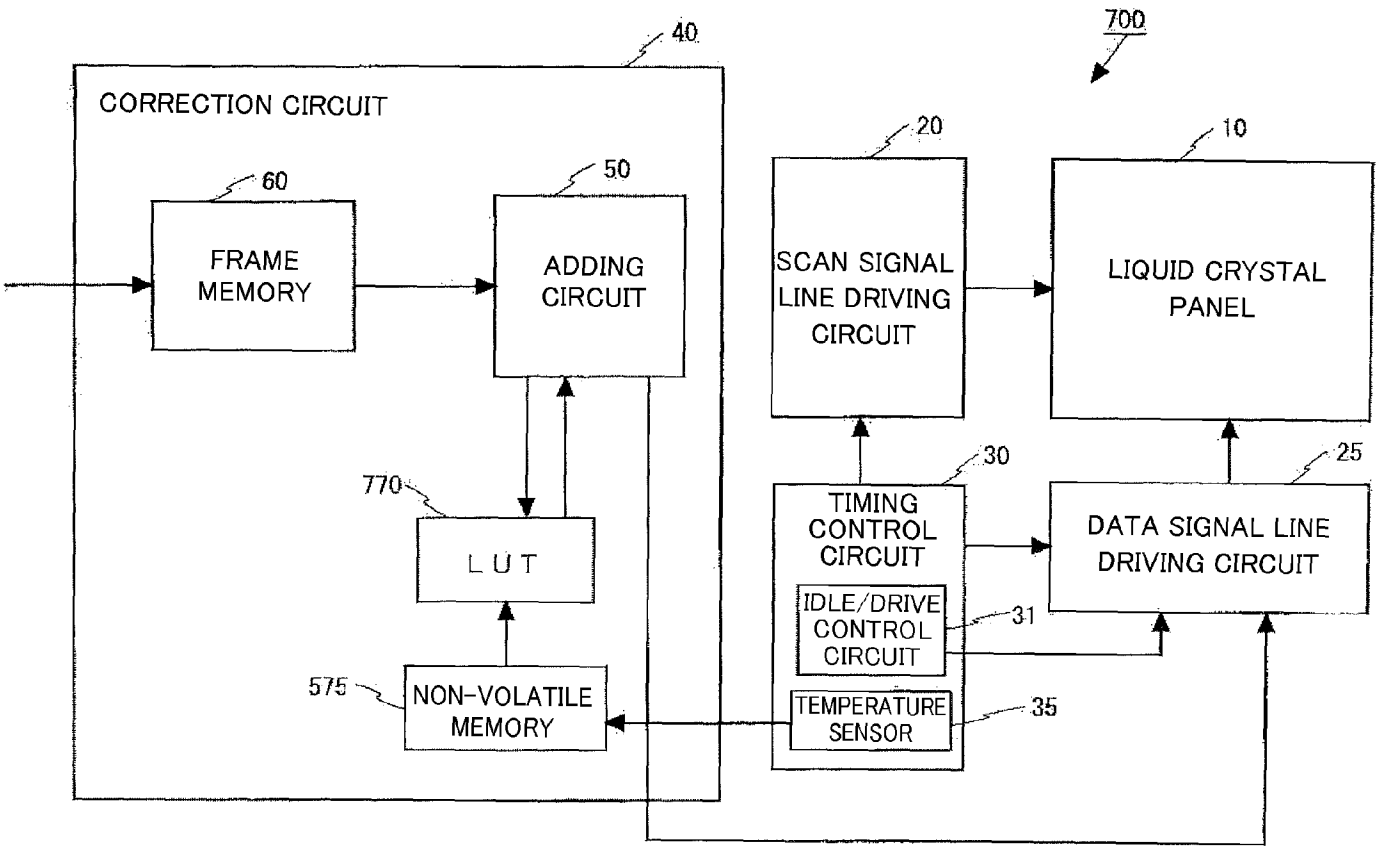
FIG. 43 is a block diagram of a liquid crystal display device according to the first variation of the third embodiment where the comparison circuit has been eliminated.
Figure 44:
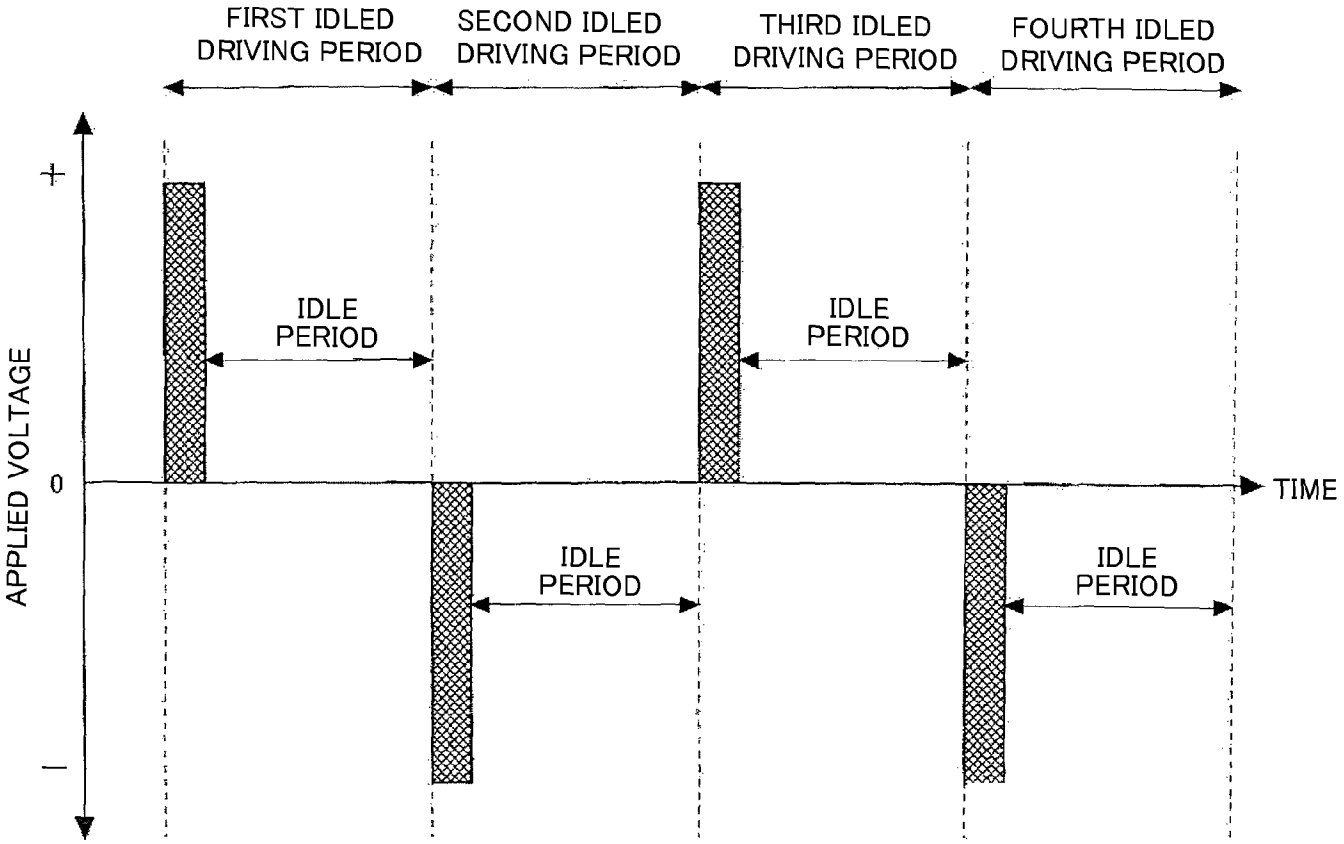
FIG. 44 illustrates how idled driving is performed by conventional AC driving.

FIG. 37 is a block diagram of a liquid crystal display device 400 according to a third embodiment of the present invention. The liquid crystal display device 400 shown in FIG. 37 is different from the liquid crystal display device 100 shown in FIG. 1 in that a temperature sensor 35 is provided inside the timing control unit 30 and the gray scale level control unit 40 has three LUTs 343*a* to 343*c* provided for different temperature ranges. In FIG. 37, the same components as those shown in FIG. 1 are labeled with the same reference characters as those for the components shown in FIG. 1 and their description will not be provided, and the components that are different will be mainly described.

FIG. 38 illustrates an LUT 343*a* for room temperature used in the liquid crystal display device 400, FIG. 39 illustrates an LUT 343*b* for high temperature, and FIG. 40 illustrates an LUT 343*c* for low temperature. As can be understood from FIGS. 38 to 40, the absolute values of the correction values in the LUT 343*a* for room temperature are smaller than those in the LUT 343*c* for low temperature, and those in the LUT 343*b* for high temperature are smaller than those in the LUT 343*a* for room temperature. As such, the use of these LUTs 343*a* to 343*c* emphasizes overshoot driving and undershoot driving at lower temperatures at which the response speed of the liquid crystal decreases, and emphasizes overshoot and undershoot at room temperature to a lower degree. Overshoot driving and undershoot driving at higher temperatures are suppressed.

Thus, different LUTs 343 are used depending on the temperature in which the liquid crystal display device 400 is used, which requires the temperature sensor 35 for acquiring temperature information. In the present embodiment, the temperature sensor 35 is provided inside the timing control unit 30, and one of the LUTs 343*a* to 343*c* is selected based on the temperature information from the temperature sensor 35. When one of the LUTs 343*a* to 343*c* has been selected, correction values stored in the selected LUT are used to perform overshoot driving or undershoot driving, in a manner similar to that of one of the above embodiments.

In the present embodiment, the LUT 343*a* for room temperature is used at temperatures of not less than 10° C. and less than 40° C., the LUT 343*b* for high temperature is used at temperatures not less than 40° C., and the LUT 343*c* for low temperature is used at temperatures less than 10° C.; however, the temperature range in which these tables are used may be adjusted as appropriate. Further, the number of LUTs 343 is not limited to three, and may be two or four or more depending on the temperature range in which the liquid crystal display device 400 is used.

In FIG. 37, the temperature sensor 35 is provided inside the timing control unit 30; alternatively, it may be provided separately from the timing control unit 30 on the liquid crystal panel 10. In this case, the timing control unit 30 obtains temperature information from the temperature sensor 35 via serial communication, and selects one of the LUTs 343*a* to 343*c* depending on the temperature information. If the temperature sensor 35 is provided on the insulating substrate and provides the timing control unit 30 with temperature information via serial communication, the temperature sensor 35 may be provided at any location on the insulating substrate. If the temperature sensor 35 is provided inside the timing control unit 30, the circuit configuration of the timing control unit 30 is not made more complex. This means lower cost of manufacturing the liquid crystal display device 400.

3.2 Effects

In the present embodiment, one of the LUTs 343*a* to 343*c* is selected depending on the temperature around the liquid crystal display device 400 measured by the temperature sensor 35 to perform overshoot driving or undershoot driving, achieving optimized overshoot driving or undershoot driving regardless of temperature. This reduces the decrease in luminance during writing of signal voltages in a liquid crystal display device 400 used in a wide temperature range, and thus the viewer can hardly recognize flickers.

3.3 Example Variations

An example variation of the liquid crystal display device 400 may have a non-volatile memory that stores data of correction values for room temperature, high temperature and low temperature in advance, where appropriate correction data may be read based on temperature information from the temperature sensor 35 and then used. Thus, in a manner similar to that for the liquid crystal display device 400, the correction value associated with the gray scale value of a preceding frame and the gray scale value of a current frame is provided to the adding circuit 44. This will reduce the number of LUTs, thereby reducing the cost of manufacturing the liquid crystal display device 400.

Further, the comparison circuit may be eliminated from the liquid crystal display device 400. In this case, the LUTs 343*a* to 343*c* only stores correction values for the gray scale values of current frames for their respective temperature ranges. Thus, the correction value only depends on the gray scale value of a current frame, regardless of the gray scale value of its preceding frame. As such, the adding circuit 44 adds a correction value stored in the one of the LUTs 343*a* to 343*c* that has been selected based on the temperature to all the gray scale values of current frames regardless of the gray scale values of preceding frames, thereby generating a corrected image signal.

In the above example variation without the comparison circuit, the non-volatile memory may further store three types of correction values corresponding to the temperature ranges, where, based on the temperature information provided by the temperature sensor 35, the associated set of correction values may be read and used.

These example variations will further simplify the configuration of the liquid crystal display device 400, thereby further reducing the cost of manufacturing it.

4. Others

In the above description, the liquid crystal display devices according to the embodiments and their example variations are driven by dot reverse driving. However, the present invention may be applied to devices driven by not only dot reverse driving, but also various AC driving techniques such as line reverse driving, column reverse driving and frame reverse driving, which will have the same effects as those of dot reverse driving.

EXPLANATION OF REFERENCE CHARACTERS

10 liquid crystal panel
15 pixel-forming units
16 thin-film transistors (TFTs)
17 pixel electrodes
18 common electrode
20 scan line control unit
25 signal line control unit
30 timing control unit
35 temperature sensor
40 gray scale level control unit
41 frame memory
42 comparison circuit
43 lookup table (LUT)
44 adding circuit
45 selector
46 subtracting circuit
100 liquid crystal display device

The invention claimed is:

1. A liquid crystal display device that performs intermittent driving involving a driving period and an idle period, the liquid crystal display device comprising:

a plurality of scan lines;

a plurality of signal lines crossing the plurality of scan lines;

a pixel-forming unit provided at the intersection of each of the plurality of scan lines and each of the plurality of signal lines;

a scan line control unit that scans the plurality of scan lines by selecting one after another of the scan lines;

a gray scale level control unit that generates, from an input image signal, an image signal for display and an image signal for correction; and a signal line control unit that writes the image signal for correction to the plurality of signal lines before writing the image signal for display during a driving period, wherein the gray scale level control unit includes:

a correction value storage unit that stores a correction gray scale value associated with a gray scale value of at least a current frame of the input image signal;

a first correction circuit that corrects the input image signal based on the correction gray scale value read from the correction value storage unit; and a second correction circuit that specifies, in a pixel region including the pixel-forming unit, a regular pixel pattern including at least a first pixel and a second pixel and changes an output from the first correction circuit for the first pixel by a predetermined gray scale width; and when the image signal for display is at a predetermined gray scale level, the regular pixel pattern is only composed of second pixels, and, when the image signal for display is at a gray scale level other than the predetermined gray scale level, the regular pixel pattern is composed of first and second pixels.

2. The liquid crystal display device according to claim 1, wherein the regular pixel pattern includes a total of 4 pixels with two pixels horizontally and two pixels vertically, and two of the four pixels are the first pixels.

3. The liquid crystal display device according to claim 2, wherein the first pixels are two of the four pixels that are disposed diagonally.

4. The liquid crystal display device according to claim 1, wherein, within the driving period, the length of a period in which the pixel signal for display is written is equal to the length of a period in which the image signal for correction is written.

5. The liquid crystal display device according to claim 4, wherein, within the driving period, the length of a period in which the image signal for display is written and the length of a period in which the image signal for correction is written are equal to the time that corresponds to one frame.

6. The liquid crystal display device according to claim 1, wherein the gray scale level control unit further includes a frame memory for storing the input image signal on a frame-by-frame basis, the correction value storage unit provides a correction gray scale value associated with a gray scale value of a current frame of the input image signal to the first correction circuit, and when the image signal for correction is to be written, the first correction circuit corrects a gray scale value of the input image signal with the correction gray scale value and outputs it and, when the image signal for display is to be output, the first correction circuit outputs the gray scale value of the input image signal without correcting it.

7. The liquid crystal display device according to claim 6, wherein the first correction circuit further includes a comparison circuit that provides to the correction value storage unit the gray scale value of the current frame of the input image signal and a gray scale value of a preceding frame stored in the frame memory, and the correction value storage unit stores a correction value associated with a combination of the gray scale value of the current frame and the gray scale value of the preceding frame of the input image signal and, when receiving from the comparison circuit a gray scale value of a current frame and a gray scale value of a preceding frame of the input image signal, provides a correction value associated with the combination to the first correction circuit.

8. The liquid crystal display device according to claim 7, wherein the first correction circuit outputs the image signal for correction in each of two or more consecutive drive frames including the first drive frame and outputs the image signal for display in the last drive frame.

9. The liquid crystal display device according to claim 1, wherein the gray scale level control unit further includes:

a frame memory that stores the input image signal on a frame-by-frame basis; and a comparison circuit that determines a gray scale value of a current frame of the input image signal and a gray scale value of a preceding frame stored in the frame memory, the correction value storage unit stores a correction value to be used when the gray scale value of the current frame and the gray scale value of the preceding frame of the input image signal are substantially equal to each other, when the gray scale value of the current frame and the gray scale value of the preceding frame of the input image signal are substantially equal to each other, the correction value storage unit provides to the first correction circuit a correction value associated with the gray scale value of the current frame and the gray scale value of the preceding frame, when the gray scale value of the current frame and the gray scale value of the preceding frame of the input image signal are substantially equal to each other, the first correction circuit outputs the image signal for correction obtained by correcting the gray scale value of the input image signal with the correction value provided by the correction value storage unit and outputs the gray scale value of the input image signal as the image signal for display without correcting it, and, when the gray scale value of the current frame and the gray scale value of the preceding frame of the input image signal are not substantially equal to each other, the first correction circuit outputs the gray scale value of the input image signal as the image signal for correction at least once without correcting it.

10. The liquid crystal display device according to claim 9, wherein, when the gray scale value of the current frame and the gray scale value of the preceding frame of the input image signal are not substantially equal to each other, the first correction circuit further outputs the gray scale value of the input image signal as the image signal for correction without correcting it.

11. The liquid crystal display device according to claim 1, wherein the pixel-forming unit includes a thin-film transistor having a control terminal connected with the scan line, a first conductive terminal connected with the signal line, a second conductive terminal connected with a pixel electrode to which a first correction voltage, a second correction voltage or a signal voltage is to be applied, and a channel layer formed of oxide semiconductor.

12. The liquid crystal display device according to claim 11, wherein the oxide semiconductor includes indium (In), gallium (Ga), zinc (Zn) and oxygen (O).

13. A liquid crystal display device that performs intermittent driving involving a driving period and an idle period, the liquid crystal display device comprising:

a plurality of scan lines;

a plurality of signal lines crossing the plurality of scan lines;

a pixel-forming unit provided at the intersection of each of the plurality of scan lines and each of the plurality of signal lines;

a scan line control unit that scans the plurality of scan lines by selecting one after another of the scan lines;

a gray scale level control unit that generates, from an input image signal, an image signal for display and an image signal for correction; and a signal line control unit that writes the image signal for correction to the plurality of signal lines before writing the image signal for display during a driving period, wherein the gray scale level control unit includes:

a correction value storage unit that stores a correction gray scale value associated with a gray scale value of at least a current frame of the input image signal;

a first correction circuit that corrects the input image signal based on the correction gray scale value read from the correction value storage unit; and a second correction circuit that specifies, in a pixel region including the pixel-forming unit, a regular pixel pattern including at least a first pixel and a second pixel and changes an output from the first correction circuit for the first pixel by a predetermined gray scale width, and the second correction circuit changes the output from the first correction circuit for the first pixel by increasing or decreasing it by one gray scale level, and leaves unchanged the output from the first correction circuit for the second pixel.

14. The liquid crystal display device according to claim 13, wherein the regular pixel pattern includes a total of 4 pixels with two pixels horizontally and two pixels vertically, and two of the four pixels are the first pixels.

15. The liquid crystal display device according to claim 14, wherein the first pixels are two of the four pixels that are disposed diagonally.

16. The liquid crystal display device according to claim 13, wherein, within the driving period, the length of a period in which the pixel signal for display is written is equal to the length of a period in which the image signal for correction is written.

17. The liquid crystal display device according to claim 16, wherein, within the driving period, the length of a period in which the image signal for display is written and the length of a period in which the image signal for correction is written are equal to the time that corresponds to one frame.

18. The liquid crystal display device according to claim 13, wherein the pixel-forming unit includes a thin-film transistor having a control terminal connected with the scan line, a first conductive terminal connected with the signal line, a second conductive terminal connected with a pixel electrode to which a first correction voltage, a second correction voltage or a signal voltage is to be applied, and a channel layer formed of oxide semiconductor.

19. The liquid crystal display device according to claim 18, wherein the oxide semiconductor includes indium (In), gallium (Ga), zinc (Zn) and oxygen (O).

20. A liquid crystal display device that performs intermittent driving involving a driving period and an idle period, the liquid crystal display device comprising:

a plurality of scan lines;

a plurality of signal lines crossing the plurality of scan lines;

a pixel-forming unit provided at the intersection of each of the plurality of scan lines and each of the plurality of signal lines;

a scan line control unit that scans the plurality of scan lines by selecting one after another of the scan lines;

a gray scale level control unit that generates, from an input image signal, an image signal for display and an image signal for correction; and a signal line control unit that writes the image signal for correction to the plurality of signal lines before writing the image signal for display during a driving period, wherein the gray scale level control unit includes:

a correction value storage unit that stores a correction gray scale value associated with a gray scale value of at least a current frame of the input image signal;

a first correction circuit that corrects the input image signal based on the correction gray scale value read from the correction value storage unit; and a second correction circuit that specifies, in a pixel region including the pixel-forming unit, a regular pixel pattern including at least a first pixel and a second pixel and changes an output from the first correction circuit for the first pixel by a predetermined gray scale width, and within the driving period, the length of a period in which the pixel signal for display is written is equal to the length of a period in which the image signal for correction is written.

21. The liquid crystal display device according to claim 20, wherein the regular pixel pattern includes a total of 4 pixels with two pixels horizontally and two pixels vertically, and two of the four pixels are the first pixels.

22. The liquid crystal display device according to claim 20, wherein the first pixels are two of the four pixels that are disposed diagonally.

23. The liquid crystal display device according to claim 20, wherein, within the driving period, the length of a period in which the image signal for display is written and the length of a period in which the image signal for correction is written are equal to the time that corresponds to one frame.

* * * * *